US005732689A

United States Patent [19]

Ohno et al.

[11] Patent Number: 5,732,689

[45] Date of Patent: Mar. 31, 1998

[54] AIR-FUEL RATIO CONTROL SYSTEM FOR INTERNAL COMBUSTION ENGINES

[75] Inventors: Hiroshi Ohno; Koichi Saiki; Yukio Noda; Shusuke Akazaki; Yoshitaka Takasuka; Yusuke Hasegawa, all of Wako, Japan

[73] Assignee: Honda Giken Kogyo Kabushiki Kaisha, Tokyo, Japan

[21] Appl. No.: 606,382

[22] Filed: Feb. 23, 1996

[30] Foreign Application Priority Data

Feb. 24, 1995 [JP] Japan ..... 7-061780
Feb. 27, 1995 [JP] Japan ..... 7-038857

[51] Int. Cl.[6] ..... F02D 41/14; F02D 41/22

[52] U.S. Cl. ..... 123/673; 123/688; 123/696

[58] Field of Search ..... 123/673, 688, 123/691, 694–696

[56] References Cited

U.S. PATENT DOCUMENTS

| | | | |
|---|---|---|---|
| 4,878,472 | 11/1989 | Hibino | 123/696 |
| 5,179,924 | 1/1993 | Manaka | 123/682 |
| 5,548,514 | 8/1996 | Hasegawa et al. | 123/673 |

FOREIGN PATENT DOCUMENTS

| | | |
|---|---|---|
| 59-101562 | 6/1984 | Japan . |
| 2-11842 | 1/1990 | Japan . |
| 5-180040 | 7/1993 | Japan . |

OTHER PUBLICATIONS

"Comptrol", Computer and Application's Mook, No. 27, Jul. 10, 1989, pp. 28–41.

"Automatic Control Handbook", Ohm, Ltd., Japan, 1983, pp. 703–707.

"A Survey of Model Reference Adaptive Techniques—Theory and Applications", Landau, *Automatica*, vol. 10, 1974, pp. 353–379.

"Unification of Discrete Time Explicit Model Reference Adaptive Control Designs", Landau et al, *Automatica*, vol. 17, No. 4, 1981, pp. 593–611.

"Combining Model Reference Adaptive Controllers and Stochastic Self-tuning Regulators", Landau, *Automatica*, vol. 18, No. 1, 1982, pp. 77–84.

*Primary Examiner*—Andrew M. Dolinar

*Attorney, Agent, or Firm*—Nikaido Marmelstein Murray & Oram LLP

[57] ABSTRACT

An air-fuel ratio control system for an internal combustion engine has an air-fuel ratio sensor arranged in an exhaust passage of the engine for detecting an air-fuel ratio of exhaust gases emitted from a plurality of cylinders. An output from the air-fuel ratio sensor is sampled whenever the engine rotates through a predetermined crank angle, and sampled values of the output from the air-fuel ratio sensor are sequentially stored. An output characteristic of the air-fuel ratio sensor is detected. One of the sampled values of the output from the air-fuel ratio sensor is selected at least depending on the output characteristic of the air-fuel ratio sensor. An air-fuel ratio of a mixture supplied to each of the cylinders is estimated, separately from other ones of the cylinders, based on selected ones of the sampled values of the output from the air-fuel ratio sensor and a model representative of a behavior of the exhaust passage. The air-fuel ratio of the mixture supplied to the each of the cylinders is controlled in a feedback manner responsive to the estimated air-fuel ratio of the mixture such that the estimated air-fuel ratio of the mixture supplied to the each of the cylinders is converged to a desired air-fuel ratio.

21 Claims, 54 Drawing Sheets

FIG.10A TDC SIGNAL PULSE
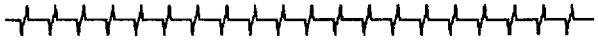
FIG.10B A/F AT CONFLUENT PORTION
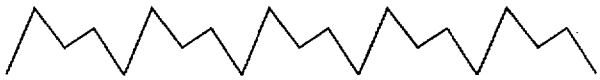
FIG.11A
FIG.11B
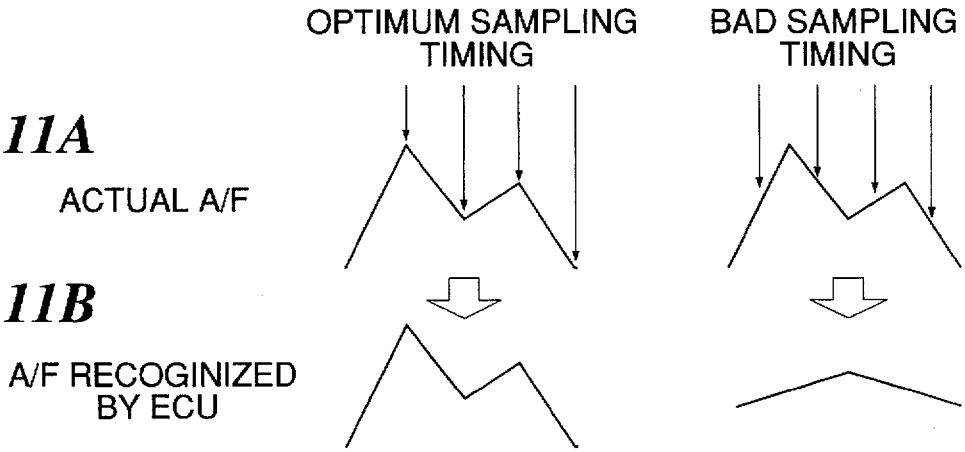

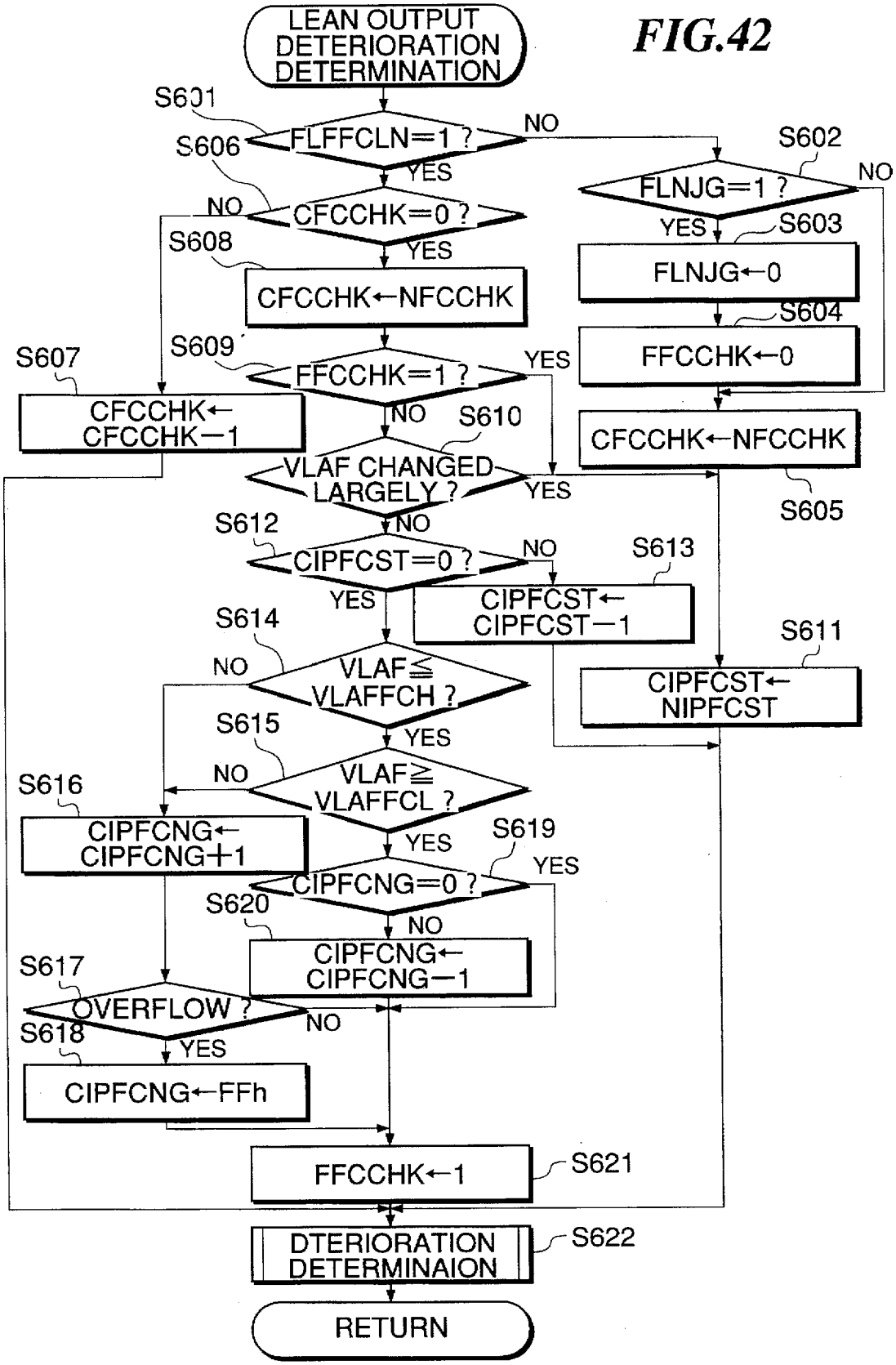
FIG.42
LEAN OUTPUT DETERIORATION DETERMINATION
S601
FLFFCLN=1 ?
NO
YES
S606
CFCCHK=0 ?
NO
YES
S608
CFCCHK←NFCCHK
S609
FFCCHK=1 ?
YES
NO
S607
CFCCHK← CFCCHK−1
S610
VLAF CHANGED LARGELY ?
YES
NO
S612
CIPFCST=0 ?
NO
YES
S613
CIPFCST← CIPFCST−1
S614
VLAF≦ VLAFFCH ?
NO
YES
S615
VLAF≧ VLAFFCL ?
NO
YES
S616
CIPFCNG← CIPFCNG+1
S619
CIPFCNG=0 ?
YES
NO
S620
CIPFCNG← CIPFCNG−1
S617
OVERFLOW ?
NO
YES
S618
CIPFCNG←FFh
FFCCHK←1
S621
DTERIORATION DETERMINAION
S622
RETURN
S602
FLNJG=1 ?
NO
YES
S603
FLNJG←0
S604
FFCCHK←0
CFCCHK←NFCCHK
S605
S611
CIPFCST← NIPFCST

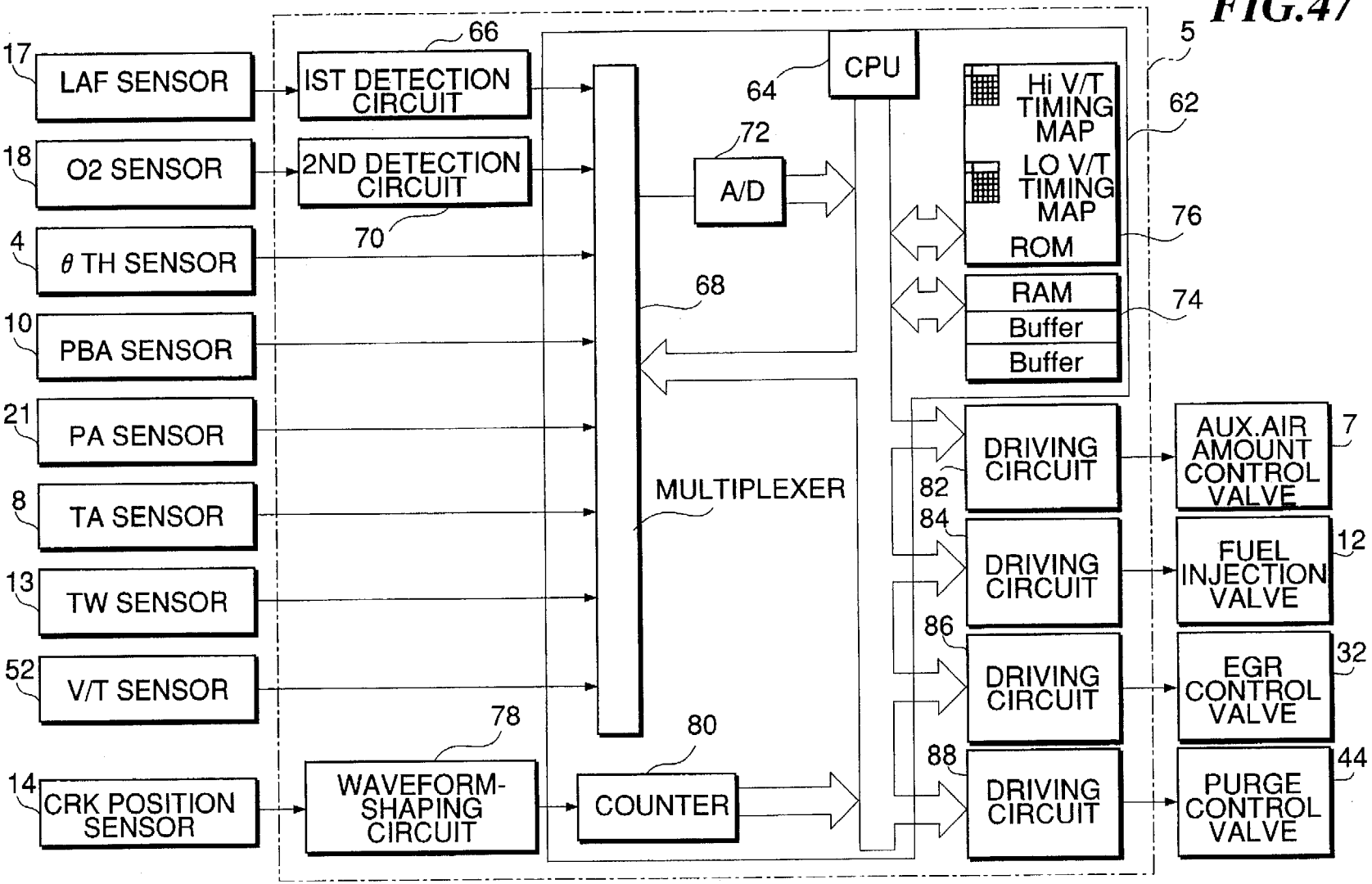
FIG.47
5
62
76
74
Hi V/T TIMING MAP
LO V/T TIMING MAP
ROM
RAM
Buffer
Buffer
DRIVING CIRCUIT
DRIVING CIRCUIT
DRIVING CIRCUIT
DRIVING CIRCUIT
AUX.AIR AMOUNT CONTROL VALVE
FUEL INJECTION VALVE
EGR CONTROL VALVE
PURGE CONTROL VALVE
7
12
32
44
82
84
86
88
CPU
64
72
A/D
68
MULTIPLEXER
80
COUNTER
66
IST DETECTION CIRCUIT
2ND DETECTION CIRCUIT
70
78
WAVEFORM-SHAPING CIRCUIT
LAF SENSOR
O2 SENSOR
θ TH SENSOR
PBA SENSOR
PA SENSOR
TA SENSOR
TW SENSOR
V/T SENSOR
CRK POSITION SENSOR
17
18
4
10
21
8
13
52
14

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which estimates the air-fuel ratio of a mixture supplied to the engine separately for each cylinder based on an output from an air-fuel ratio sensor arranged in a confluent portion of the exhaust system, and feedback-controls the amount of fuel to be injected for each cylinder separately in response to the air-fuel ratio separately estimated for each cylinder so as to minimize variations in the air-fuel ratio between the cylinders (cylinder-by-cylinder air-fuel ratio feedback control).

2. Prior Art

Conventionally, in view of the fact that a catalytic converter arranged in an exhaust passage of the engine exhibits the maximum exhaust gas-purifying efficiency when the air-fuel ratio of a mixture supplied to the engine is equal to a stoichiometric air-fuel ratio, air-fuel ratio control systems in general for internal combustion engines employ an air-fuel ratio sensor (oxygen concentration sensor) arranged in the exhaust passage and feedback-control the injection amount of fuel such that the actual air-fuel ratio detected by the air-fuel ratio sensor becomes equal to the stoichiometric air-fuel ratio (e.g. Japanese Laid-Open Patent Publication (Kokai) No. 59-101562).

However, mere provision of a single air-fuel ratio sensor in the confluent portion of the exhaust system of a multi-cylinder internal combustion engine cannot obtain accurate detected values of the air-fuel ratio separately for respective cylinders but can merely obtain a detected value of the air-fuel ratio which is a mixed value of air-fuel ratios of exhaust gases from all the cylinders. Consequently, the feedback control of the air-fuel ratio based on the air-fuel ratio thus detected by the single air-fuel ratio sensor can cause degraded exhaust emission characteristics of the engine. To solve this problem, it has been proposed by Japanese Laid-Open Patent Publication (Kokai) No. 5-180040 to employ an observer for estimating the air-fuel ratio for each cylinder in which the value of the air-fuel ratio detected by a single air-fuel ratio sensor whose output is proportional to the air-fuel ratio is applied to a theoretical model defining the behavior of the exhaust system to thereby obtain estimated values of the air-fuel ratio separately for the respective cylinders and feedback-control the air-fuel ratio for each cylinder to a desired value based on the estimated value of the air-fuel ratio. On the other hand, there is another problem that if the output signal from the air-fuel ratio sensor is sampled in synchronism with a system clock of an electronic control unit (ECU) of the engine, it is not possible to accurately detect the air-fuel ratio of exhaust gases at the confluent portion of the engine due to the fact that exhaust gases behave in a manner dependent on the rotational speed of the engine, etc. To solve this problem, it has also been proposed by the above publication to provide a sampling block (SELV) for setting the sampling timing so as to vary in a manner following up the behavior of exhaust gases to detect the air-fuel ratio of exhaust gases at the confluent portion of the exhaust system. The air-fuel ratio for each cylinder is determined based on the air-fuel ratio at the confluent portion detected by the use of the sampling block, and then the air-fuel ratio is feedback-controlled cylinder by cylinder.

The proposed cylinder-by-cylinder air-fuel ratio feedback control is advantageous not only in that it is capable of setting the air-fuel ratio separately for each cylinder but also in that an air-fuel ratio control system employing the proposed control can be simple in construction, which dispenses with the need of using a plurality of air-fuel ratio sensors arranged respectively for the cylinders.

However, the proposed control does not take into account degradation of operating characteristics of the air-fuel ratio sensor caused by aging, etc., so that if the degree of degradation exceeds a tolerance set in designing the air-fuel ratio sensor, the difference between the air-fuel ratio estimated separately for each cylinder by the use of the observer and the actual or true air-fuel ratio increases, which can unexpectedly result in degraded exhaust emission characteristics of the engine owing to the feedback control based on the erroneous estimated values of the air-fuel ratio.

More specifically, the sampling block cannot set the optimum sampling timing in a manner following up the behavior of exhaust gases if the output from the air-fuel ratio sensor per se presents a progressive deviation away from a proper or ideal value obtained when the sensor was fresh, which makes it more difficult to detect with accuracy the air-fuel ratio of exhaust gases at the confluent portion of the exhaust system. As a result, the responsiveness of the air-fuel ratio control system is degraded, so that it becomes increasingly difficult to feedback-control the air-fuel ratio in a manner suitable for each cylinder separately from other cylinders, which causes degraded exhaust emission characteristics of the engine.

Further, when the ignition key of the engine is turned off to stop the engine, the detection of the air-fuel ratio of exhaust gases is stopped. Therefore, if the air-fuel ratio sensor is aged, it is impossible to set the sampling timing to optimum timing suitable for degraded operating characteristics of the aged air-fuel ratio sensor immediately after the ignition key is turned on again after it is turned off to re-start the engine after it is turned off, which makes it impossible to accurately detect the air-fuel ratio.

SUMMARY OF THE INVENTION

It is a first object of the invention to provide an air-fuel ratio control system for an internal combustion engine, which is capable of preventing degradation of controllability of the air-fuel ratio of a mixture supplied to the engine even if an air-fuel ratio sensor employed in the control system has degraded operating characteristics.

It is a second object of the invention to provide an air-fuel ratio control system for an internal combustion engine, which is capable of performing the air-fuel ratio feedback control cylinder by cylinder in a manner suitable for operating characteristics of an air-fuel ratio sensor employed in the control system even if the sensor is aged or otherwise deteriorated.

To attain the first and second objects, according to a first aspect of the present invention, there is provided an air-fuel ratio control system for an internal combustion engine having a plurality of cylinders, and an exhaust passage connected to the plurality of cylinders, comprising:

air-fuel ratio-detecting means arranged in the exhaust passage, for detecting an air-fuel ratio of exhaust gases emitted from the cylinders;

sampling means for sampling an output from the air-fuel ratio-detecting means whenever the engine rotates through a predetermined crank angle, and for sequentially storing sampled values of the output from the air-fuel ratio-detecting means;

output characteristic-detecting means for detecting an output characteristic of the air-fuel ratio-detecting means;

selecting means for selecting one of the sampled values of the output from the air-fuel ratio-detecting means at least depending on the output characteristic of the air-fuel ratio-detecting means detected by the output characteristic-detecting means;

cylinder-by-cylinder air-fuel ratio-estimating means for estimating an air-fuel ratio of a mixture supplied to each of the cylinders, separately from other ones of the cylinders, based on selected ones of the sampled values of the output from the air-fuel ratio-detecting means and a model representative of a behavior of the exhaust passage; and cylinder-by-cylinder feedback control means for controlling the air-fuel ratio of the mixture supplied to the each of the cylinders in a feedback manner responsive to the estimated air-fuel ratio of the mixture such that the estimated air-fuel ratio of the mixture supplied to the each of the cylinders is converged to a desired air-fuel ratio.

Preferably, the air-fuel ratio control system includes operating condition-detecting means for detecting operating conditions of the engine, and the selecting means selects the one of the sampled values depending on the operating conditions of the engine detected by the operating condition-detecting means.

More preferably, the output characteristic-detecting means detects a response characteristic of the air-fuel ratio-detecting means as the output characteristic thereof, the selecting means selecting, as the one of the sampled values, a sampled value which was sampled at a later timing as a degree of deterioration of the response characteristic of the air-fuel ratio-detecting means increases.

More preferably, the selecting means includes timing-determining means for determining a timing for selecting the one of the sampled values sampled and stored, and timing correction amount-calculating means for calculating a timing correction amount for changing the timing depending on the output characteristic of the air-fuel ratio-detecting means.

Further preferably, the output characteristic-detecting means detects a response characteristic of the air-fuel ratio-detecting means, the timing correction amount-calculating means calculating the timing correction amount such that the timing is changed to a later timing as a degree of deterioration of the response characteristic of the air-fuel ratio-detecting means increases.

Further preferably, the air-fuel ratio control system includes learned value-calculating means for calculating a learned value of the timing correction amount, storing means for storing the learned value of the timing correction amount, and timing-correcting means for correcting the timing by the stored learned value of the timing correction amount.

Preferably, the output characteristic-detecting means detects, as the output characteristic of the air-fuel ratio-detecting means, deterioration of a response characteristic of the air-fuel ratio-detecting means, based on a repetition period of inversion of the air-fuel ratio with respect to a stoichiometric air-fuel ratio detected by the air-fuel ratio-detecting means, which is obtained when the air-fuel ratio detected by the air-fuel ratio-detecting means is feedback-controlled to the stoichiometric air-fuel ratio.

Preferably, the output characteristic-detecting means detects, as the output characteristic of the air-fuel ratio-detecting means, deterioration of a response characteristic of the air-fuel ratio-detecting means, based on a time period elapsed from a time point of interruption of fuel supply to the engine to a time point at which the air-fuel ratio detected by the air-fuel ratio-detecting means becomes equal to a predetermined value.

Preferably, the cylinder-by-cylinder air-fuel ratio-estimating means includes observer means for observing an internal operative state of the exhaust passage by means of the model representative of the behavior of the exhaust passage, and for estimating the air-fuel ratio of the mixture supplied to the each of the cylinders, based on the output from the air-fuel ratio-detecting means.

To attain the first object, according to a second aspect of the invention, there is provided an air-fuel ratio control system for an internal combustion engine having a plurality of cylinders, and an exhaust passage connected to the plurality of cylinders, the air-fuel ratio control system including air-fuel ratio-detecting means arranged in the exhaust passage, for detecting an air-fuel ratio of exhaust gases emitted from the cylinders, cylinder-by-cylinder air-fuel ratio-estimating means for estimating an air-fuel ratio of a mixture supplied to each of the cylinders, separately from other ones of the cylinders, based on an output from the air-fuel ratio-detecting means and a model representative of a behavior of the exhaust passage, and cylinder-by-cylinder feedback control means for controlling the air-fuel ratio of the mixture supplied to the each of the cylinders in a feedback manner responsive to the estimated air-fuel ratio of the mixture such that the estimated value of the air-fuel ratio of the mixture supplied to the each of the cylinders is converged to a desired air-fuel ratio.

The air-fuel ratio control system according to the second aspect of the invention is characterized by comprising:

stoichiometric output deterioration-detecting means for detecting stoichiometric output deterioration of the air-fuel ratio-detecting means that the output from the air-fuel ratio-detecting means corresponding to a stoichiometric air-fuel ratio deviates from a proper value by an amount exceeding a predetermined amount; and inhibiting means for inhibiting operation of the cylinder-by-cylinder feedback control means when the stoichiometric output deterioration of the air-fuel ratio-detecting means is detected by the stoichiometric output deterioration-detecting means.

Preferably, the air-fuel ratio control system includes second air-fuel ratio-detecting means having an output characteristic that an output from the second air-fuel ratio-detecting means sharply changes as the air-fuel ratio of exhaust gases changes across a narrow range including the stoichiometric air-fuel ratio, the stoichiometric output deterioration-detecting means having desired air-fuel ratio-changing means responsive to the output from the second air-fuel ratio-detecting means, for progressively changing the desired air-fuel ratio with respect to the stoichiometric air-fuel ratio, average air-fuel ratio value-calculating means for calculating an average value of values of the air-fuel ratio detected by the first-mentioned air-fuel ratio-detecting means of time points of inversion of the output of the second air-fuel ratio-detecting means caused by the progressive change of the desired air-fuel ratio; and determining means for determining that the first-mentioned air-fuel ratio-detecting means suffers from the stoichiometric output deterioration when a difference between the average value of the values of the air-fuel ratio detected by the first-mentioned air-fuel ratio-detecting means and the stoichiometric air-fuel ratio exceeds a predetermined value.

Preferably, the air-fuel ratio control system includes second air-fuel ratio-detecting means having an output characteristic that an output from the second air-fuel ratio-detecting means sharply changes as the air-fuel ratio of exhaust gases changes across a narrow range including the stoichiometric air-fuel ratio, the stoichiometric output deterioration-detecting means having determining means for determining that the first-mentioned air-fuel ratio-detecting means suffers from the stoichiometric output deterioration when an average value of a correction amount set based on the output from the second air-fuel ratio-detecting means for correcting the desired air-fuel ratio exceeds a predetermined value.

Preferably, the cylinder-by-cylinder air-fuel ratio-estimating means includes observer means for observing an internal operative state of the exhaust passage by means of the model representative of the behavior of the exhaust passage, and for estimating the air-fuel ratio of the mixture supplied to the each of the cylinders, based on the output from the air-fuel ratio-detecting means.

To attain the first object of the invention, according to a third aspect of the invention, there is provided an air-fuel ratio control system for an internal combustion engine having a plurality of cylinders, and an exhaust passage connected to the plurality of cylinders, the air-fuel ratio control system including air-fuel ratio-detecting means arranged in the exhaust passage and being capable of detecting at least leaner values of an air-fuel ratio of exhaust gases emitted from the cylinders than a stoichiometric air-fuel ratio, cylinder-by-cylinder air-fuel ratio-estimating means for estimating an air-fuel ratio of a mixture supplied to each of the cylinders, separately from other ones of the cylinders, based on an output from the air-fuel ratio-detecting means and a model representative of a behavior of the exhaust passage, and cylinder-by-cylinder feedback control means for controlling the air-fuel ratio of the mixture supplied to the each of the cylinders in a feedback manner responsive to the estimated air-fuel ratio of the mixture such that the estimated value of the air-fuel ratio of the mixture supplied to the each of the cylinders is converged to a desired air-fuel ratio.

The air-fuel ratio control system according to the third aspect of the invention is characterized by comprising:

lean output deterioration-detecting means for detecting lean output deterioration of the air-fuel ratio-detecting means that the output from the air-fuel ratio-detecting means corresponding to a predetermined value leaner than the stoichiometric air-fuel ratio deviates from a proper value by an amount exceeding a predetermined amount, the cylinder-by-cylinder feedback control means setting the desired air-fuel ratio to a value equal to or close to the stoichiometric air-fuel ratio when the lean output deterioration of the air-fuel ratio-detecting means is detected by the lean output deterioration-detecting means.

Preferably, the lean output deterioration-detecting means determines that the air-fuel ratio-detecting means suffers form the lean output deterioration when the output from the air-fuel ratio-detecting means continuously falls outside a predetermined range after a predetermined time period has elapsed from a time point of interruption of fuel supply to the engine.

More preferably, the air-fuel ratio control system includes permitting means responsive to interruption of fuel supply to the engine, for permitting the lean output deterioration-detecting means to detect the lean output deterioration of the air-fuel ratio-detecting means when the engine is operating in a lean control region in which the air-fuel ratio of the mixture is controlled to a leaner value than the stoichiometric air-fuel ratio.

Preferably, the cylinder-by-cylinder air-fuel ratio-estimating means includes observer means for observing an internal operative state of the exhaust passage by means of the model representative of the behavior of the exhaust passage, and for estimating the air-fuel ratio of the mixture supplied to the each of the cylinders, based on the output from the air-fuel ratio-detecting means.

To attain the first and second objects of the invention, according to a fourth aspect of the invention, there is provided an air-fuel ratio control system for an internal combustion engine having a plurality of cylinders, and an exhaust passage connected to the plurality of cylinders, the air-fuel ratio control system including air-fuel ratio-detecting means arranged in the exhaust passage, for detecting an air-fuel ratio of exhaust gases emitted from the cylinders, cylinder-by-cylinder air-fuel ratio-estimating means for estimating an air-fuel ratio of a mixture supplied to the each of the cylinders, separately from other ones of the cylinders, based on an output from the air-fuel ratio-detecting means and a model representative of a behavior of the exhaust passage, and cylinder-by-cylinder feedback control means for controlling the air-fuel ratio of the mixture supplied to the each of the cylinders in a feedback manner by the use of at least one of a proportional control term, an integral control term, and a differential control term, which are calculated based on the estimated air-fuel ratio of the mixture supplied to the each of the cylinders, such that the estimated value of the air-fuel ratio of the mixture supplied to the each of the cylinders is converged to a desired air-fuel ratio.

The air-fuel ratio control system according to the fourth aspect of the invention is characterized by comprising:

response deterioration-detecting means for detecting deterioration of a response characteristic of the air-fuel ratio-detecting means, the cylinder-by-cylinder feedback control means controlling the air-fuel ratio of the mixture supplied to the each of the cylinders in the feedback manner by the use of the at least one of the proportional term, the integral term, and the differential term which is changed to a smaller value when the deterioration of the response characteristic of the air-fuel ratio-detecting means is detected by the response deterioration-detecting means.

Preferably, the response deterioration-detecting means detects the deterioration of the response characteristic of the air-fuel ratio-detecting means based on a repetition period of inversion of the air-fuel ratio with respect to a stoichiometric air-fuel ratio detected by the air-fuel ratio-detecting means, which is obtained the air-fuel ratio detected by the air-fuel ratio-detecting means is feedback-controlled to the stoichiometric air-fuel ratio.

Preferably, the response deterioration-detecting means detects the deterioration of the response characteristic of the air-fuel ratio-detecting means, based on a time period elapsed from a time point of interruption of fuel supply to the engine to a time point at which the air-fuel ratio detected by the air-fuel ratio-detecting means becomes equal to a predetermined value.

Preferably, the cylinder-by-cylinder air-fuel ratio-estimating means includes observer means for observing an internal operative state of the exhaust passage by means of the model representative of the behavior of the exhaust passage, and for estimating the air-fuel ratio of the mixture supplied to the each of the cylinders, based on the output from the air-fuel ratio-detecting means.

The above and other objects, features, and advantages of the invention will become more apparent from the following detailed description taken in conjunction with the accompanying drawings.

BRIEF DESCRIPTION OF THE DRAWINGS

FIG. 10A and FIG. 10B show a timing chart showing the relationship between TDC signal pulses obtained from a multi-cylinder internal combustion engine and an air fuel ratio detected at a confluent portion of the exhaust system of the engine, in which:

FIG. 10A shows TDC signal pulses obtained from the engine; and

FIG. 10B shows the air-fuel ratio detected at the confluent portion of the exhaust system;

FIG. 11A and FIG. 11B show good and bad examples of timing of sampling an output from an air-fuel ratio sensor, in which;

FIG. 11A shows examples of sampling timing in relation to the actual air-fuel ratio; and FIG. 11B shows examples of the air-fuel ratio recognized by an ECU through sampling of the output from the air-fuel ratio sensor;

FIGS. 32A and 32B show a timing chart useful in explaining how deterioration of the LAF sensor in respect of its output with respect to a stoichiometric air-fuel ratio (stoichiometric output deterioration) is determined, in which:

FIG. 32A shows changes in the output VMO2 from O2 sensor; and

FIG. 32B shows changes in the desired air-fuel ratio KCMD;

FIGS. 33A and 33B show a timing chart useful in explaining how deterioration of the LAF sensor in respect of response (response deterioration) thereof is determined, in which:

FIG. 33A shows changes in an actual equivalent ratio KACT; and

FIG. 33B shows changes in the PID correction coefficient KLAF;

FIG. 42 is a flowchart showing a subroutine for executing a step S504 of the FIG. 36 routine for determining the lean output deterioration of the LAF sensor;

FIGS. 46A and 46B show a timing chart useful in explaining how the response deterioration of the LAF sensor is determined, in which:

FIG. 46A shows states of execution of fuel cut (F/C) and inhibition of the same;

FIG. 46B shows a change in the output VLAF from the LAF sensor;

FIG. 47 is a block diagram showing the interior construction of a control unit employed in an air-fuel ratio control system according to a second embodiment of the invention;

DETAILED DESCRIPTION

The invention will now be described in detail with reference to the drawings showing embodiments thereof.

Figure 1:
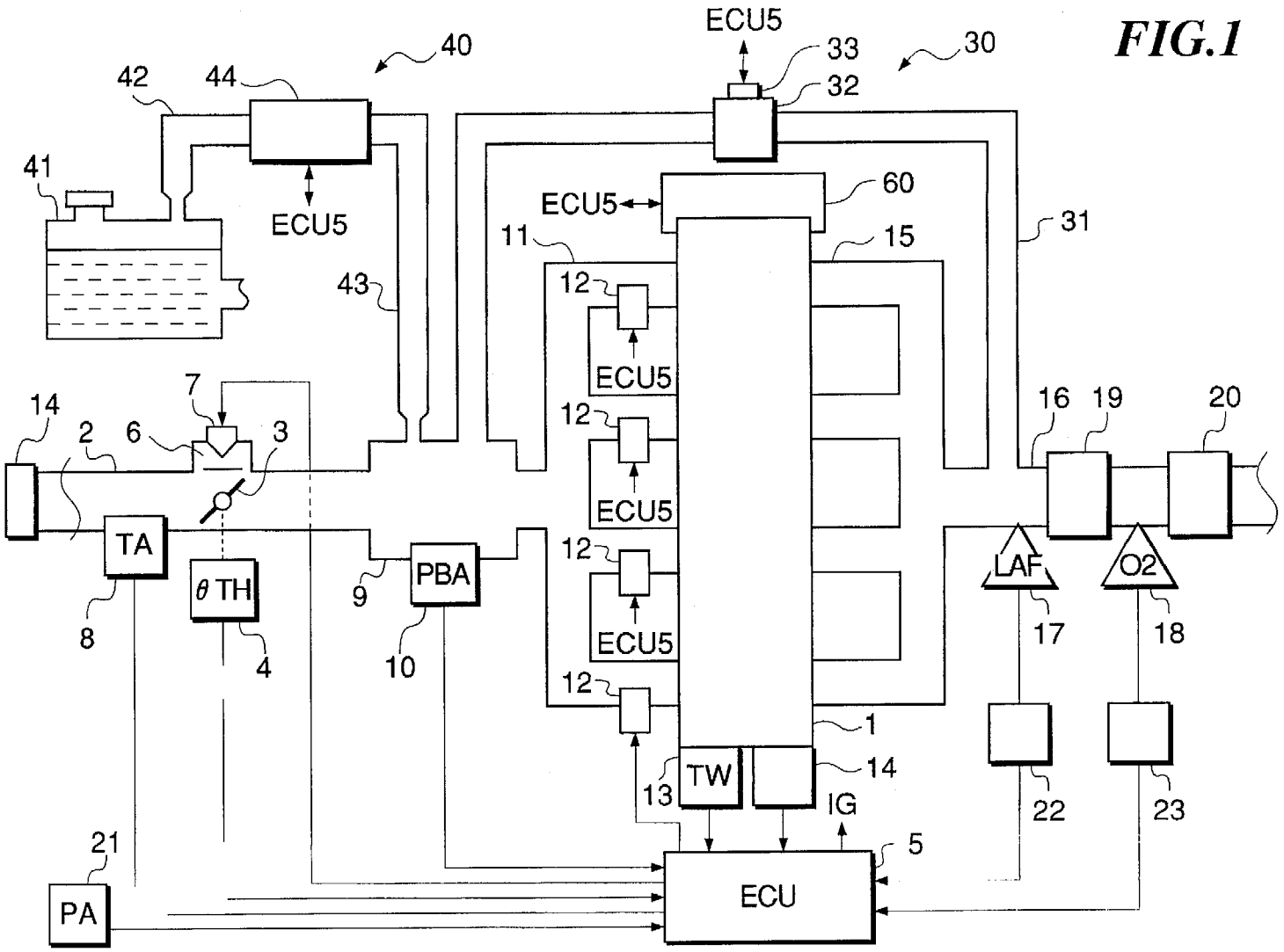
FIG. 1 is a block diagram showing the arrangement of an internal combustion engine incorporating an air-fuel ratio control system therefor, according to a first embodiment of the invention.

Referring first to FIG. 1, there is shown the whole arrangement of a DOHC straight type four-cylinder internal combustion engine (hereinafter simply referred to as "the engine") and an air-fuel ratio control system therefor, according to a first embodiment of the invention. In the figure, reference numeral 1 designates an internal combustion engine for automotive vehicles.

The engine 1 has an intake pipe 2 having an air cleaner 14 mounted on an open end thereof and a manifold part (intake manifold) 11 directly connected to the combustion chamber of each cylinder. A throttle valve 3 is arranged in the intake pipe 2 at a location upstream of the manifold part 11. A throttle valve opening ((IG) sensor 4 is connected to the throttle valve 3 for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged in the auxiliary air passage 6. The auxiliary air amount control valve 7 is connected to the ECU 7 to have an amount of opening thereof controlled by a signal therefrom 5.

An intake air temperature (TA) sensor 8 is inserted into the intake pipe 2 at a location upstream of the throttle valve 3 for supplying an electric signal indicative of the sensed intake air temperature TA to the ECU 5. The take pipe 2 has a thickened portion 9 as a chamber interposed between the throttle valve 3 and the intake manifold 11. An intake pipe absolute pressure (PBA) sensor 10 is arranged in the chamber 9 for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant for supplying an electric signal indicative of the sensed engine coolant temperature TW to the ECU 5. A crank angle position sensor 14 for detecting the rotational angle of a crankshaft, not shown, of the engine 1 is connected to the ECU 5 for supplying signals corresponding to the rotational angle of the crankshaft to the ECU 5. The crank angle position sensor 14 is comprised of a cylinder-discriminating sensor which generates a pulse (hereinafter referred to as "the CYL signal pulse") at a predetermined crank angle position of a particular cylinder of the engine assumed before a TDC position corresponding to the start of the intake stroke of the cylinder, a TDC sensor which generates a pulse (hereinafter referred to as "the TDC signal pulse") at a predetermined crank angle position of each cylinder assumed a predetermined angle before the TDC position (whenever the crankshaft rotates through 180 degrees in the case of a four-cylinder engine), and a CRK sensor which generates a pulse (hereinafter referred to as "the CRK signal pulse) at each of predetermined crank angle positions whenever the crankshaft rotates through a predetermined angle (e.g. 30 degrees) smaller than the rotational angle interval of generation of the TDC signal pulse. The CYL signal pulse, the TDC signal pulse and the CRK signal pulse are supplied to the ECU 5. These signal pulses are used for timing control in carrying out operations of the control system for determining fuel injection timing, ignition timing, etc., as well as for detecting the engine rotational speed NE.

Fuel injection valves 12 for respective cylinders are inserted into the intake manifold 11 at a location slightly upstream of intake valves, not shown, of the respective cylinders. The fuel injection valves 12 are connected to a fuel pump, not shown, and electrically connected to the ECU 5 to have their valve opening periods (fuel injection periods) and fuel injection timing controlled by signals therefrom. The engine 1 has spark plugs, not shown, provided for respective cylinders and electrically connected to the ECU 5 to have ignition timing θIG thereof controlled by signals therefrom.

An exhaust pipe 16 of the engine has a manifold part (exhaust manifold) 15 directly connected to the combustion chambers of the cylinders of the engine 1. A linear output air-fuel ratio sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17 for purifying noxious components such as HC, CO, and NOx. An oxygen concentration sensor (hereinafter referred to as "the O2 sensor") 18 is arranged between the three-way catalysts 19 and 20.

As the linear output air-fuel ratio sensor 17 is used a LAF sensor as disclosed e.g. in Japanese Laid-Open Patent Publication (Kokai) No. 2-11842 filed by the present assignee. The LAF sensor 17 has a wide range output characteristic that its output changes linearly to the concentration of oxygen in exhaust gases.

The LAF sensor 17 is connected via a low-pass filter 22 to the ECU 5 for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is connected via a low-pass filter 23 to the ECU 5 for supplying the ECU 5 with the high or low level signal.

The engine 1 is also provided with an exhaust gas recirculation system (EGR system) 30 which is comprised of an exhaust gas recirculation passage 31 connecting between the chamber 9 of the intake pipe 2 and the exhaust pipe 16, an exhaust recirculation (EGR) control valve 32 arranged in the exhaust recirculation passage 31 for controlling the amount of recirculated 20 exhaust gases, and a lift sensor 32 for detecting opening of the EGR control valve 32 and supplying a signal indicative of the sensed opening of the EGR control valve to the ECU 5. The EGR control valve 32 is formed by an electromagnetic valve having a solenoid which is connected to the ECU 5 to have its valve opening linearly changed by a control signal from the ECU 5.

Figure 2:
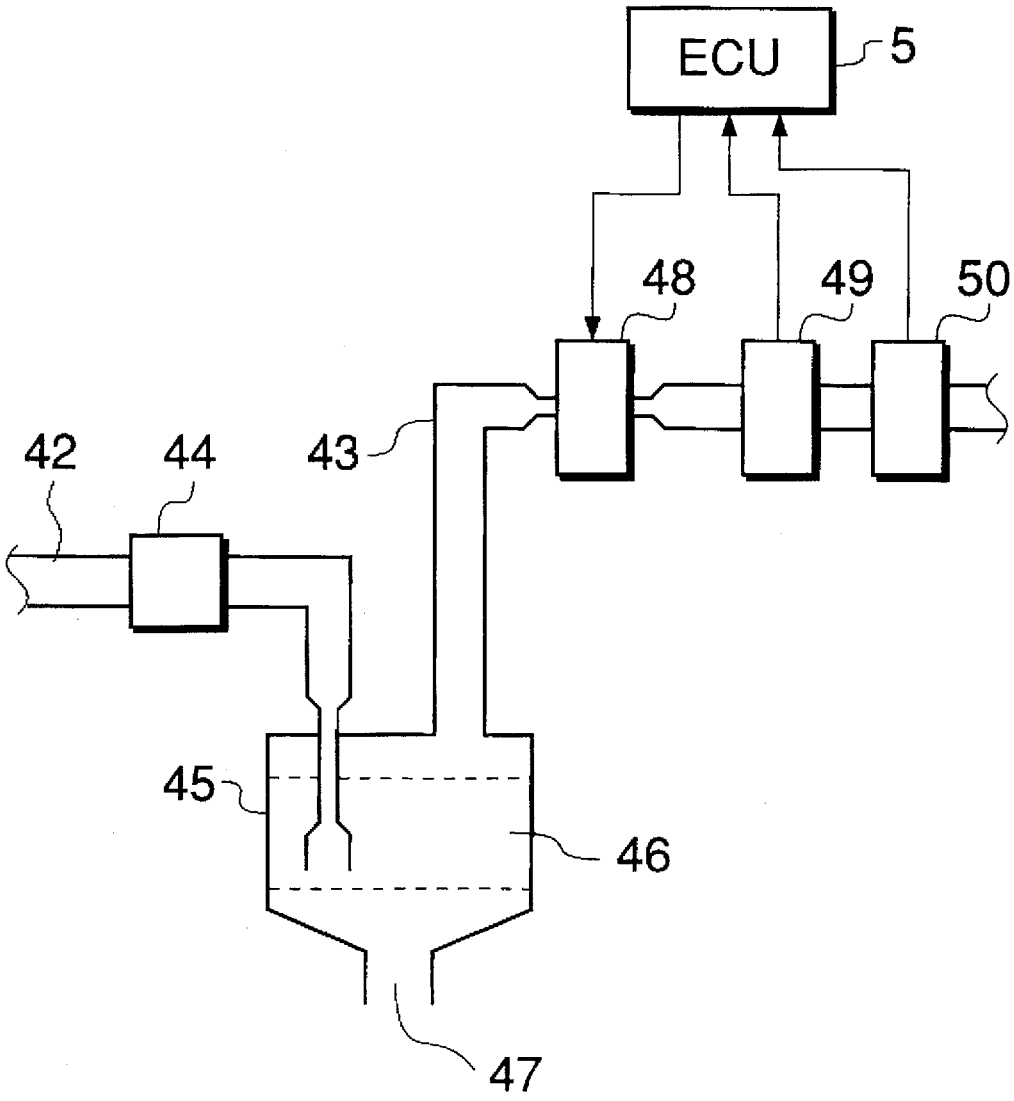
FIG. 2 is a block diagram showing details of the construction of an evaporative emission control system appearing in FIG. 1.

The engine 1 is further provided with an evaporative emission control system 40 for the engine, which will be described with reference to FIG. 2 as well. The evaporative emission control system 40 is comprised of a fuel tank 41, a canister 45, a passage 42 connecting between the tank 41 and the canister 45, and a purging passage 43 connecting between the canister 45 and the chamber 9 of the intake pipe 2. The canister 45 contains an adsorbent 46 for adsorbing evaporative fuel generated from the fuel tank 41 and is provided with an air inlet port 47 via which fresh air is introduced into the canister 45. A two-way valve 44 having a positive pressure valve and a negative pressure valve, neither of which is shown, is arranged in the passage 42, while a purge control valve 48 formed by an electromagnetic valve of a duty control type, a flowrate sensor 49 for detecting a flow rate of a mixture flowing through the passage 43, which contains evaporative fuel, and an HC concentration sensor 50 for detecting the concentration of hydrocarbons (HC) contained in the mixture, are arranged in the purging passage 43. The purge control valve 48 and the sensors 49, 50 are connected to the ECU 5. The purge control valve 48 has its valve opening controlled by a control signal from the ECU 5, and a signal indicative of the flow rate of the mixture sensed by the flowrate sensor 49 and a signal indicative of the concentration of HC sensed by the HC concentration sensor 50 are supplied to the ECU 5.

The evaporative emission control system 40 operates in the following manner: When the pressure of evaporative fuel generated within the fuel tank 41 reaches a predetermined level, the positive pressure valve of the two-way valve 44 is caused to open, thereby allowing the evaporative fuel to flow into the canister 45 for the adsorbent contained therein to adsorb the evaporative fuel for temporary storage therein. The purge control valve 48 has its valve opening/closing operation controlled by a duty control signal from the ECU 5, and during a valve opening period, the evaporative fuel temporarily stored in the canister 45 is purged into the chamber 9 together with fresh air from the air inlet port 47 due to negative pressure created in the chamber 9, via the purge control valve 48 through the purging passage 43, and supplied to each cylinder. When the negative pressure within the fuel tank 41 increases due to cooling by cold fresh air, the negative pressure valve of the two-way valve 44 opens to allow the evaporative fuel temporarily stored in the canister 45 to return to the fuel tank 41. Thus, the evaporative emission control system 40 prevents emission of evaporative fuel generated from the fuel tank 41 into the atmosphere.

The engine 1 includes a valve timing changeover mechanism 60 which changes valve timing of the intake valves and exhaust valves between a high speed valve timing suitable for a high speed operating region of the engine and a low speed valve timing suitable for a low speed operating region of the same. The changeover of the valve timing includes not only timing of opening and closing of the valve but also changeover of the valve lift amount, and further, when the low speed valve timing is selected, one of the two intake valves is rendered inoperative, thereby ensuring stable combustion within the combustion chamber even when the air-fuel ratio of the mixture is controlled to a leaner value than a stoichiometric air-fuel ratio.

The valve timing changeover mechanism 60 carries out changeover of the valve timing by means of changeover of hydraulic pressure for operating the valve, and includes an electromagnetic valve and an oil pressure sensor, neither of which is shown, which cooperate to effect the changeover of the hydraulic pressure. A signal from the oil pressure sensor is supplied to the ECU 5, and the ECU 5 controls the operation of the electromagnetic valve to effect changeover of the valve timing.

An atmospheric pressure (PA) sensor 21 is electrically connected to the ECU 5 for detecting atmospheric pressure PA, and supplying a signal indicative of the sensed atmospheric pressure PA to the ECU 5.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit(hereinafter referred to as "the CPU"), a memory device comprised of a ROM storing various operational programs which are executed by the CPU and various maps, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors including the LAF sensor 17 and the O2 sensor 18 to determine various operating conditions in which the engine 1 is operating, such as an air-fuel ratio feedback control region in which the air-fuel ratio is controlled in response to outputs from the LAF sensor 17 and the O2 sensor 18, and open-loop control regions other than these regions, and calculates, based upon the determined operating conditions, the valve opening period or fuel injection period TOUT over which the fuel injection valves 12 are to be opened, by the use of the following equation (1) in synchronism with inputting of TDC signal pulses to the ECU 5, to deliver driving signals to the fuel injection valves 12, which are based on results of the calculation:

$$TOUT(N)=TIMF\times KTOTAL\times KCMDM\times KLAF\times KOBSV\#N \quad (1)$$

Figure 3:
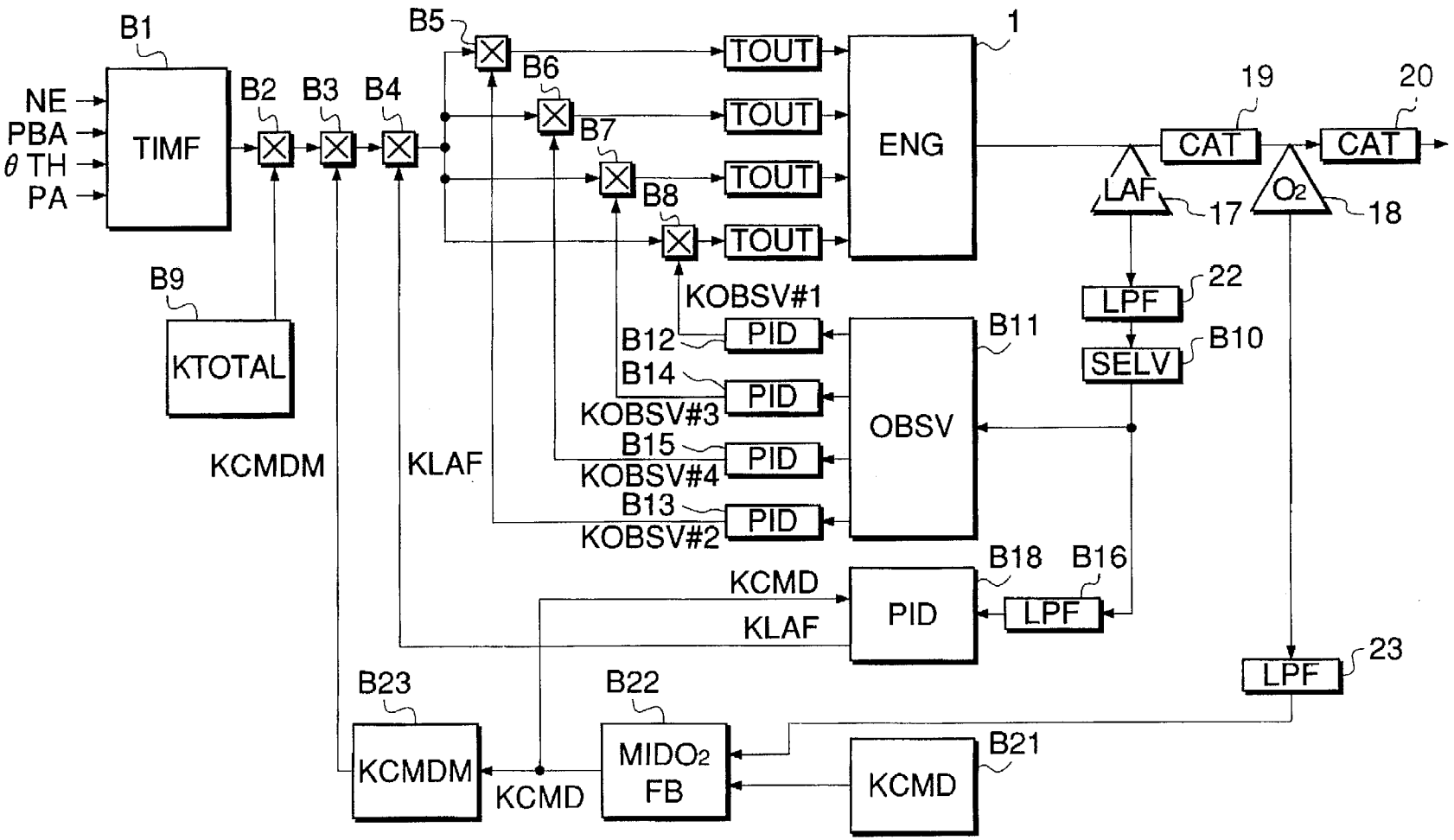
FIG. 3 is a block diagram useful in explaining the functions of the air-fuel ratio control system and a manner of controlling the air-fuel ratio of a mixture supplied to the engine.

FIG. 3 shows a block diagram which is useful in explaining a manner of calculation of the fuel injection period TOUT(N) by the use of the equation (1). With reference to the figurer an outline of the manner of calculation of the fuel injection period TOUT(N) according to the present embodiment will be described. The suffix (N) represents a cylinder number, and a parameter with this suffix is calculated cylinder by cylinder. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 3, a block B1 calculates a basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B8 designate multiplying blocks, which each multiply the basic fuel amount TIMF by parameter values input thereto, and deliver the product values. These blocks carry out the arithmetic operation of the equation (1), and outputs from the multiplying blocks B5 to B8 provide fuel injection amounts TOUT(N) for the respective cylinders.

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purge-dependent correction coefficient KPUG set according to the amount of purged fuel during execution of purging of evaporative fuel by the evaporative emission control system 40, to obtain the correction coefficient KTOTAL, which is supplied to the block B2.

A block B21 determines a desired air-fuel ratio coefficient KCMD based on the engine rotational speed NE, the intake pipe absolute pressure PBA, etc. and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to a block B18 and the block B23. The block B23 carries out fuel cooling-dependent correction of the corrected KCMD value to calculate a final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, stores the sampled values sequentially into a ring buffer memory, not shown, and selects one of the stored values depending on operating conditions of the engine (LAF sensor output-selecting processing), which was sampled at the optimum timing for each cylinder, to supply the selected value to a block B11 and the block B18 via a low-pass filter block B16. The LAF sensor output-selecting processing eliminates the inconvenience that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B18 calculates a PID correction coefficient KLAF through PID control based on the difference between the actual air-fuel ratio and the desired air-fuel ratio and supplies the same to the block B4.

The block B11 has the function of a so-called observer, estimates a value of the air-fuel ratio separately for each cylinder from the air-fuel ratio detected at the confluent portion of the exhaust system (from a mixture of exhaust gases emitted from the cylinders) by the LAF sensor 17, and supplies the estimated value to a corresponding one of blocks B12 to B15 associated, respectively, with the four cylinders. In FIG. 3, the block B12 corresponds to a cylinder #1, the block B13 to a cylinder #2, the block B14 to a cylinder #3, and the block B15 to a cylinder #4. The blocks B12 to B15 calculate the cylinder-by-cylinder correction coefficient KOBSV#N(N=1 to 4) by the PID control such that the air-fuel ratio of each cylinder (the value of the air-fuel ratio estimated by the observer B11 for each cylinder) becomes equal to a value of the air-fuel ratio detected at the confluent portion, and supplies the calculated values to the blocks B5 to B8, respectively.

As described above, in the present embodiment, the fuel injection amount TOUT(N) is calculated cylinder by cylinder by applying to the equation (1) the PID correction coefficient KLAF calculated by the PID control based on the output from the LAF sensor 17 and further the cylinder-by-cylinder correction coefficient KOBSV#N, which is set according to the air-fuel ratio value of each cylinder estimated based on the output from the LAF sensor 17. Variations in the air-fuel ratio between the cylinders can be eliminated by the use of the cylinder-by-cylinder correction coefficient KOBSV#N to thereby improve the purifying efficiency of the catalysts and hence achieve excellent exhaust emission characteristics of the engine in various operating conditions.

In the present embodiment, the functions of the blocks appearing in FIG. 3 are realized by arithmetic operations executed by the CPU of the ECU 5, and details of the operations will be described with reference to program routines illustrated in the drawings.

Figure 4:
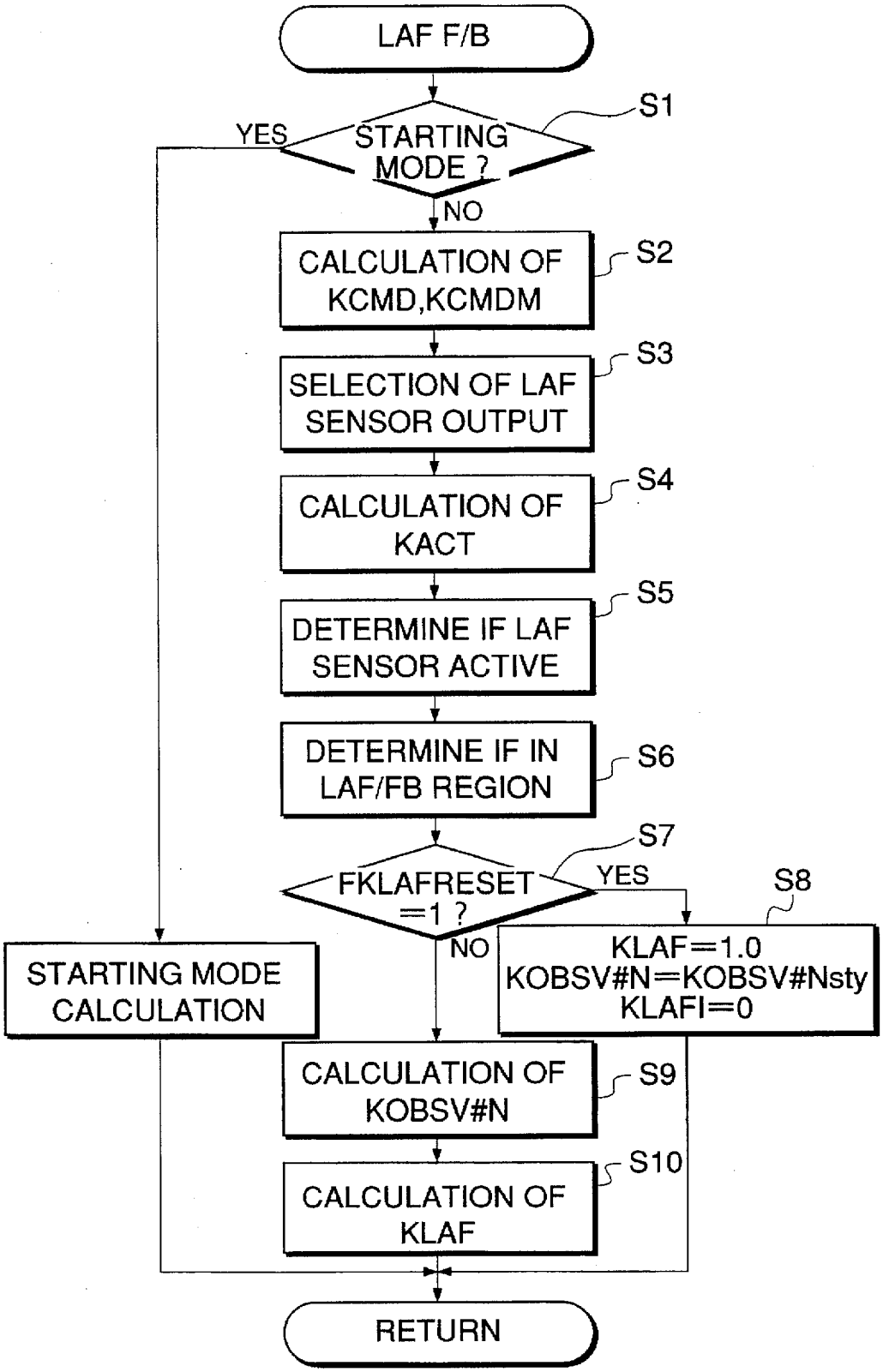
FIG. 4 is a flowchart showing a routine for calculating a PID correction coefficient KLAF and a cylinder-by-cylinder correction coefficient KOBSV#N in response to an output from a LAF sensor appearing in FIG. 1.

FIG. 4 shows a routine for calculating the PID correction coefficient KLAF and the cylinder-by-cylinder correction coefficient KOBSV#N. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S11 to execute a subroutine for the starting mode. If the engine is not in the starting mode, the desired air-fuel ratio coefficient (desired equivalent ratio) KCMD and the final desired air-fuel ratio coefficient KCMDM are calculated at a step S2, and the LAF sensor output-selecting processing is executed at a step S3. Further, the actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region e.g. when the LAF sensor 17 has been activated but at the same time neither fuel cut nor wide open throttle operation is being carried out. If it is determined at this step that the engine is not in the LAF feedback control region, a reset flag FKLAFRESET is set to "1", whereas if it is determined that the engine is in the LAP feedback control region, the KLAF reset flag FKLAFRESET is set to "0".

At the following step S7, it is determined whether or not the KLAF reset flag FKLAFRESET assumes "1". If FKLAFRSET=1 holds, the program proceeds to a step S8, wherein the PID correction coefficient KLAF is set to "1.0", and the cylinder-by-cylinder correction coefficient KOBSV#N is set to a learned value KOBSV#Nsty thereof, referred to hereinafter, and an integral term KLAFI used in the PID control is set to "0", followed by terminating the program. By setting the cylinder-by-cylinder correction coefficient KOBSV#N to the learned value KOBSV#Nsty thereof, it is possible to ensure required stability of the engine operation during the feedforward control, thereby preventing a misfire of the engine ascribable to a change in the mechanical parts of the fuel supply system due to aging, as well as undesired variation of rotation of the engine.

On the other hand, if FKLAFRESET=0 holds at the step S7, the cylinder-by-cylinder correction coefficient KOBSVS#N is calculated by the observer B11 at a step S9, and then, the PID (air-fuel ratio feedback control) correction coefficient KLAF is calculated at a step S10 by the use of the KOBSV#N value obtained at the step S9, followed by terminating the program.

Figure 5:
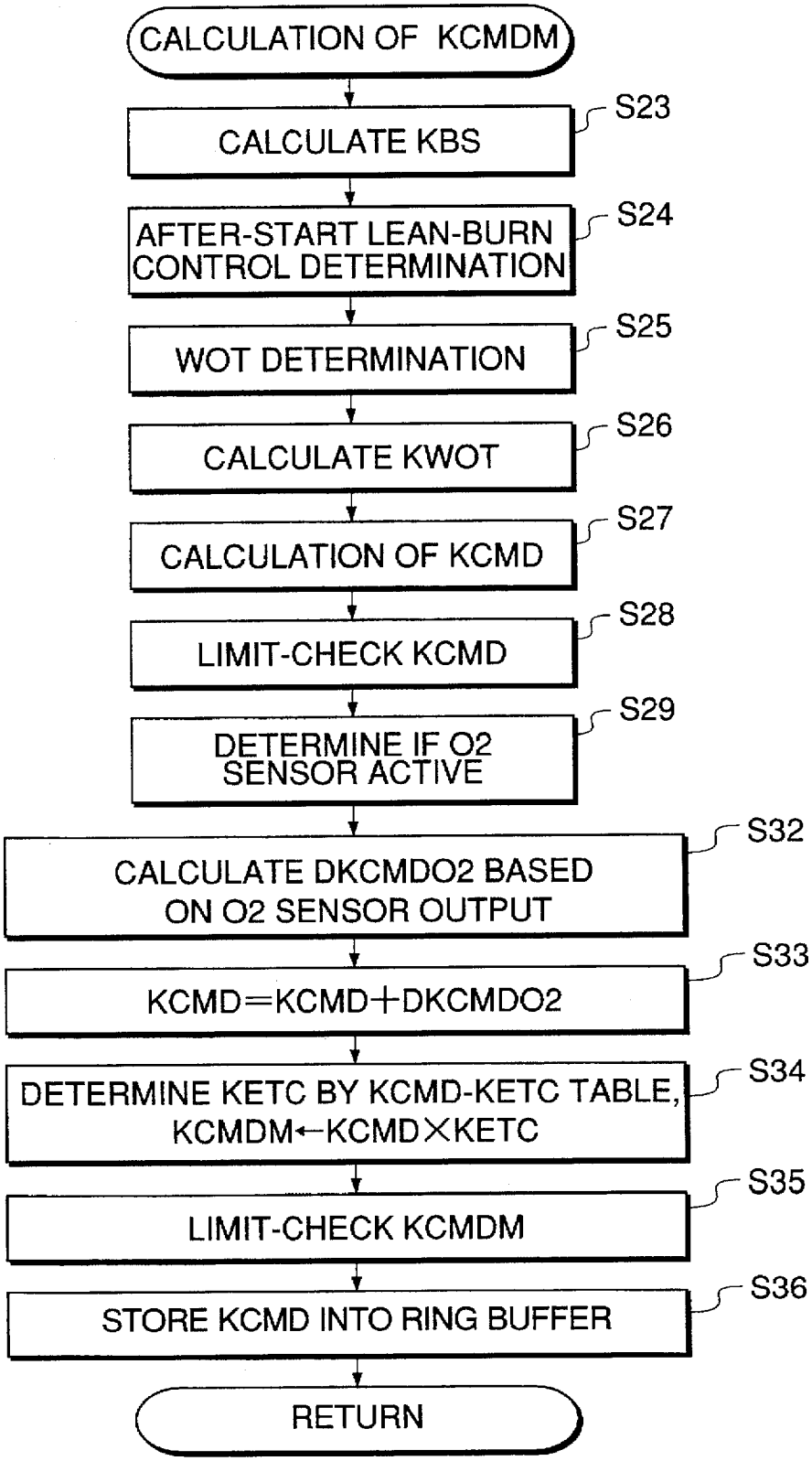
FIG. 5 is a flowchart showing a subroutine for executing a step S2 of the FIG. 4 routine for calculating a final desired air-fuel ratio correction coefficient KCMDM.

FIG. 5 shows a subroutine for executing the step S2 of the FIG. 4 routine to calculate the final desired air-fuel ratio correction coefficient KCMDM.

At a step S23, a basic value KBS is determined by retrieving a map according to the engine rotational speed NE and the intake pipe absolute pressure PBA. More specifically, the map contains map values of the basic value KBS of the desired air-fuel ratio corresponding to the engine rotational speed NE and the intake pipe absolute pressure PBA, and is stored in the ROM in advance, for use in a steady operating condition of the engine. The map also contains map values of the basic value KBS for use in an idling condition of the engine. Further, the map also contains map values of the basic value KBS for use in lean-burn control for increasing the air-fuel ratio (i.e. decreasing the equivalent ratio) of the mixture supplied to the engine when load on the engine is low, to thereby enhance combustion characteristics of the engine.

At the following step S24, it is determined whether or not conditions for carrying out after-start lean-burn control immediately after the start of the engine are fulfilled. If the conditions are fulfilled, an after-start leaning flag FASTLEAN is set to "1", whereas if they are not fulfilled, the flag FASTLEAN is set to "0". The conditions are fulfilled e.g. when the engine coolant temperature TW, the engine rotational speed NE and the intake pipe absolute pressure PBA fall within respective predetermined ranges before a predetermined time period elapses after the start of the engine. It should be noted that the after-start lean-burn control is carried out for the purpose of preventing an increase in emission of HC occurring when the catalysts are inactivated immediately after the start of the engine, as well as reducing the fuel consumption. More specifically, this determination is carried for the following reason: The engine 1 is equipped with the valve timing changeover mechanism 60, and during cranking of the engine 1 (during the starting mode of the engine), the lean-burn control is carried out by making one of the intake valves of each cylinder inoperative to set the air-fuel ratio to a slightly leaner than the stoichiometric air-fuel ratio, so as to prevent the amount of hydrocarbons (HC) from increasing even during the starting mode of the engine in which the three-way catalysts have not been activated. In the case of an ordinary engine (i.e. having no valve timing changeover mechanism) with two intake valves provided for each cylinder, if the desired air-fuel ratio is set to a value leaner than the stoichiometric air-fuel ratio, the combustion of the engine becomes unstable, which may cause a misfire. The engine to which is applied the air-fuel ratio control system according to the present embodiment is equipped with the valve timing changeover mechanism 60. Accordingly, when one of the intake valves is made inoperative, a vortex flow, i.e. a so-called swirl, is produced in the combustion chamber, which makes it possible to obtain stable combustion even if the air-fuel ratio of the mixture supplied to the engine is made leaner than the stoichiometric air-fuel ratio immediately after the start of the engine.

Then, at a step S25, it is determined whether or not the throttle valve is fully open (i.e. the engine is in a WOT condition). If the throttle valve is fully open, a WOT flag FWOT is set to "1", whereas if the throttle valve is not fully open, the same flag is set to "0". Then, an enriching correction coefficient KWOT is calculated according to the engine coolant temperature TW at a step S26. At the same time, a correction coefficient KXWOT to be applied in a high coolant temperature condition is also calculated.

At the following step S27, the desired air-fuel ratio coefficient KCMD is calculated, and then limit-checking of the calculated KCMD value is carried out to limit the KCMD value within a range defined by predetermined upper and lower limit values at a step S28. A subroutine for executing the step S27 will be described in detail hereinafter with reference to FIG. 6.

At the following step S29, it is determined whether or not the O2 sensor 18 has been activated. If the O2 sensor 18 has been activated, an activation flag FO2 is set to "1", whereas if the O2 sensor has not been activated, the same flag is set to "0". The O2 sensor 18 is determined to have become activated e.g. when a predetermined time period has elapsed after the start of the engine. Alternatively, the activation of the O2 sensor 18 may be determined by executing a subroutine for detecting a change in the output voltage VMO2 from the O2 sensor 18.

At the following step S32, a correction term DKCMDO2 for correcting the desired air-fuel ratio coefficient KCMD is calculated according to the output VMO2 from the O2 sensor 18. More specifically, the correction term DKCMDO2 is calculated by the PID control according to the difference between the O2 sensor output VMO2 and a reference value VREFM, and details of the calculation of the correction term DKCMDO2 will be described hereinafter with reference to FIG. 7.

At a step S33, the desired air-fuel ratio coefficient KCMD is corrected by the use of the following equation (2):

$$KCMD=KCMD+DKCMDO2 \quad (2)$$

This correction makes it possible to set the desired air-fuel ratio coefficient KCMD such that a deviation of the LAF sensor output from a proper value is corrected.

At the following step S34, a KCMD-KETC table is retrieved according to the calculated KCMD value, and the final desired air-fuel ratio coefficient KCMDM is calculated by the use of the following equation (3):

$$KCMDM=KCMD\times KETC \quad (3)$$

The correction coefficient KETC compensates for the influence of fuel cooling effects caused by fuel injection, the degree of which increases as the KCMD value increases to increase the fuel injection amount. The correction coefficient KETC is set to a larger value as the KCMD value is larger.

Then, limit-checking of the calculated KCMDM value is carried out at a step S35, and the KCMD value obtained at the step S33 is stored in a ring buffer memory at a step S36, followed by terminating the subroutine.

Figure 6:
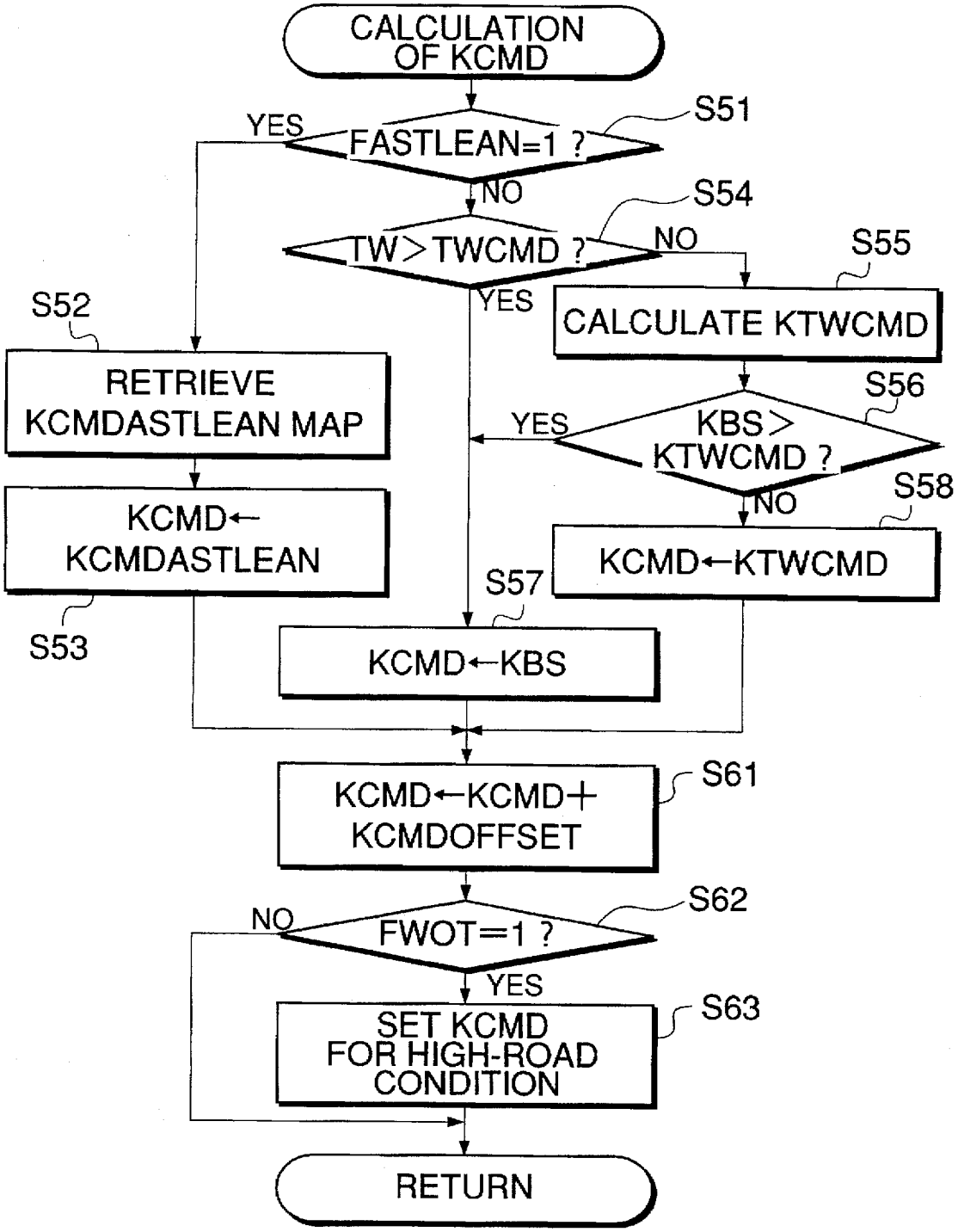
FIG. 6 is a flowchart showing a subroutine for executing a step S27 of the FIG. 5 subroutine for calculating a desired air-fuel ratio coefficient KCMD.

FIGS. 6 shows the aforementioned subroutine for executing the step S27 of the FIG. 5 subroutine to calculate the desired air-fuel ratio coefficient KCMD.

First, at a step S51, it is determined whether or not the after-start leaning flag FASTLEAN set at the step S24 of the FIG. 5 subroutine is equal to "1". If FASTLEAN=1 holds, the program proceeds to a step S52, wherein a KCMDASTLEAN map is retrieved to read a lean desired value KCMDASTLEAN corresponding to a central air-fuel ratio during execution of the lean-burn control. The KCMDASTLEAN map contains map values set according to the engine coolant temperature TW and the intake pipe absolute pressure PBA. Then, the desired air-fuel ratio coefficient KCMD is set to the lean desired value KCMDASTLEAN at a step S53, followed by the program proceeding to a step S61.

On the other hand, if FASTLEAN=0 holds at the step S51, which means that the conditions for executing the after-start lean-burn control are not fulfilled, it is determined at a step S54 whether or not the engine coolant temperature TW is higher than a predetermined value TWCMD (e.g. 80° C.). If TW>TWCMD holds at the steps S54, the desired air-fuel ratio coefficient KCMD is set to the basic value KBS calculated at the step S23 of the FIG. 5 subroutine at a step S57, and then the program proceeds to the step S61, whereas if TW≦TWCMD holds at the step S54, the aforementioned map is retrieved according to the engine coolant temperature TW and the intake pipe absolute pressure PBA to determine a desired air-fuel ratio KTWCMD suitable for a low engine coolant temperature condition at a step S55, and then it is determined at a step S56 whether or not the basic value KBS is larger than the desired air-fuel ratio KTWCMD. If KBS>KTWCMD holds at the step S56, the program proceeds to the step S57, while KBS≦KTWCMD holds, the basic value KBS is replaced by the desired air-fuel ratio KTWCMD suitable for the low engine coolant temperature condition at a step S58, followed by the program proceeding to the step S61.

Figure 7:
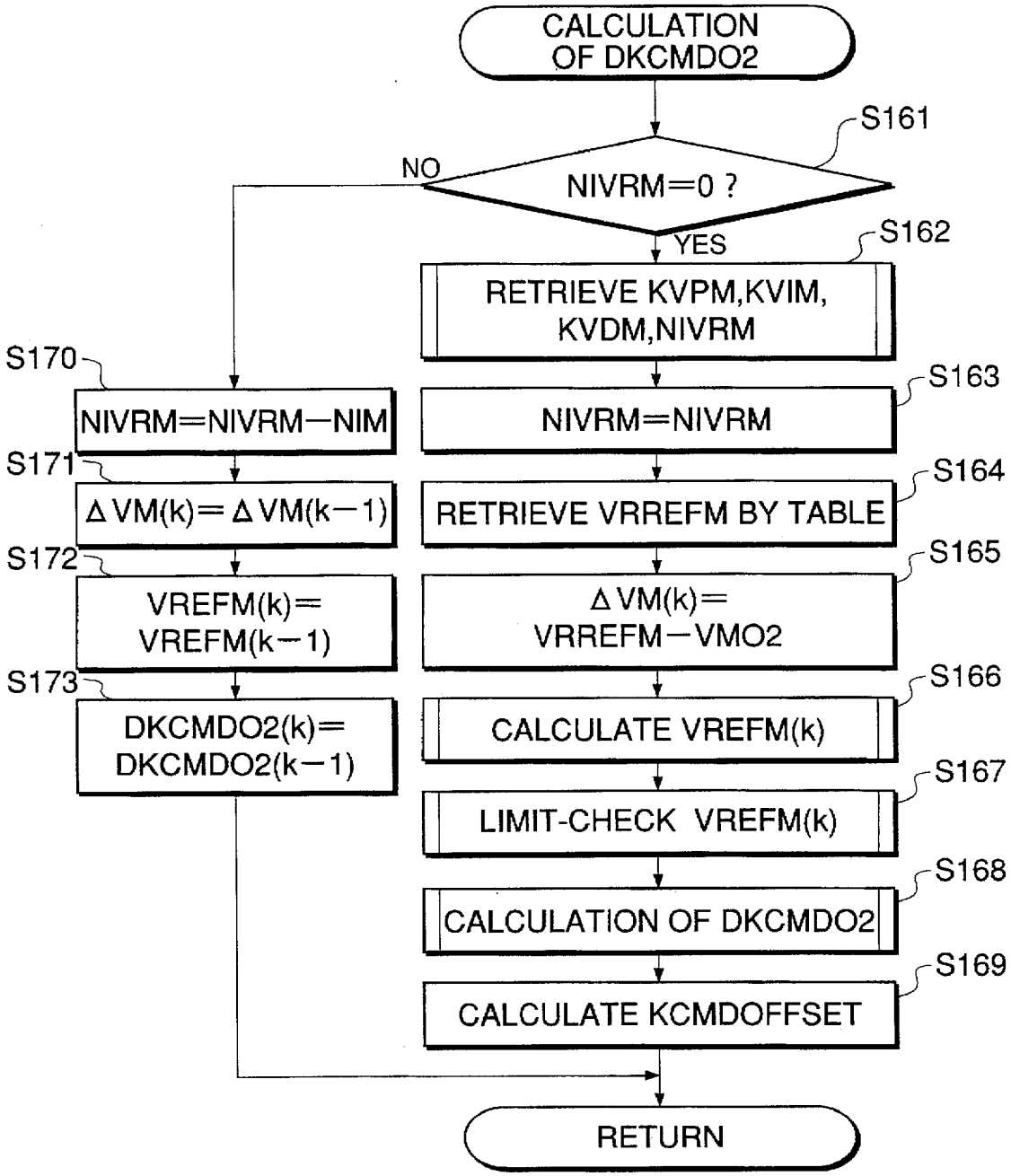
FIG. 7 is a flowchart showing a subroutine for executing a step S32 of the FIG. 5 subroutine for determining a correction term DKCMDO2 for correcting the desired air-fuel ratio KCMD based on the output from the O2 sensor.
Figure 8:
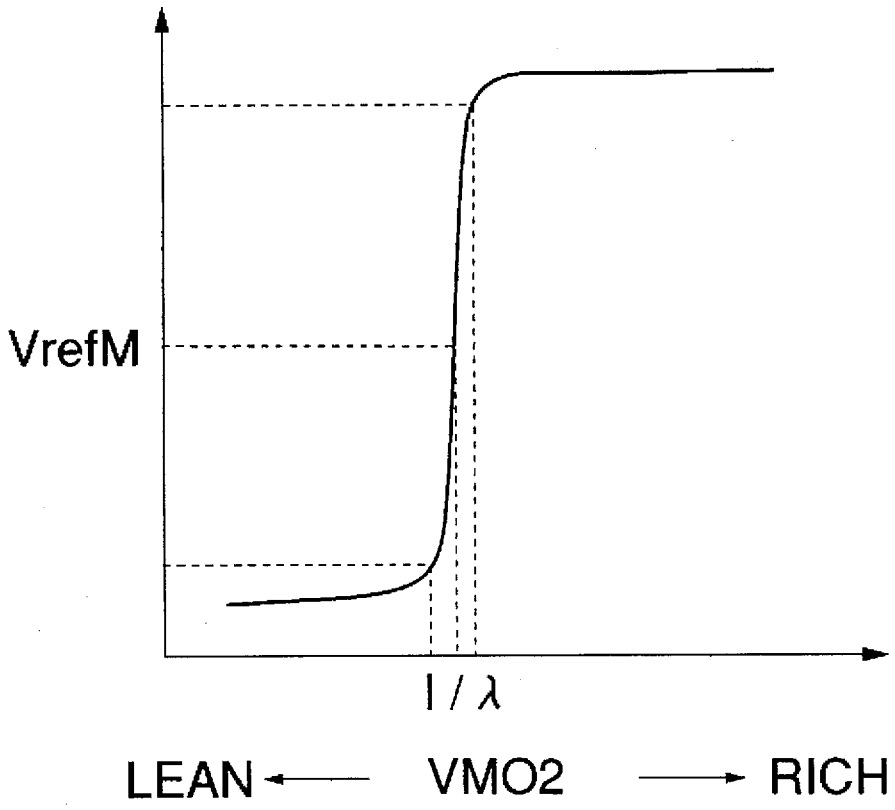
FIG. 8 is a diagram which is useful in explaining characteristics of an output VMO2 from an O2 sensor appearing in FIG. 1.

At the step S61, the desired air-fuel ratio coefficient KCMD is corrected by the use of the following equation (4), followed by the program proceeding to a step S62.

$$KCMD=KCMD+KCMDOFFSET \quad (4)$$

where KCMDOFFSET represents an addend term for fine control of the air-fuel ratio within a narrow air-fuel ratio range or window, set as shown in FIG. 8 in the vicinity of the stoichiometric air-fuel ratio, in which the output VMO2 from the O2 sensor 19 exhibits a linear characteristic (indicated by broken lines parallel to the ordinate). The addend term KCMDOFFSET is a parameter for reflecting variations in operating characteristics of the exhaust system, the LAF sensor, etc. and influence of aging of these components, on the desired air-fuel ratio KCMD for fine control to set the same to the optimum value within the window for the best performance of the three-way catalyst. This parameter is calculated by a subroutine described hereinafter with reference to FIG. 7.

At the step S62, it is determined whether or not the WOT flag FWOT set at the step S25 of the FIG. 5 subroutine assumes "1". If FWOT=0 holds at the step S62, the present program is immediately terminated, whereas if FWOT=1 holds at the step S62, the desired air-fuel ratio coefficient KCMD is set to a value suitable for a high-load condition of the engine at a step S63, followed by terminating the program. The step S63 is executed more specifically by comparing the KCMD value with the enriching correction coefficients KWOT and KXWOT for the high-load condition of the engine calculated at the step S26 of the FIG. 5 routine, and if the KCMD value is smaller than these values, the KCMD value is multiplied by the correction coefficient KWOT or KXWOT for correction.

FIG. 7 shows the subroutine for executing the step S32 of the FIG. 5 subroutine for calculating the correction term DKCMDO2.

First, at a step S161, it is determined whether or not a thinning variable NIVRM, i.e. the count of an NIVRM counter is equal to "0". The thinning variable NIVRM is subtracted by a decremental value NIM set according to operating conditions of the engine whenever a TDC signal pulse is generated, as will be described hereinafter. When this step is first executed, the thinning variable NIVRM is equal to "0", and hence the answer to the question of the step S161 is affirmative (YES), so that the program proceeds to a step S162.

When the answer to the question of the step S161 becomes negative (NO) in any subsequent loop, the program proceeds to a step S170.

At the step S162, control gains for determining a rate of change of the control amount or the fuel injection period TOUT used in the feedback control responsive to the output from the O2 sensor 18, i.e. a proportional term (P term) coefficient KVPM, an integral term (I term) coefficient KVIM, a differential term (D term) coefficient KVDM, and the thinning variable NIVRM, are calculated by retrieving a KVPM map, a KVIM map, a KVDM map, and a NIVRM map, respectively. These maps each contain predetermined map values set for a plurality of engine operating regions, respectively, determined according to the engine rotational speed NE and the intake pipe absolute pressure PBA. These maps are retrieved to read respective control gain values therefrom which correspond to operating conditions of the engine, and the read values are subjected to interpolation, if required.

Then, at a step S163, the thinning variable NIVRM is set to a NIVRM value calculated at the step S162, and then a VRREFM table is retrieved at a step S164 to determine a reference value VRREFM of the output voltage VMO2 from the O2 sensor 18. The reference voltage VRREFM is determined according to the atmospheric pressure PA, the engine coolant temperature TW, the volume of exhaust gases (which can be determined based on the engine rotational speed and the intake pipe absolute pressure PBA). Then, at a step S165, the difference ΔVM(k) between the reference value VRREFM and the present value of the output voltage VMO2 from the O2 sensor 18 is calculated by the use of the following equation:

$$\Delta VM(k)=VRREFM-VMO2 \quad (4)$$

At the following step S166, desired values VREFPM(k) of the P term, VREFIM(k) of the I term, and VREFDM(k) of the D term are calculated by the use of the following equations (5A), (5B) and (5C), and the desired correction value VREFM(k) is calculated by adding together these correction terms:

$$VREFPM(k)=\Delta VM(k)+KVPM \quad (5A)$$

$$VREFIM(k)=VREFIM(k-1)+\Delta VM(k)\times KVIM \quad (5B)$$

$$VREFDM(k)=(\Delta VM(k)-\Delta VM(k-1))\times KVDM+VREFDM(k) \quad (5C)$$

Then, at a step S167, limit-checking of the desired correction value VREFM(k) is carried out to thereby limit the desired correction value VREFM and the I term VREFIM within respective ranges each determined by predetermined upper and lower limit values thereof.

After the limit-checking of the VREFM(k) value, the program proceeds to a step S168, wherein the correction term DKCMDO2 is calculated.

Figure 9:
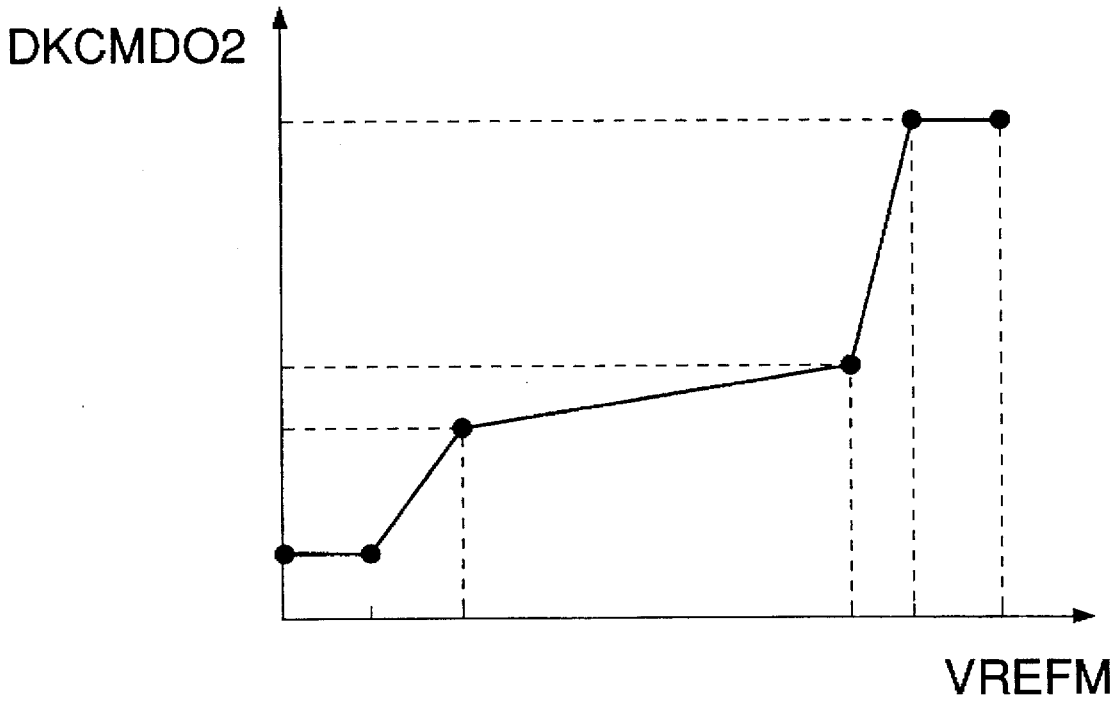
FIG. 9 shows a table used in the FIG. 7 subroutine for determining the correction term DKCMDO2.

More specifically, the correction term DKCMDO2 is calculated by retrieving a DKCMDO2 table set e.g. as shown in FIG. 9. That is, the DKCMDO2 table is set such that the correction term DKCMDO2 assumes a larger value as the desired correction value VREFM is larger. Further, since the limit-checking of the VREFM value has been carried out at the step S167, the correction term DKCMDO2 is also limited by the limit-checking to a range determined by predetermined upper and lower limit values.

Then, at a step S169, the addend term KCMDOFFSET is calculated through averaging of the correction term DKCMDO2 by the use of the following equation:

$$KCMDOFFSET=\alpha+DKCMDO2+(1-\alpha)\times KCMDOFFSET \quad (6)$$

where KCMDOFFSET on the right side represents the immediately preceding value of the addend term, and α represents an averaging coefficient set to a value between 0 and 1.

The addend term KCMDOFFSET thus calculated is added to the desired air-fuel ratio coefficient KCMD, which makes it possible to suppress the influence of variations in operating characteristics of the exhaust system and the LAF sensor as well as aging of the LAF sensor on the air-fuel ratio control.

On the other hand, if NIVRM>0 holds at the step S161, the count of the NIVRM counter is decreased by the decremental NIM at a step S170, and the difference ΔvM, the desired correction value VREFM, and the correction term DKCMDO2 are held at the immediately preceding values thereof at steps S171, S172, and S173, respectively, followed by terminating the program.

Next, the LAF sensor output-selecting processing at the step S3 of the FIG. 4 routine will be described.

Exhaust gases are emitted from the engine on the exhaust stroke, and accordingly clearly the behavior of the air-fuel ratio detected at the confluent portion of the exhaust system of the multi-cylinder engine is synchronous with generation of each TDC signal pulse. Therefore, detection of the air-fuel ratio by the LAF sensor 17 is also required to be carried out in synchronism with generation of each TDC signal pulse. However, depending on the timing of sampling the output from the LAF sensor 17, there are cases where the behavior of the air-fuel ratio cannot be accurately grasped. For example, if the air-fuel ratio detected at the confluent portion of the exhaust system varies as shown in FIG. 10B in comparison with timing of generation of each TDC signal pulse shown in FIG. 10A, the air-fuel ratio recognized by the ECU 5 can have quite different values depending on the timing of sampling, as shown in FIG. 11B. Therefore, it is desirable that the sampling of the output from the LAF sensor 17 should be carried out at such timing as enables the ECU 5 to recognize actual variation of the sensor output, as shown in FIG. 11A, as accurately as possible.

Further, the variation of the air-fuel ratio also depends upon a time period required to elapse before exhaust gases emitted from the cylinder reach the LAF sensor 17 as well as upon the response time of the LAF sensor 17. The required time period depends on the pressure and volume of exhaust gases, etc. Further, sampling of the sensor output in synchronism with generation of each TDC signal pulse is equivalent to sampling of the same based on the crank angle position, so that the sampling result is inevitably influenced by the engine rotational speed NE. The optimum timing of detection of the air-fuel ratio thus largely depends upon operating conditions of the engine.

Figure 12:
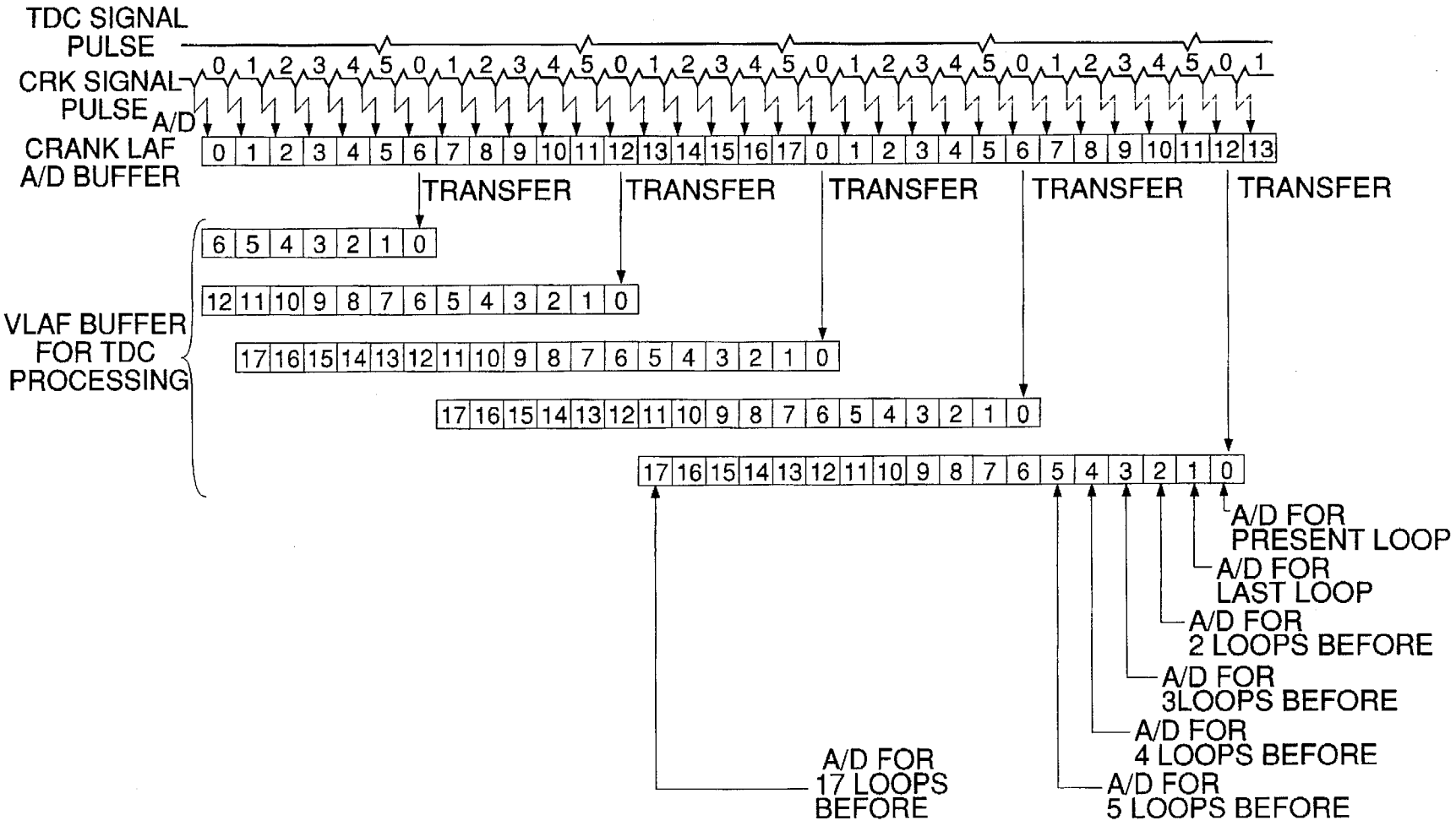
FIG. 12 is a diagram which is useful in explaining how to select a value of the output from the LAF sensor sampled at the optimum timing from values of the same sampled whenever a CRK signal pulse is generated.

In view of the above fact, in the present embodiment, as shown in FIG. 12, values of the output from the LAF sensor 17 sampled in synchronism with generation of CRK signal pulses (at crank angle intervals of 30 degrees) are sequentially stored in the ring buffer memory (having 18 storage locations in the present embodiment), and one sampled at the optimum timing (selected out of the values from a value obtained 17 loops before to the present value) is converted to the actual equivalent ratio KACT for use in the feedback control.

Figure 13:
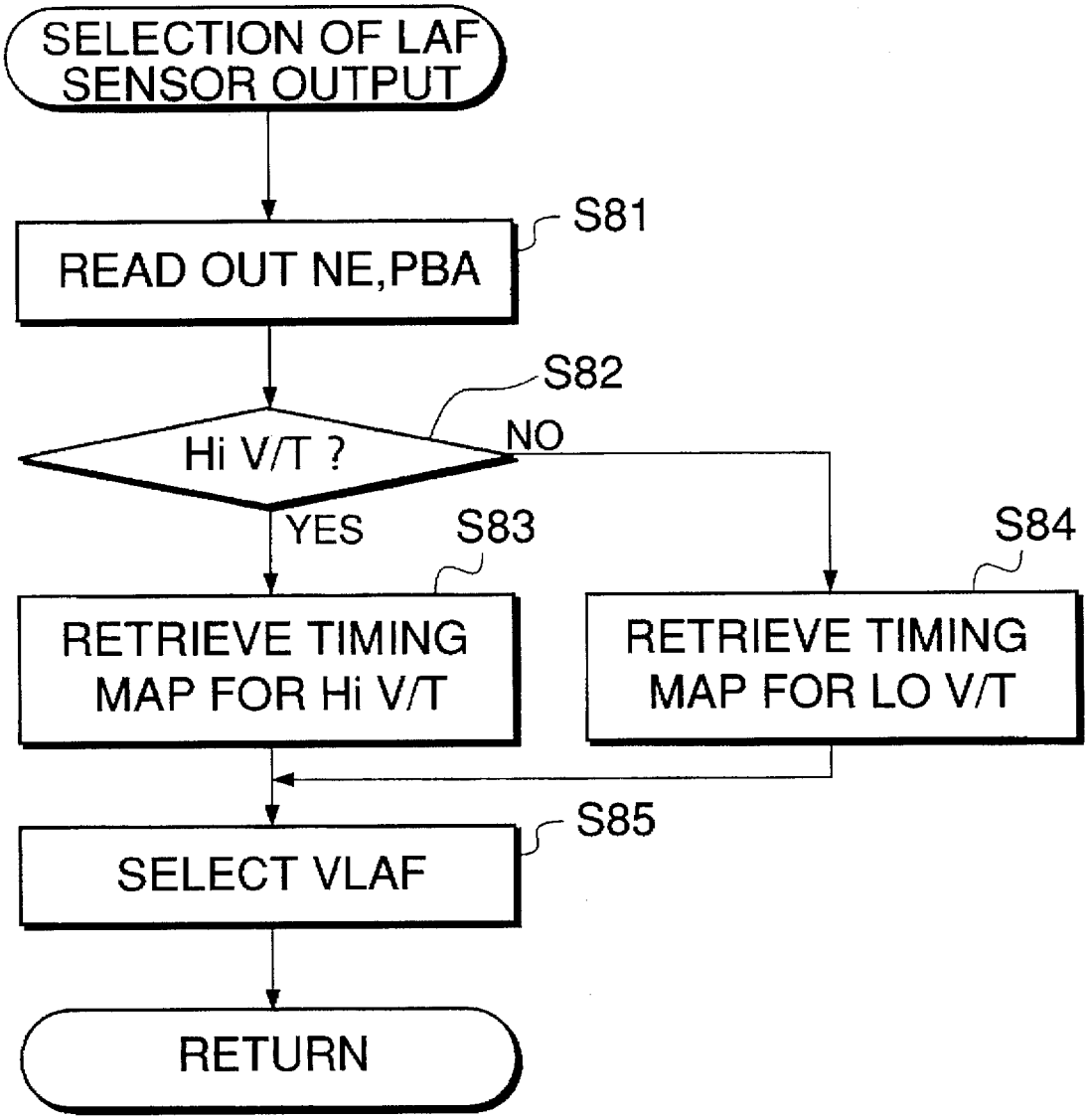
FIG. 13 is a flowchart showing a subroutine for executing a step S3 of the FIG. 4 routine for selecting a value of the output from the LAF sensor.

FIG. 13 shows a subroutine for executing the step S3 of the FIG. 4 routine to carry out the LAF sensor output-selecting processing.

First, at a step S81, the engine rotational speed NE and the intake pipe absolute pressure PBA are read from the outputs from the respective sensor outputs, and then it is determined at a step S82 whether or not the present valve timing is set to the high-speed valve timing. If the present valve timing is set to the high-speed valve timing, a timing map suitable for the high-speed valve timing is retrieved at a step S83, whereas if the same is set to the low-speed valve timing, a timing map suitable for the low-speed valve timing is retrieved at a step S84. Then, one of the LAF sensor output values VLAF stored in the ring buffer memory is selected as a selected value VLAFSEL according to the result of the retrieval at a step S85, followed by terminating the program.

Figure 14:
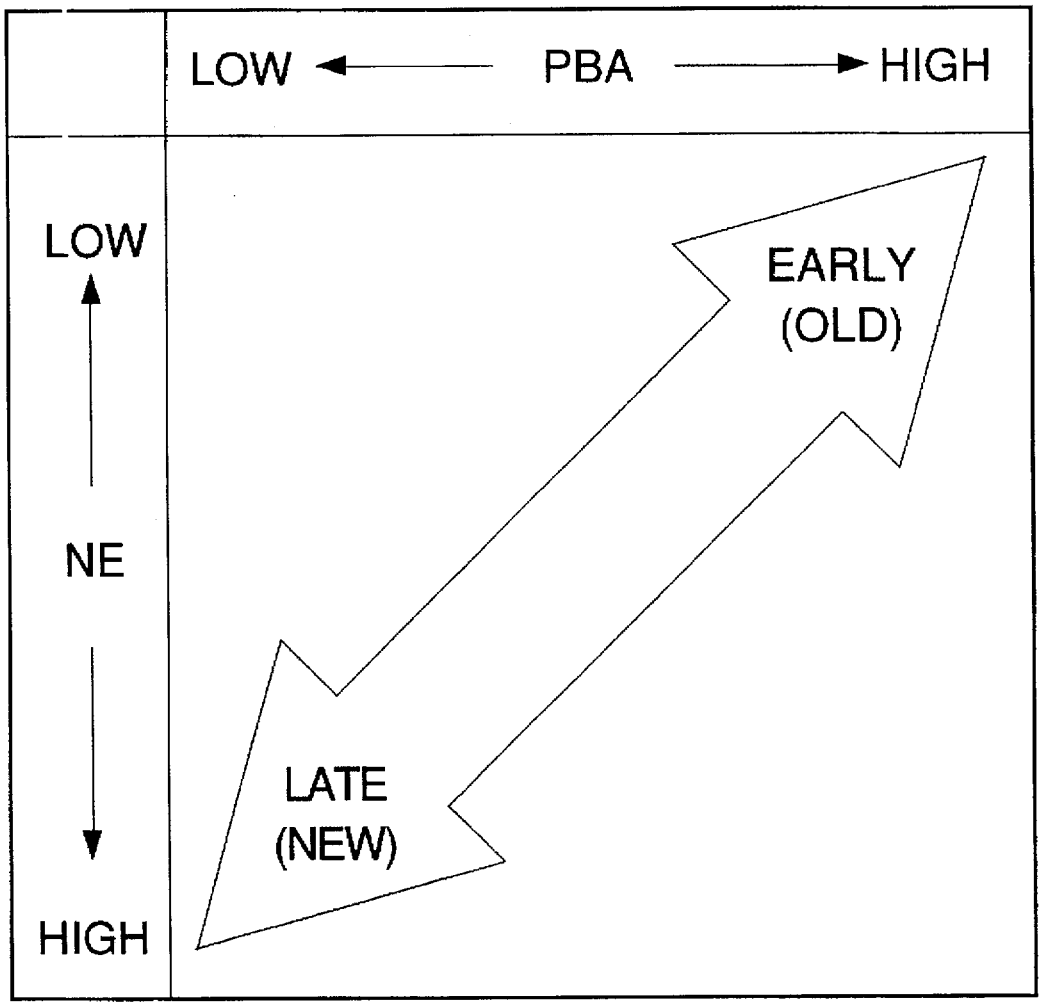
FIG. 14 is a diagram showing characteristics of timing maps used in the FIG. 13 subroutine.
Figure 15A:
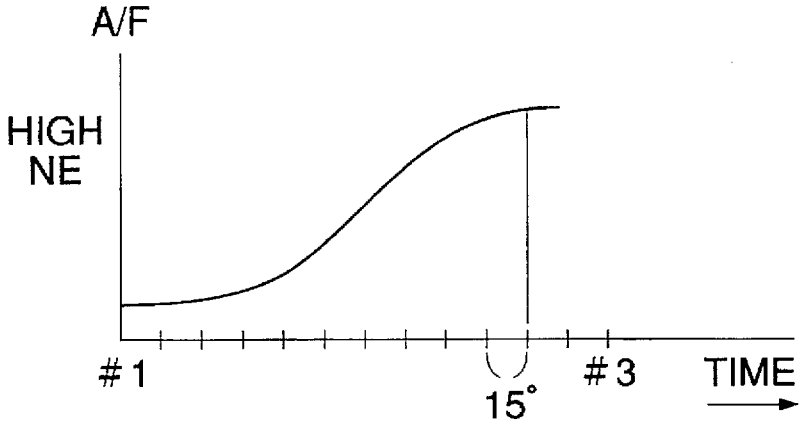
FIG. 15A is a diagram showing characteristics of the output from the LAF sensor assumed at a high engine rotational speed, which is useful in explaining the characteristics of the timing maps shown in FIG. 14.
Figure 15B:
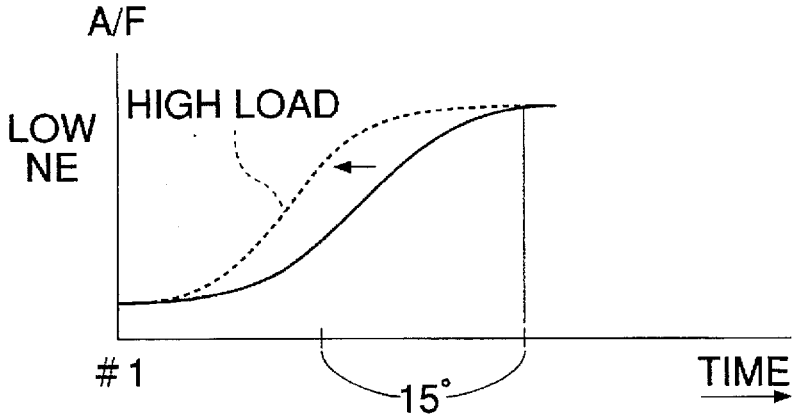
FIG. 15B is a diagram showing characteristics of the output from the LAF sensor assumed at a low engine rotational speed with a shift to be effected when a change in load on the engine occurs, which is useful in explaining the characteristics of the timing maps shown in FIG. 14.

The timing maps are set e.g. as shown in FIG. 14 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that as shown in FIGS. 11A and 11B referred to before, the air-fuel ratio is best sampled at timing closest to time points corresponding to maximal and minimal values (hereinafter both referred to as "extreme values" of the actual air-fuel ratio), and assuming that the response time of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIG. 15A and 15B.

As described above, according to the FIG. 13 subroutine, the sensor output VLAF value sampled at the optimum timing is selected depending on operating conditions of the engine, which improves the accuracy of detection of the air-fuel ratio. As a result, a cylinder-by-cylinder value of the air-fuel ratio can be estimated by the observer with enhanced accuracy.

It should be noted that when deterioration of response of the LAF sensor 17 is detected, i.e. when the delay time of detection of the air-fuel ratio by the LAF sensor 17 exceeds a predetermined time period, the sensor output VLAF value to be selected in the above manner is changed to a value sampled at later timing, as will be described in detail hereinbelow.

Figure 16:
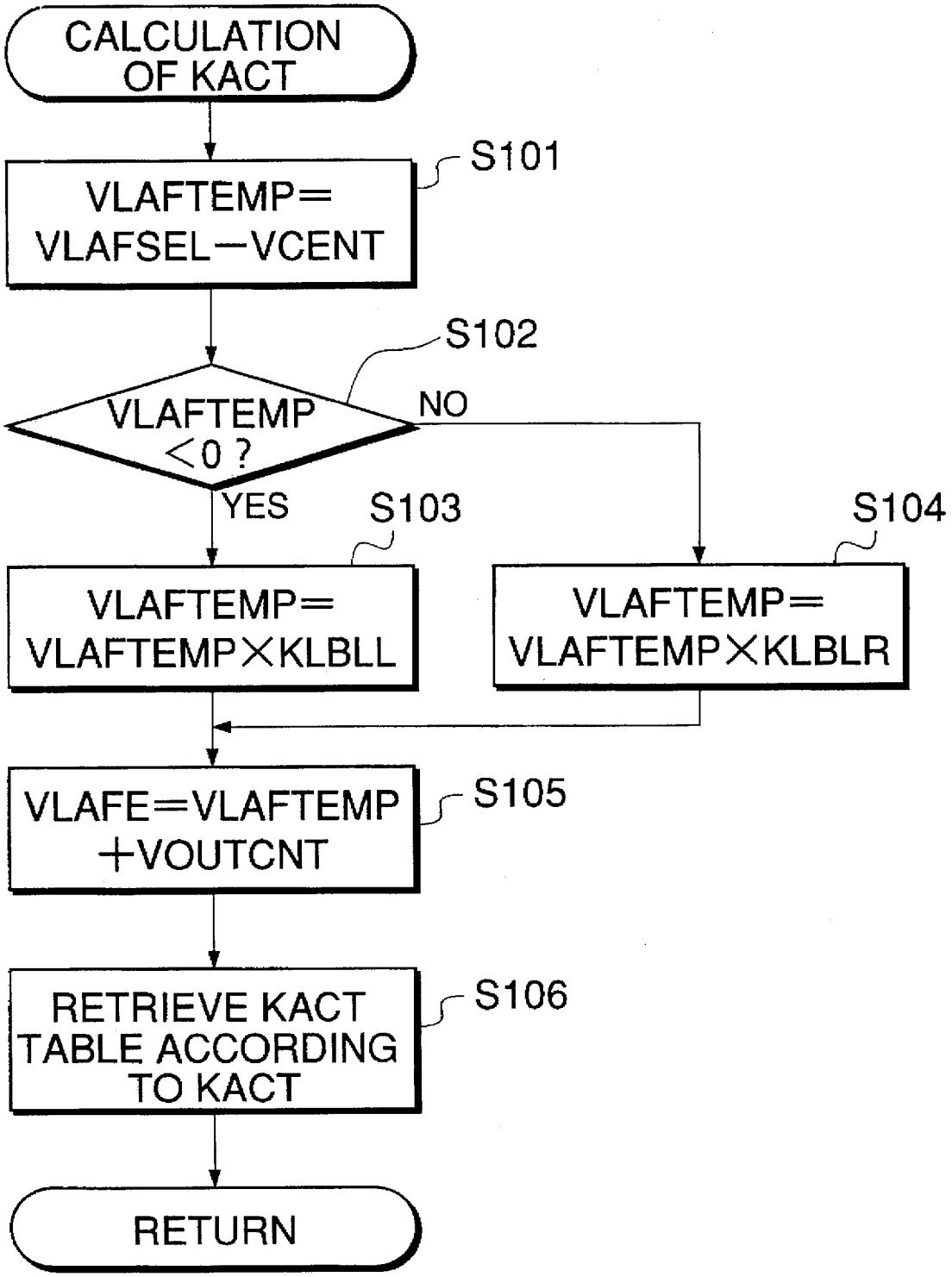
FIG. 16 is a flowchart showing a subroutine for executing a step S4 of the FIG. 4 routine for calculating an actual equivalent ratio KACT.

Then, the calculation of the actual equivalent ratio KACT executed at the step S4 of the FIG. 4 routine will be described with reference to FIG. 16.

First, at a step S101, a central value VENT of the sensor output is subtracted from the selected sensor output value VLAFSEL determined by the FIG. 13 subroutine to obtain a temporary value VLAFTEMP. The central value VCENT is a value of the output from the LAF sensor 17 detected when the air-fuel ratio of the mixture is equal to the stoichiometric air-fuel ratio.

Next, it is determined at a step S102 whether or not the temporary value VLAFTEMP is negative. If VLAFTEMP<0 holds, which means that the actual air-fuel ratio is leaner than the stoichiometric air-fuel ratio, the VLAFTEMP value is multiplied by a leaning correction coefficient KLBLL to correct the same at a step S103. On the other hand, if VLAFTEMP≧0 holds, which means that the air-fuel ratio is richer than the stoichiometric air-fuel ratio, the VLAFTEMP value is multiplied by an enriching correction coefficient KLBLR to correct the same at a step S104. The lean value correction coefficient KLBLL and the rich value correction coefficient KLBLR are calculated according to a label resistance value indicated on the LAF sensor 17 for correcting variations in sensor output value between LAF sensors to be employed. The label resistance value is set according to output characteristics of the LAF sensor measured in advance, and the ECU 5 reads the label resistance value to determine the correction coefficients KLBLL, KLBLR.

At the following step S105, a table central value VOUTCNT is added to the temporary value VLAFTEMP to calculate a corrected output value VLAFE, and a KACT table is retrieved according to the corrected output value VLAFE to determine the actual equivalent ratio KACT at a step S106. In the KACT table, the table central value VOUTCNT corresponds to lattice point data corresponding to the stoichiometric air-fuel ratio (KACT=1.0).

By the above processing, the actual equivalent ratio KACT can be obtained which is free of the influence of undesired variations in output characteristics between individual LAF sensors employed.

Figure 17:
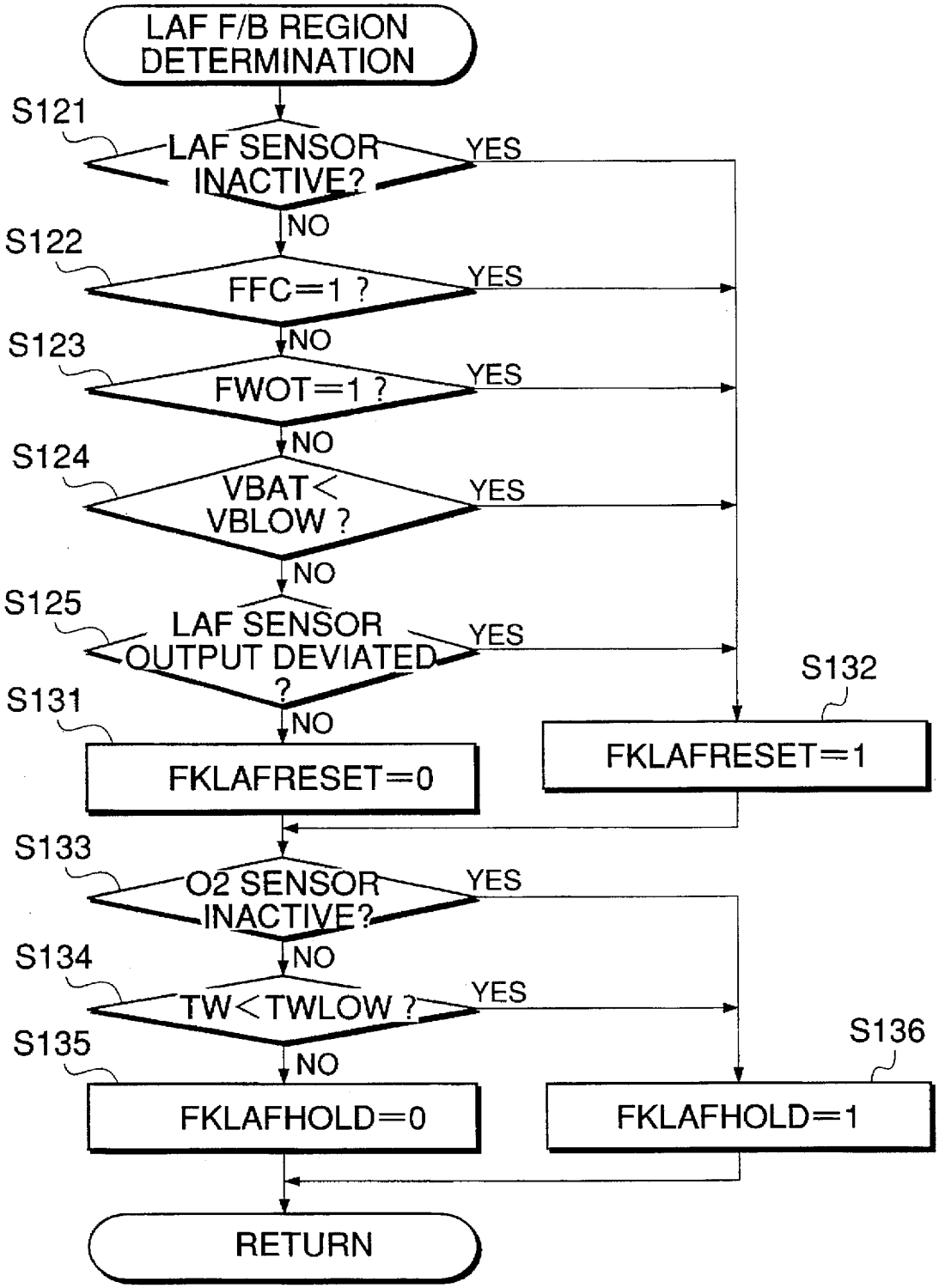
FIG. 17 is a flowchart showing a subroutine for executing a step S6 of the FIG. 4 routine for determining whether the engine is operating in a LAF feedback control region.

FIG. 17 shows a LAF feedback control region-determining routine for executing the step S6 of the FIG. 4 routine.

First, at a step S121, it is determined whether or not the LAF sensor 17 is inactive. If the LAF sensor 17 is inactive, it is determined at a step S122 whether or not a flag FFC, which, when set to "1", indicates that fuel cut is being carried out, assumes "1". If FFC=0 holds, it is determined at a step S123 whether or not the WOT flag FWOT, which, when set to "1", indicates that the engine is operating in the wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the aforementioned reset flag FKLAFRESET, which when set to "1", indicates that the feedback control based on the output from the LAF sensor should be stopped, is set to "1" at a step S132.

On the other hand, if all the answers to the questions of the steps S121 to S125 are negative (NO), the KLAF reset flag FKLAFRESET is set to "0" at a step S131.

At the following step S133, it is determined whether or not the O2 sensor 18 is inactive. If the O2 sensor 18 is inactive, it is determined at a step S134 whether or not the engine coolant temperature TW is lower than a predetermined lower limit value TWLOW (e.g. 0° C.). If the O2 sensor 18 is inactive or if TW<TWLOW holds, a hold flag FKLAFHOLD, which, when set to "1", indicates that the PID correction coefficient KLAF should be held at the present value, is set to "1" at a step S136, followed by terminating the program. If the O2 sensor 18 is active and at the same time TW≧TWLOW holds, the hold flag FKLAFHOLD is set to "0" at a step S135, followed by terminating the program.

Next, a subroutine for executing the step S9 of the FIG. 4 routine for calculating the cylinder-by-cylinder correction coefficient KOBSV#N will be described.

First, a manner of estimation of the cylinder-by-cylinder air-fuel ratio by the observer will be described, and then a manner of calculating the cylinder-by-cylinder correction coefficient KOBSV#N based on the estimated cylinder-by-cylinder air-fuel ratio will be described.

Figure 18:
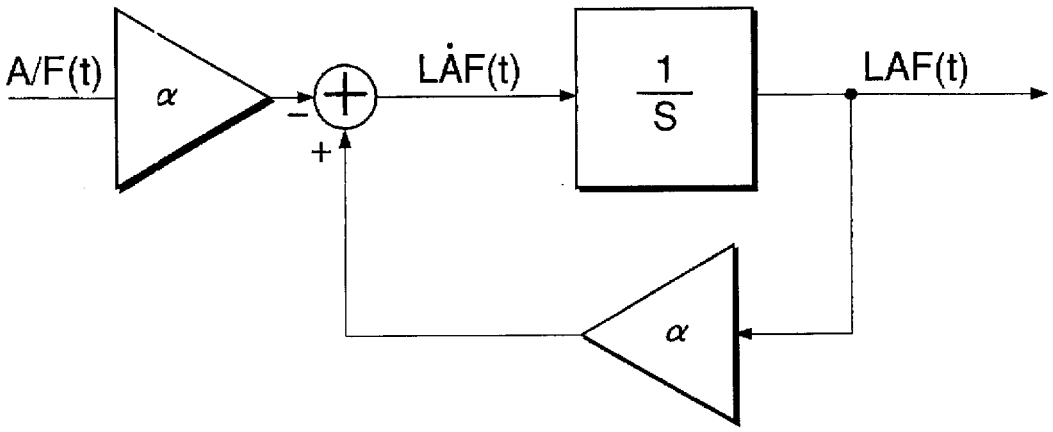
FIG. 18 is a block diagram showing a model representative of operation of the LAF sensor prepared based on the assumption that the LAF sensor is a system of delay of the first order.

First, to extract a value of the air-fuel ratio separately for each cylinder (cylinder-by-cylinder air-fuel ratio) from an output from a single LAF sensor with accuracy, it is necessary to take into account the delay of response of the LAF sensor 17 To this end, assuming that the LAF sensor 17 is a system of delay of the first order, a model representative of operation of the LAF sensor 17 was prepared as shown in FIG. 18. It was experimentally ascertained that the air-fuel ratio obtained based on this model excellently agrees with the actual air-fuel ratio. The state equation of this model can be expressed by the following equation (7):

$$LAF(t)=\alpha LAF(t)-\alpha A/F(t) \tag{7}$$

where LAF(t) represents the LAF sensor output, A/F(t) the input A/F, and α a gain.

Figure 19:
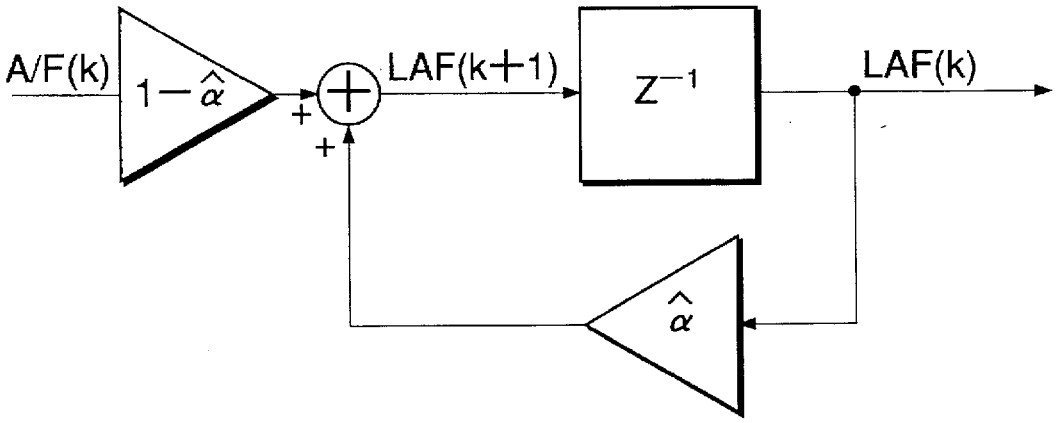
FIG. 19 is a block diagram showing a modification of the FIG. 18 model, in which the model in FIG. 18 is digitized with a repetition period of $\Delta T$.

If this model is digitized with a repetition period of ΔT, the following equation (8) is obtained, which is shown in a block diagram as in FIG. 19.

$$LAF(k+1)=\hat{\alpha}LAF(k)+(1-\hat{\alpha})A/F(k) \tag{8}$$

where $$\hat{\alpha}=1+\alpha\Delta T+(1/2!)\alpha^2\Delta T^2+(1/3!)\alpha^3\Delta T^3+(1/4!)\alpha^4\Delta T^4$$

This equation (8) can be changed into the following equation (9):

$$A/F(k)=\{LAF(k+1)-\hat{\alpha}LAF(k)\}/(1-a) \tag{9}$$

and hence, from a value corresponding to a time point (k), a value corresponding to a time point (k−1) can be calculated back by the following equation (10):

$$A/F(k-1)=\{LAF(k)-\hat{\alpha}LAF(k-1)\}/(1-\hat{\alpha}) \tag{10}$$

For example, the equation (8) may be subjected to Z-transformation and expressed in terms of a transfer function by the following equation (11):

$$t(z)=(1-\hat{\alpha})/(z-\hat{\alpha}) \tag{11}$$

Figure 20:
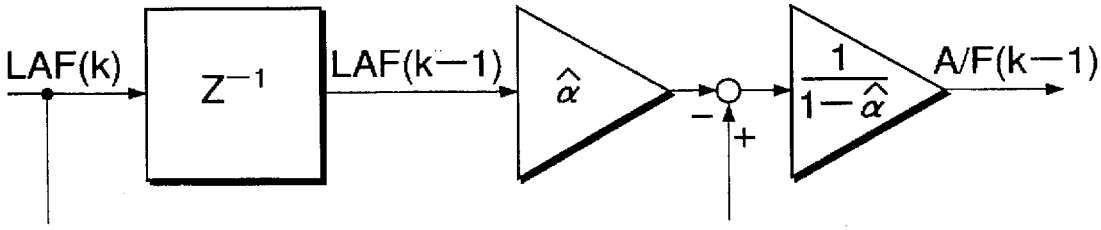
FIG. 20 is a block diagram showing a true air-fuel ratio-estimating device based on a model of representative of a detecting behavior of the LAF sensor.

By multiplying the present LAF sensor output LAF(k) by the inverse of the transfer function, the immediately preceding value A/F(1−k) of the input air-fuel ratio can estimated on real-time basis. FIG. 20 shows an A/F-estimating device implementing the real-time estimation.

Next, the manner of separately extracting the cylinder-by-cylinder air-fuel ratio based on the actual air-fuel ratio thus obtained will be described.

The air-fuel ratio detected at the confluent portion of the exhaust system is regarded as a weighted average value of air-fuel ratio values of individual cylinders, which reflects time-dependent contributions of all the cylinders, whereby values of the air-fuel ratio detected at time points (k), (k−1), (k−2) are expressed by equations (12A), (12B), and (12C). In preparing these equations, the fuel amount (F) was used as an operation amount, and accordingly the fuel-air ratio F/A is used in these equations. The values of the fuel-air ratio F/A applied to the following equations (12A) to (12C) mean the actual values obtained by the use of the equation (10) through correction of the delay of response of the LAF sensor:

$$\begin{aligned}[F/A](k) &= C_1[F/A\#1]+C_2[F/A\#3] \\ &\quad C_3[F/A\#4]+C_4[F/A\#2]\end{aligned} \tag{12A}$$

$$\begin{aligned}[F/A](k+1) &= C_1[F/A\#3]+C_2[F/A\#4] \\ &\quad C_3[F/A\#2]+C_4[F/A\#1]\end{aligned} \tag{12B}$$

$$\begin{aligned}[F/A](k+2) &= C_1[F/A\#4]+C_2[F/A\#2] \\ &\quad C_3[F/A\#1]+C_4[F/A\#3]\end{aligned} \tag{12C}$$

Figure 21:
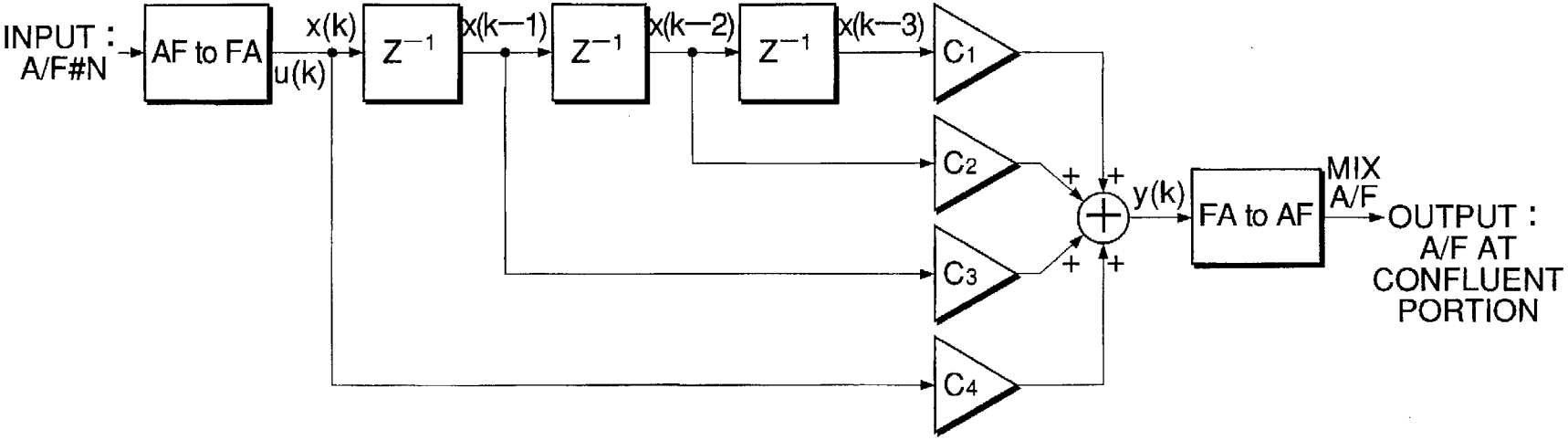
FIG. 21 is a block diagram showing a model representative of a behavior of the exhaust system of the engine.

More specifically, the air-fuel ratio detected at the confluent portion of the exhaust system is expressed as the sum of values of the cylinder-by-cylinder air-fuel ratio multiplied by respective weights C varying in the order of combustion (e.g. 40% for a cylinder corresponding to the immediately preceding combustion, 30% for one corresponding to the second preceding combustion, and so on). This model can be expressed in block diagrams as shown in FIG. 21, and the state equation therefor is expressed by the following equation (13):

$$\begin{bmatrix} x(k-2) \\ x(k-1) \\ x(k) \end{bmatrix} = \begin{bmatrix} 010 \\ 001 \\ 000 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \tag{13}$$

Further, if the fuel-air ratio detected at the confluent portion is designated by y(k), the output equation can be expressed by the following equation (14):

$$y(k)=[c_1c_2c_3]\begin{bmatrix} x(k-3) \\ x(k-2) \\ x(k-1) \end{bmatrix}+c_4\,u(k) \tag{14}$$

where, c1: 0.50, c2: 0.15, c3: 0.30, c4: 0.50.

In the equation (14), u(k) cannot be observed, and hence an observer designed based on this state equation cannot enable observation of x(k). Therefore, on the assumption that a value of the air fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (14) can be changed into the following equation (15):

$$\begin{bmatrix} x(k-2) \\ x(k-1) \\ x(k) \\ x(k+1) \end{bmatrix} = \begin{bmatrix} 0100 \\ 0010 \\ 0001 \\ 1000 \end{bmatrix} \begin{bmatrix} x(k-3) \\ x(k-2) \\ x(k-1) \\ x(k) \end{bmatrix}$$

$$y(k) = [c_1 c_2 c_3 c_4] \begin{bmatrix} x(k-3) \\ x(k-2) \\ x(k-1) \\ x(k) \end{bmatrix} \quad (15)$$

Figure 22:
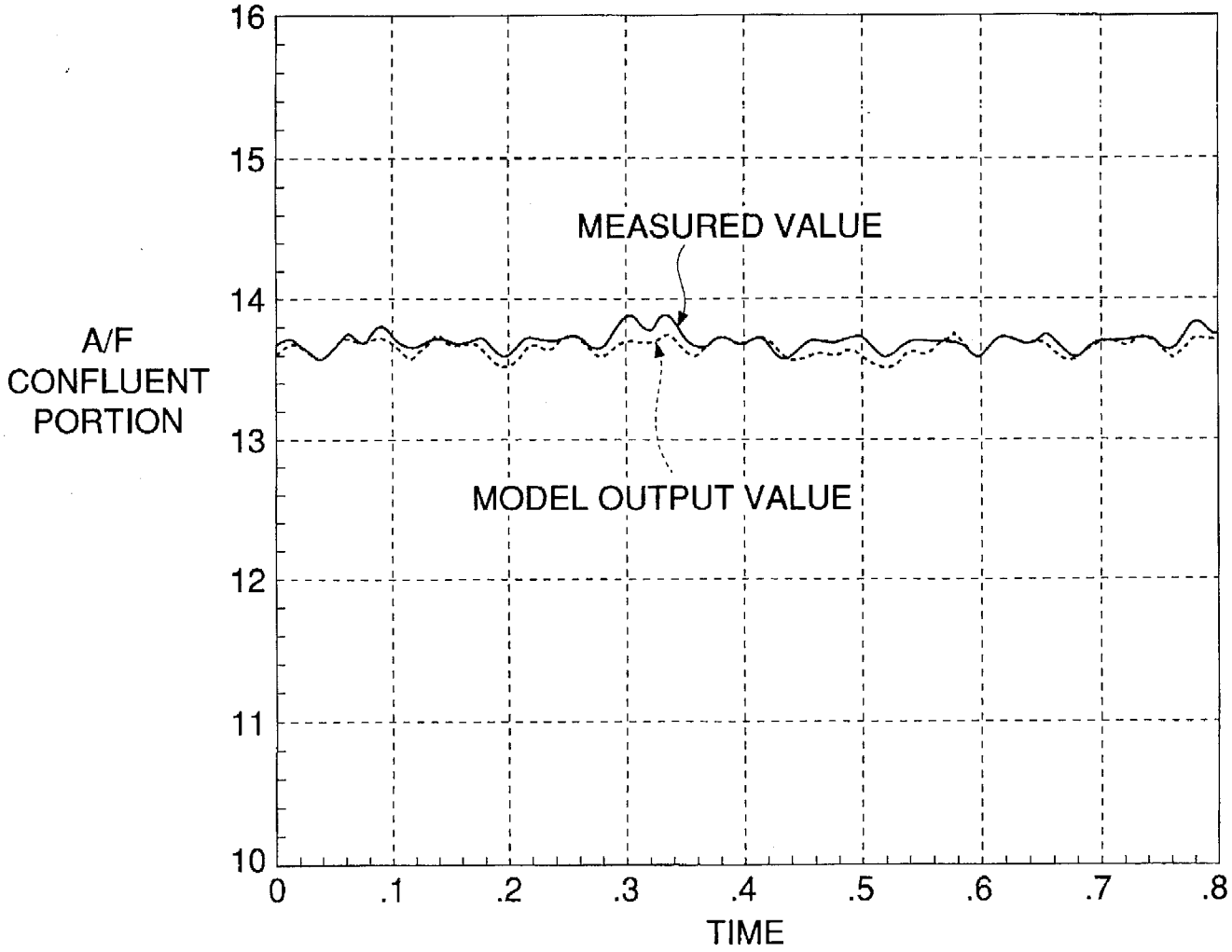
FIG. 22 is a graph showing changes in the value of the air-fuel ratio output from the FIG. 21 model and changes in the actually measured value of the air-fuel ratio, which are exhibited when the air-fuel ratio of three cylinders of the four-cylinder type engine is set to 14.7 and the air-fuel ratio of the remaining cylinder is set to 12.0.

FIG. 22 shows changes in the value of the air-fuel ratio calculated based on the above model and the actually detected value of the same on the assumption that the desired air-fuel ratio for three cylinders of the four-cylinder engine is set to 14.7, and the desired air-fuel ratio for the remaining cylinder is set to 12.0. As shown in the figure, it turned out that the above model accurately represents the exhaust system of the four-cylinder engine. Therefore, a problem arising from estimating the cylinder-by-cylinder air-fuel ratio from the air-fuel ratio A/F detected at the confluent portion of the exhaust system is the same as a problem with an ordinary Kalman filter used in observing x(k) by the following state equations and output equations (16). If weight matrices Q, R are expressed by the following formula (17), the Riccati's equation can be solved to obtain a gain matrix K represented by the following formula (18):

$$X(k+1)=AX(k)+Bu(k)$$

$$Y(k)=CX(k)+Du(k) \quad (16)$$

where $$A = \begin{bmatrix} 0100 \\ 0010 \\ 0001 \\ 1000 \end{bmatrix} C = [c_1 c_2 c_3 c_4] B = D = [0]$$

$$X(k) = \begin{bmatrix} x(k-3) \\ x(k-2) \\ x(k-1) \\ x(k) \end{bmatrix}$$

$$Q = \begin{bmatrix} 1000 \\ 0100 \\ 0010 \\ 0001 \end{bmatrix} R = [1] \quad (17)$$

$$K = \begin{bmatrix} -0.3093 \\ 1.1916 \\ 0.3093 \\ 0.0803 \end{bmatrix} \quad (18)$$

From the gain matrix K, (A−KC) can be obtained by the following formula (19).

$$A - KC = \begin{bmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & -0.0148 \end{bmatrix} \quad (19)$$

Figure 23:
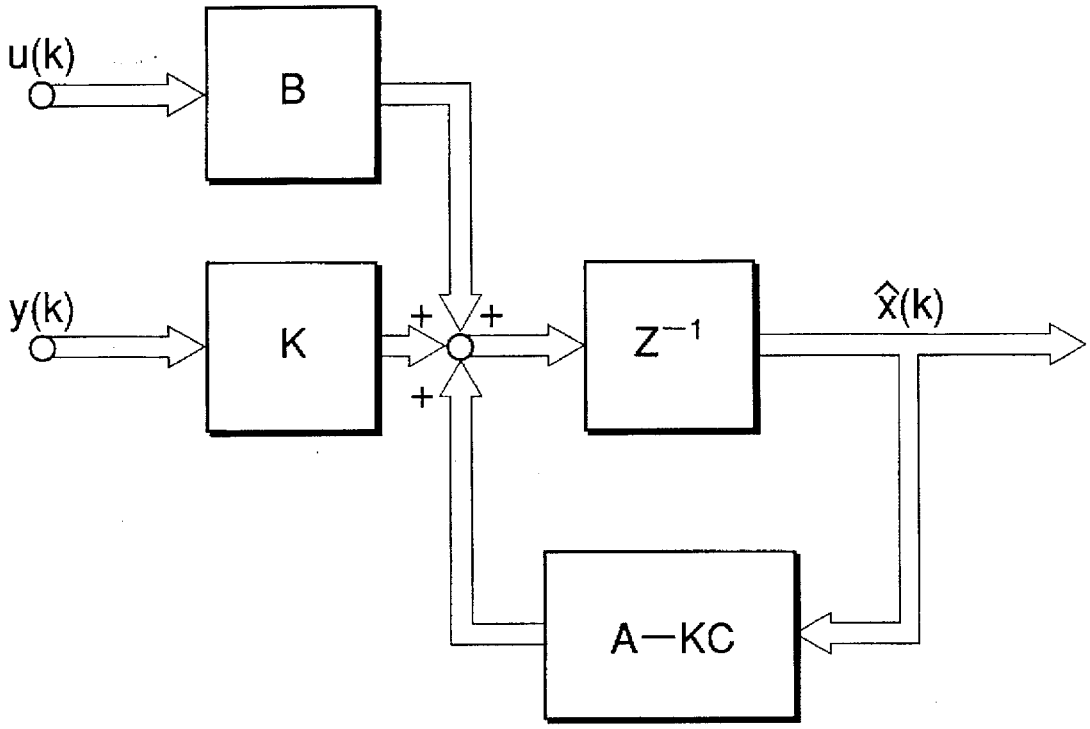
FIG. 23 is a block diagram showing the construction of an observer of a general type.
Figure 24:
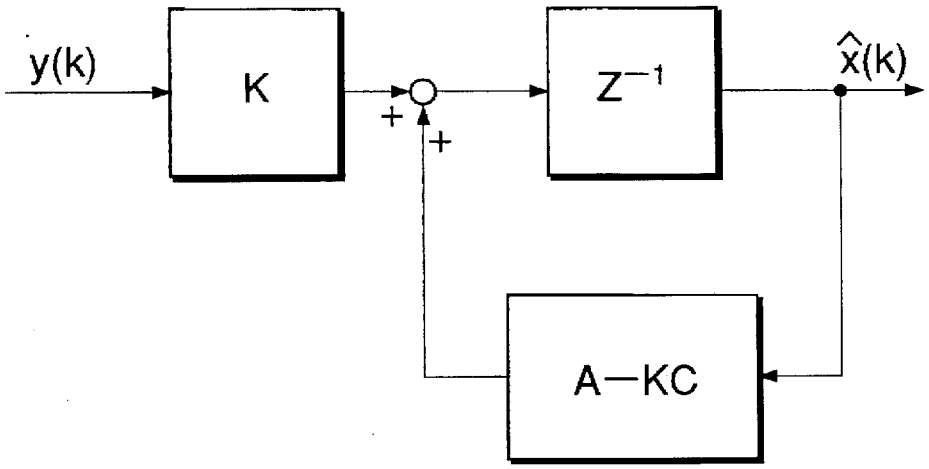
FIG. 24 is a block diagram showing the construction of a modification of the FIG. 23 observer, which is applied to the model of the exhaust system used in the present embodiment.

An observer of a general type is constructed as shown in FIG. 23. In the present embodiment, however, there is no inputting of u(k), so that the observer is constructed such that y(k) alone is input thereto as shown in FIG. 24, which is expressed by the following formula (20):

$$\hat{X}(k+1) = [A - KC]\hat{X}(k) + Ky(k)$$

$$\hat{x}(k) = [0001] \begin{bmatrix} \hat{x}(k-3) \\ \hat{x}(k-2) \\ \hat{x}(k-1) \\ \hat{x}(k) \end{bmatrix} \quad (20)$$

Therefore, from the fuel-air ratio y(k) at the confluent portion and the estimated value $\hat{X}(k)$ of the cylinder-by-cylinder fuel-air ratio obtained in the past, the estimated value $\hat{x}(k)$ of the same in the present loop can be calculated.

The observer with the input of y(k), i.e. the system matrix S of the Kalman filter is expressed by the following equation (21):

$$S = \left[ \begin{array}{c:c} A-KC & K \\ \hdashline 0001 & 0 \end{array} \right] \quad (21)$$

If the ratio of the element R of load distribution to the element Q of the same of the Riccati's equation is 1:1 in the model of the present embodiment, the system matrix S is expressed by the following equation (22):

$$S = \begin{bmatrix} 0.0785 & 1.0313 & 0.1426 & 0.0569 & -0.3093 \\ -0.3025 & 0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 1.0 & 0.0 \end{bmatrix} \quad (22)$$

Figure 25:
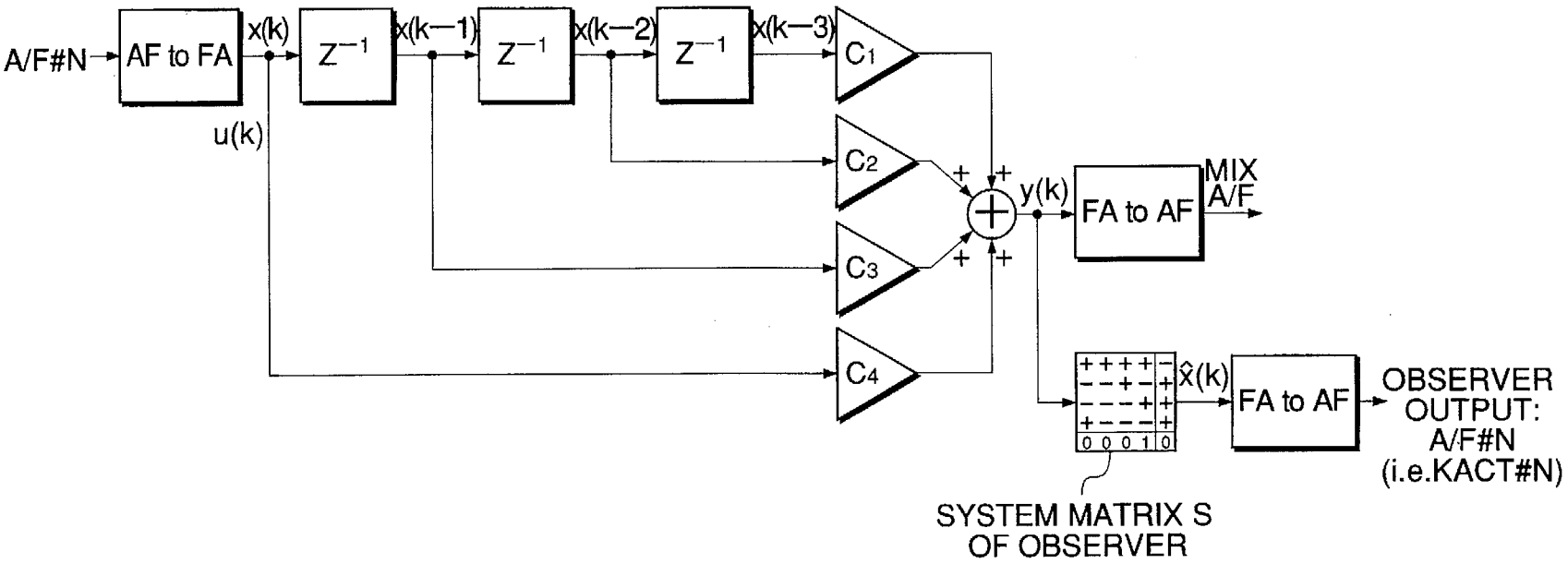
FIG. 25 is a block diagram showing a combination of the FIG. 21 model and the FIG. 23 observer.

FIG. 25 shows a combination of the model of the exhaust system and the observer described above, and a simulation carried out for detection of the cylinder-by-cylinder air-fuel ratio by the use of the combination provided an excellent result that the cylinder-by-cylinder air-fuel ratio obtained by the simulation agrees with actually-measured values. Thus, according to the present embodiment, not only the delay of response of the LAF sensor is taken into account, but also the observer is introduced, which makes it possible to accurately detect or extract the air-fuel ratio cylinder by cylinder from the air-fuel ratio value detected at the confluent portion of the exhaust system.

Next, a manner of calculating the cylinder-by-cylinder correction coefficient KOBSV#N based on the estimated cylinder-by-cylinder air-fuel ratio will be described with reference to FIG. 26.

First, a desired value KCMDOBSV(k) as an equivalent ratio corresponding to the desired air-fuel ratio A/F is calculated by dividing the actual equivalent ratio KACT at the confluent portion by the immediately preceding value of the average value of the cylinder-by-cylinder correction coefficient KOBSV#N for all the cylinders, by the use of the equation (23):

$$KCMDOBSV(k) = KACT(k) / \left( \sum_{N=1}^{4} KOBSV\#N(k-1)/4 \right) \quad (23)$$

The cylinder-by-cylinder correction coefficient KOBSV#1 for the #1 cylinder is calculated by the PID control such that the difference DKACT#1(k) (=KACT#1 (k)−KCMDOBSV(k)) between the desired value KCMDOBSV(k) and the cylinder-by-cylinder equivalent ratio KACT#1 estimated for the #1 cylinder becomes equal to zero.

More specifically, a proportional term KOBSVP#1, an integral term KOBSVI#1, and a differential term KOBSVD#1 are calculated by the use of the following equations (24A) to (24C):

$$KOBSVP\#1(k)=KPOBSV\times DKACT\#1(k) \quad (24A)$$

$$KOBSVP\#1(k)=KIOBSV\times DKACT\#1(k)+KOBSV\#1(k-1) \quad (24B)$$

$$KOBSVD\#1(k)=KDOBSV\times(DKACT\#1(k)-DKACT\#1(k-1) \quad (24C)$$

Then, the cylinder-by-cylinder correction coefficient KOBSV#1 for the #1 cylinder is calculated by the use of the following equation (24D):

$$KOBSV\#1(k)=KOBSVP\#1(k)+KOBSVI\#1(k)+KOBSVD\#1(k)+1.0 \quad (24D)$$

Similar calculations are carried out for the other cylinders #2 to #4 to obtain cylinder-by-cylinder correction coefficient values KOBSV#2 to #4.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired-air fuel ratio. Further, a learned value KOBSV#Nsty of the cylinder-by-cylinder correction coefficient KOBSV#N is calculated by the use of the following equation (25) and stored:

$$KOBSV\#Nsty=C\times KOBSV\#N+(1-C)\times KOBSV\#Nsty(n-1) \quad (25)$$

where C represents a weighting coefficient, and KOBSV#Nsty(n−1) the immediately preceding learned value.

Figure 27:
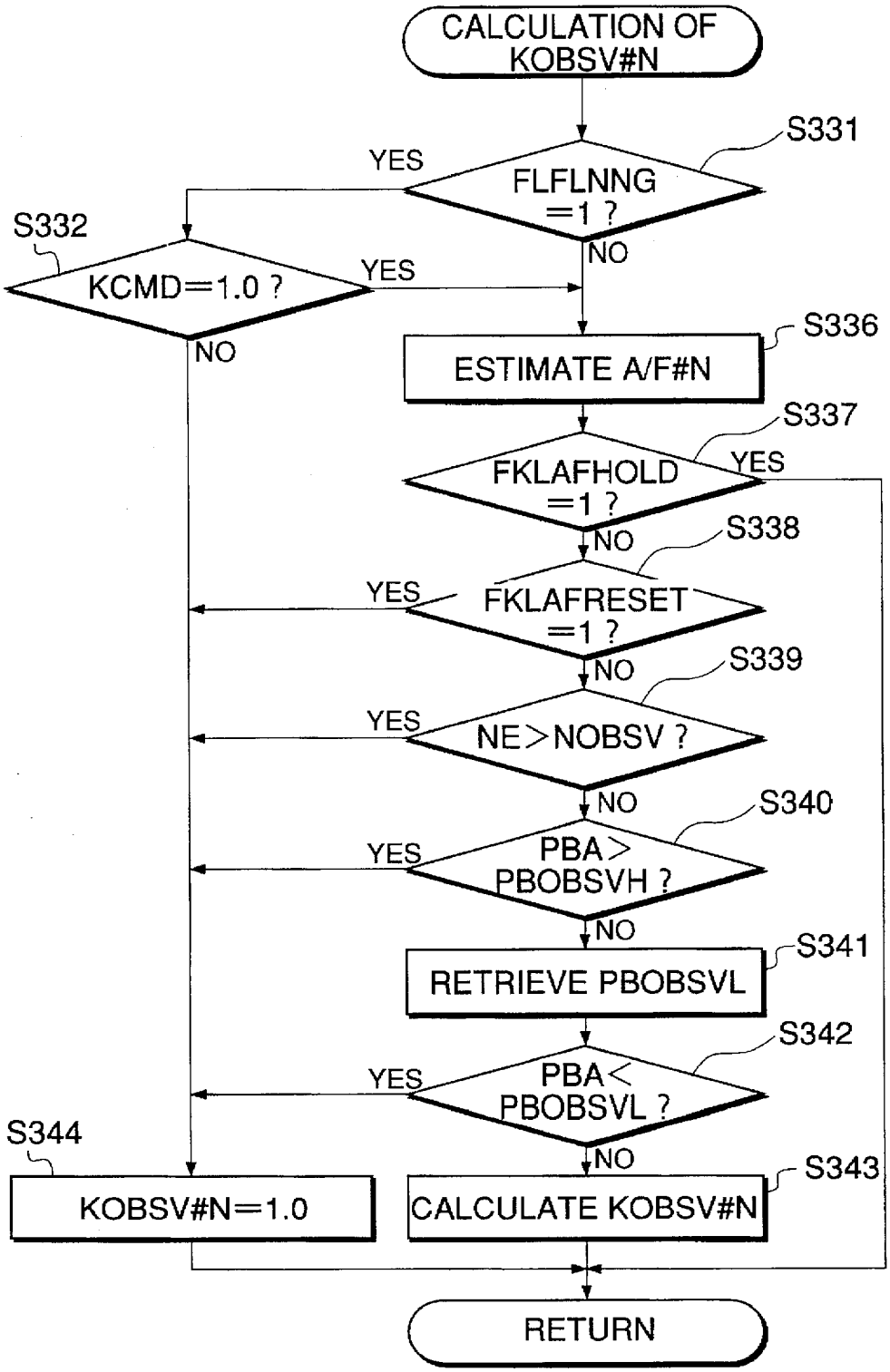
FIG. 27 is a flowchart showing a subroutine for executing a step S9 of the FIG. 4 routine for calculating a cylinder-by-cylinder correction coefficient KOBSV#N.

FIG. 27 shows a subroutine for executing the step S9 of the FIG. 4 routine for calculating the cylinder-by-cylinder correction coefficient KOBSV#N.

First, it is determined at a step S331 whether or not lean output deterioration of the LAF sensor 17 has been detected. If the lean output deterioration has not been detected, the program jumps to a step S336, whereas if the lean output deterioration has been detected, it is determined at a step S332 whether or not the desired air-fuel ratio KCMD is equal to 1.0, i.e. whether or not the desired air-fuel ratio is equal to the stoichiometric air-fuel ratio. The lean output deterioration of the LAF sensor means that the output from the LAF sensor exhibited when the air-fuel ratio of the mixture is actually controlled to a value leaner than the stoichiometric air-fuel ratio deviates from a proper value to a degree beyond a predetermined limit. The manner of detection of the lean output deterioration will be described in detail hereinafter. If KCMD=1.0 holds at the step S332, the program proceeds to a step S336, whereas if KCMD≠1.0, the cylinder-by-cylinder correction coefficient KOBSV#N is set to 1.0 for all the cylinders at a step S344, followed by terminating the program without executing the cylinder-by-cylinder air-fuel ratio feedback control.

At the step S336, the air-fuel ratio is estimated cylinder by cylinder by the observer described above, and then it is determined at a step S337 whether or not a hold flag FKLAFHOLD assumes "1". If FKLAFHOLD=1 holds at the step S337, the present program is immediately terminated.

Figure 29:
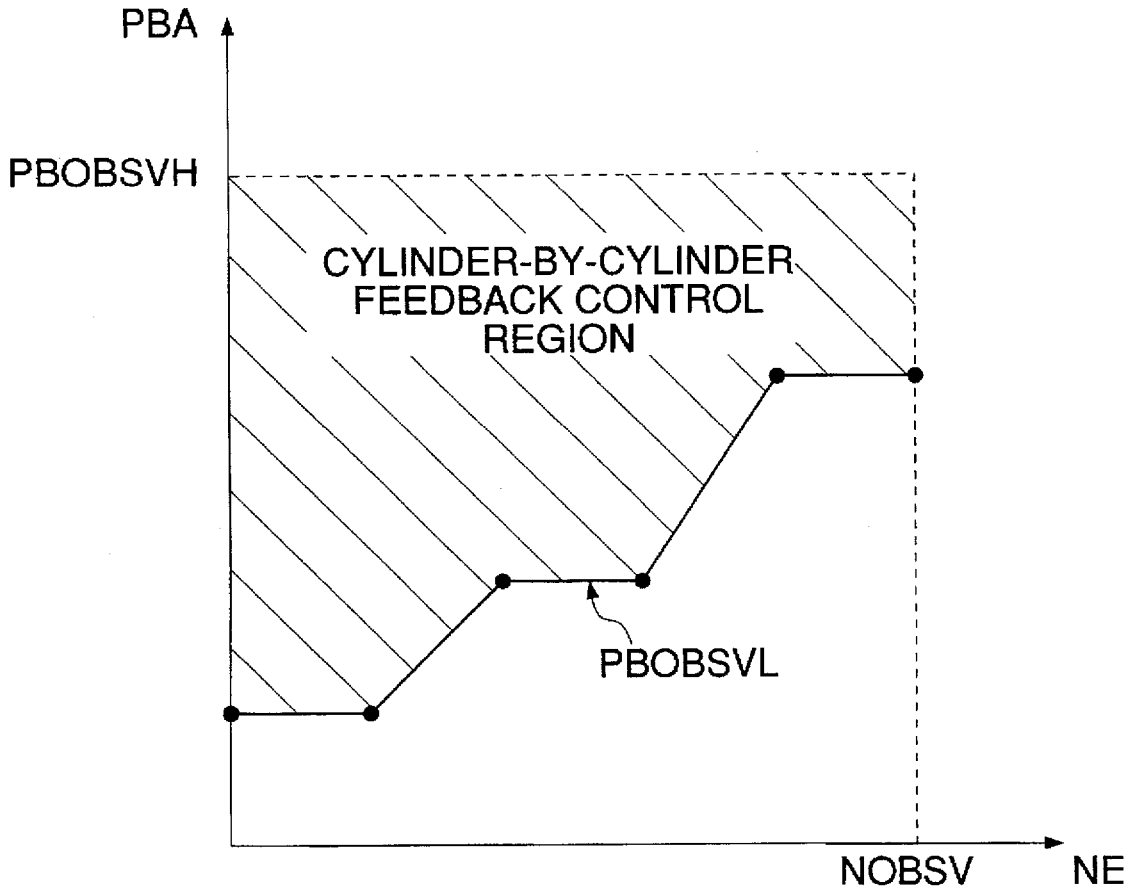
FIG. 29 is a diagram which is useful in explaining a cylinder-by-cylinder feedback control region.

At the following step S338, it is determined whether or not a reset flag FKLAFRESET assumes "0". If FKLAFRESET=0 holds at the step S338, it is determined at a step S339 whether or not the engine rotational speed NE is higher than a predetermined value NOBSV (e.g. 3500 rpm). If NE≦NOBSV holds at the step S339, it is determined at a step S340 whether or not the intake pipe absolute pressure PBA is higher than a predetermined upper limit value PBOBSVH (e.g. 650 mmHg). If PBA≦PBOBSVH holds at the step S340, a PBOBSVL table shown in FIG. 29 is retrieved according to the engine rotational speed NE to determine a lower limit value PBOBSVL of the intake pipe absolute pressure at a step S341, and it is determined at a step S342 whether or not the intake pipe absolute pressure PBA is lower than a predetermined lower limit value PBOBSVL.

If any of the answers to the questions of the steps S338 to S340, and S342 is affirmative (YES), the program proceeds to the step S344, whereby the cylinder-by-cylinder air-fuel ratio feedback control is not carried out. On the other hand, if all the answers to the questions of the steps S338 to S340 and S342 are negative (NO), it is judged that the engine is in an operating region corresponding to a hatched area in FIG. 29, which means that the cylinder-by-cylinder air-fuel ratio feedback control can be carried out, so that the cylinder-by-cylinder correction coefficient KOBSV#N is calculated in the manner described above at a step S343, followed by terminating the program.

Figure 28:
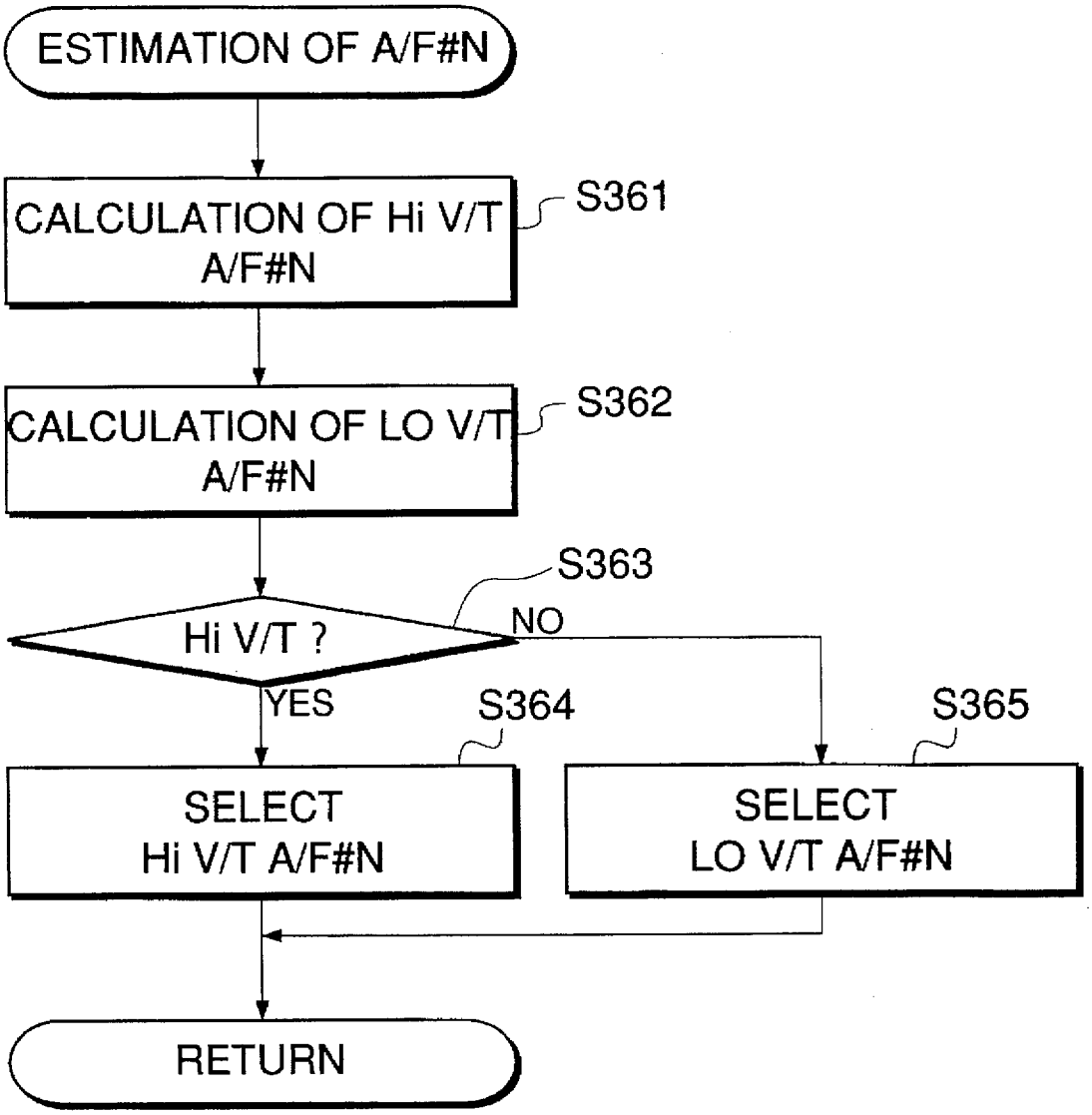
FIG. 28 is a flowchart showing a subroutine for executing a step S336 of the FIG. 27 subroutine for estimating a cylinder-by-cylinder air-fuel ratio.

FIG. 28 shows a subroutine for executing the step S336 of the FIG. 27 subroutine for estimating the cylinder-by-cylinder air-fuel ratio.

First, at a step S361, an arithmetic operation by the use of the observer (i.e. estimation of the cylinder-by-cylinder air-fuel ratio value) for the high-speed valve timing is carried out, and at the following step S362, an arithmetic calculation by the use of the observer for the low-speed valve timing is carried out. Then, it is determined at a step S363 whether or not the present valve timing is set to the high-speed valve timing. If the present valve timing is set to the high-speed valve timing, a result of the observer arithmetic operation for the high-speed valve timing is selected at a step S364, whereas if the present valve timing is set to the low-speed valve timing, a result of the observer arithmetic operation for the low-speed valve timing is selected at a step S365.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

Figure 30:
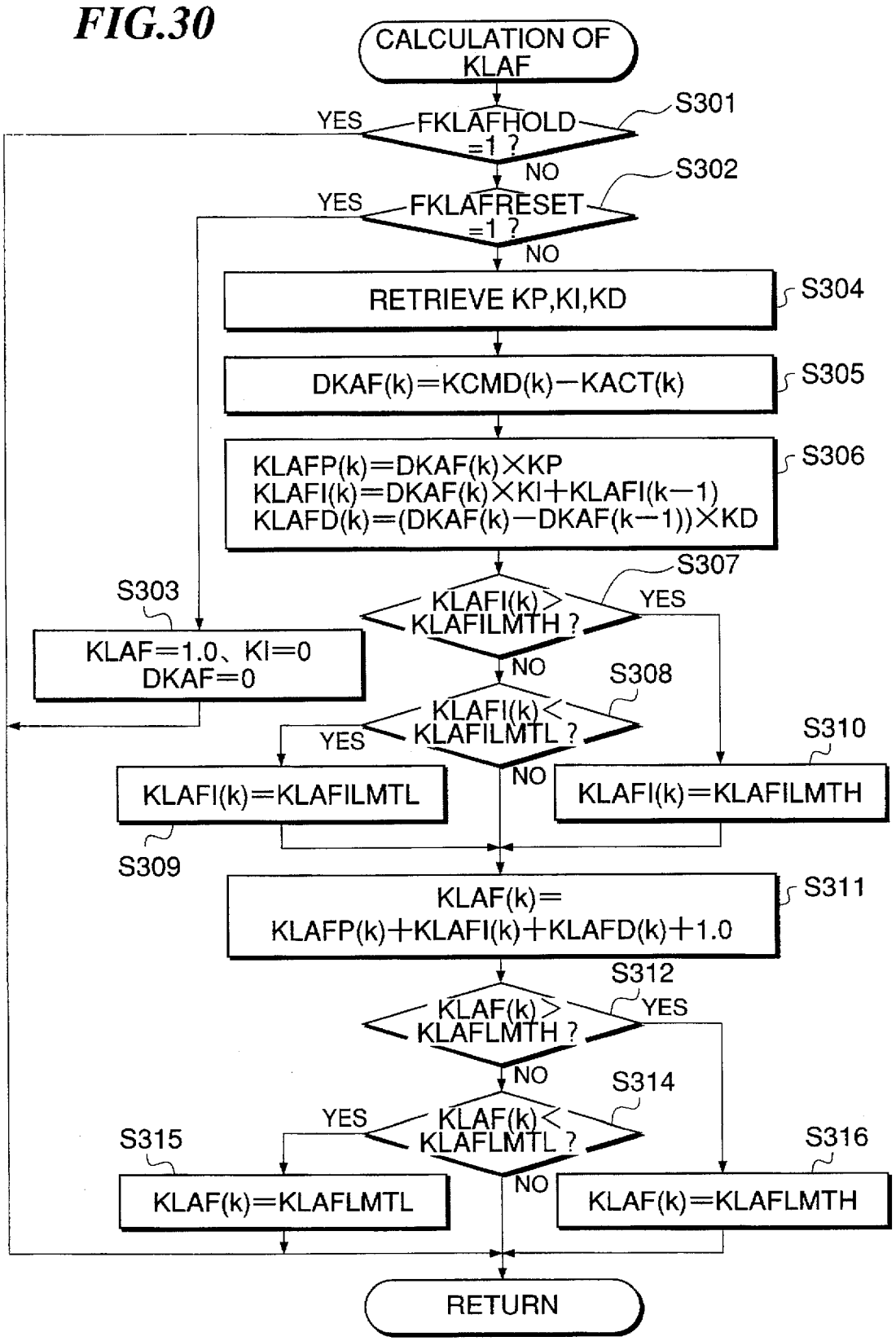
FIG. 30 is a flowchart showing a subroutine for executing a step S10 of the FIG. 4 routine for calculating a PID correction coefficient KLAF

Next, a subroutine for executing the step S10 of the FIG. 4 routine to calculate the PID correction coefficient KLAF will be described with reference to FIG. 30.

First, at a step S301, it is determined whether or not the hold flag FKLAFHOLD assumes "1". If FKALFHOLD=1 holds, the present processing is immediately terminated, whereas if FKLAFHOLD=0 holds, it is determined at a step S302 whether or not the KLAF reset flag FKLAFRESET assumes "1". If FKLAFRESET=1 holds, the program proceeds to a step S303, wherein the PID correction coefficient KLAF is set to "1.0" and at the same time an integral term control gain KI and a difference DKAF between the desired equivalent ratio KCMD and the actual equivalent ratio KACT are set to "0", followed by terminating the program.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. In this connection, during idling of the engine, gain values for the idling condition are adopted. Then, the difference DKAF(k) (=KCMD(k)−KACT(k)) between the desired equivalent ratio KCMD and the actual equivalent ratio KACT is calculated at a step S305, and the difference DKAF(k) and the gains KP, KI, and KD are applied to the following equations (26A) to (26C) to calculate a proportional term KLAFP(k), an integral term KLAFI(k), and a differential term KLAFD(k) at a step S306:

$$KLAFP(k)=DKAF(k)\times KP \quad (26A)$$

$$KLAFI(k)=DKAF(k)\times KI+KLAFI(k-1) \quad (26B)$$

$$KLAFD(k)=(DKAF(k)-DKAF(k-1))\times KD \quad (26C)$$

At the following steps S307 to S310, limit-checking of the integral term KLAFI(k) is carried out. More specifically, it is determined whether or not the KLAFI(k) value falls within a range defined by predetermined upper and lower limit values KLAFILMTH and KLAFILMTL at steps S307, S308, respectively. If KLAFI(k)>KLAFILMTH holds, the integral term KLAFI(k) is set to the predetermined upper limit value KLAFILMTH at a step S310, whereas if FLAFI (k)<KLAFILIMTL holds, the same is set to the predetermined lower limit value KLAFILMTL at a step S309.

At the following step S311, the PID correction coefficient KLAF(k) is calculated by the use of the following equation (27):

$$KLAF(k)=KLAFP(k)+KLAFI(k)+KLAFD(k)+1.0 \quad (27)$$

Then, it is determined at a step S312 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S316, followed by terminating the program.

If KLAF(k)≦KLAFLMTH holds at the step S312, it is determined at a step S314 whether or not the KLAF(k) value is smaller than a predetermined lower limit value KLAFLMTL. If KLAF(k)≧KLAFLMTL holds, the present program is immediately terminated, whereas if KLAF(k) <KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID control such that the actual equivalent ratio KACT becomes equal to the desired equivalent ratio KCMD.

Next, the deterioration determination of the LAF sensor 17 and a fail-safe action to be executed when the LAF sensor 17 is determined to be deteriorated will be described.

Figure 31:
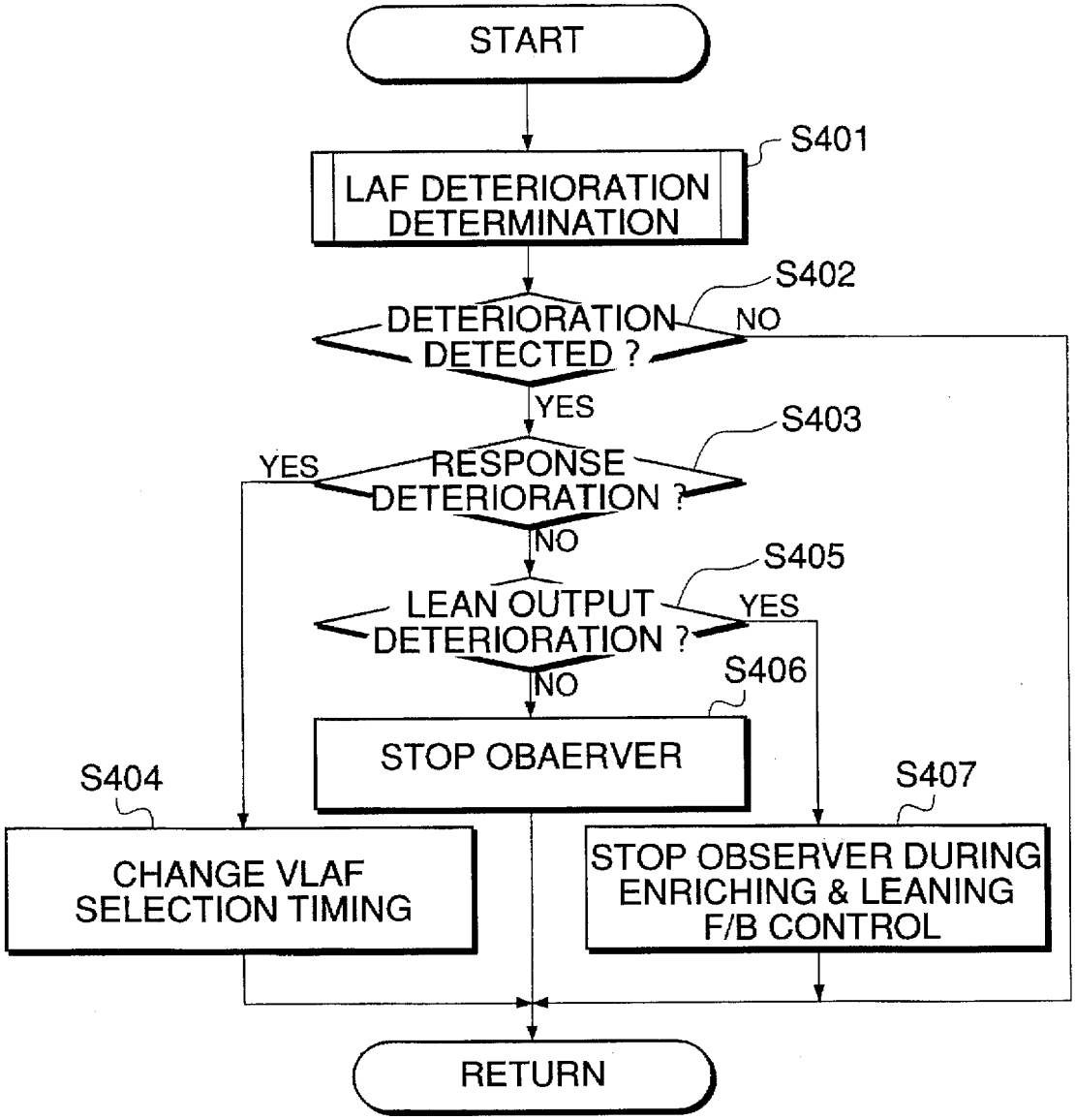
FIG. 31 is a flowchart showing a routine for determining whether or not the LAF sensor has been aged, and for carrying out fail-safe operation when the LAF sensor is determined to be aged.

FIG. 31 shows a main routine for carrying out the deterioration determination and the fail-safe action. First, at a step S401, the deterioration determination of the LAF sensor is carried out. Types of deterioration of the LAF sensor to be determined by this routine are stoichiometric output deterioration, response deterioration, and lean output deterioration. The stoichiometric output deterioration is defined as a state of the LAF sensor 17 in which the output from the LAF sensor corresponding to the stoichiometric air-fuel ratio of the mixture deviates from a proper value to a predetermined degree or more, the response deterioration as a state of the sensor in which a delay time of detection of the air-fuel ratio exceeds a predetermined time period, and the lean output deterioration as a state of the sensor in which the output from the LAF sensor 17 corresponding to an air-fuel ratio value leaner than the stoichiometric air-fuel ratio of the mixture deviates from a proper value to a predetermined degree or more. Details of these determinations will be described hereinafter with reference to FIGS. 32 to 46B.

Then, at the following step S402, it is determined whether or not deterioration of the LAF sensor has been detected. If deterioration of the LAF sensor has not been detected, the present program is immediately terminated.

If deterioration of the LAF sensor has been detected, it is determined at a step S403 whether or not the detected deterioration is the response deterioration, and if the detected deterioration is not the response deterioration, it is determined at a step S405 whether or not the detected deterioration is the lean output deterioration. If the detected deterioration is the response deterioration at the step S403, the sampled value of the LAF sensor output VLAF to be selected by the LAF sensor output-selecting operation is changed to a value sampled at later timing at a step S404, as described hereinabove. This makes it possible to accurately estimate the cylinder-by-cylinder air-fuel ratio even when the LAF sensor suffers from the response deterioration, thereby preventing degradation of exhaust emission characteristics of the engine.

Further, if the detected deterioration is the lean output deterioration, it may include a case in which the label resistance value cannot be read whereby the sensor output value cannot be corrected according to the label resistance value and consequently the output from the LAF sensor can largely deviate not only from a proper value on a side leaner than the stoichiometric air-fuel ration but also from a proper value on a side richer than the same. Therefore, as described above with reference to FIG. 27, both the feedback control on the leaner side and the feedback control on the richer side (the feedback control by the use of the cylinder-by-cylinder correction coefficient KOBSV#N and the feedback control by the use of the PID correction coefficient KLAF) are stopped or inhibited, and the feedback control of the air-fuel ratio to the stoichiometric air-fuel ratio (stoichiometric feedback control) alone is carried out by setting the desired air-fuel ratio KCMD to 1.0 at a step S407. This makes it possible to prevent the air-fuel ratio of the mixture supplied to the engine from being feedback-controlled to a value other than the stoichiometric air-fuel ratio, when the desired air-fuel ratio is other than the stoichiometric air-fuel ratio, thereby preventing degradation of exhaust emission characteristics of the engine.

Further, if the detected deterioration is neither the response deterioration nor the lean output deterioration, i.e. if the detected deterioration is the stoichiometric output deterioration, the KLAF reset flag FKLAFRESET is set to "1", thereby inhibiting the cylinder-by-cylinder air-fuel ratio feedback control as mentioned hereinabove with reference to FIG. 17. In this case, the feedback control by the use of the PID correction coefficient KLAF is also stopped or inhibited (see FIG. 4). This makes it possible to prevent the air-fuel ratio from being feedback-controlled to a value other than the desired value, and hence prevent exhaust emission characteristics of the engine from being degraded.

Details of the deterioration determination will now be described with reference to FIGS. 32A to 34.

First, the manner of determining the stoichiometric output deterioration will be described with reference to FIGS. 32A and 32B. As shown in these figures, according to this deterioration determination, when the output from the O2 sensor 18 is at a high level (indicating that the detected air-fuel ratio is richer than the stoichiometric air-fuel ratio), the desired equivalent ratio KCMD is progressively decreased, whereas when the same is at a low level (indicating that the detected air-fuel ratio is leaner than the stoichiometric air-fuel ratio), the desired equivalent ratio KCMD is progressively increased, and then an average value KACTAV (=(KACT(B)+KACT(C)+KACT(C)+KACT(D)) of the actual equivalent ratio KACT detected at time points B, C, D, and E of inversion of the output from the O2 sensor with respect to the stoichiomtetric air-fuel ratio is calculated. Then, if the KACTAV value deviates from 1.0 by a predetermined amount or more, it is determined that the LAF sensor 17 suffers from the stoichiometric output deterioration. The number of sampled values of the actual equivalent ratio KACT for calculating the average value KACTAV is not limited to four, but the number of sampled values of the actual equivalent ratio KACT on the leaner side and the number of sampled values of the same on the richer side have to be equal to each other.

Figures 33A, 33B:
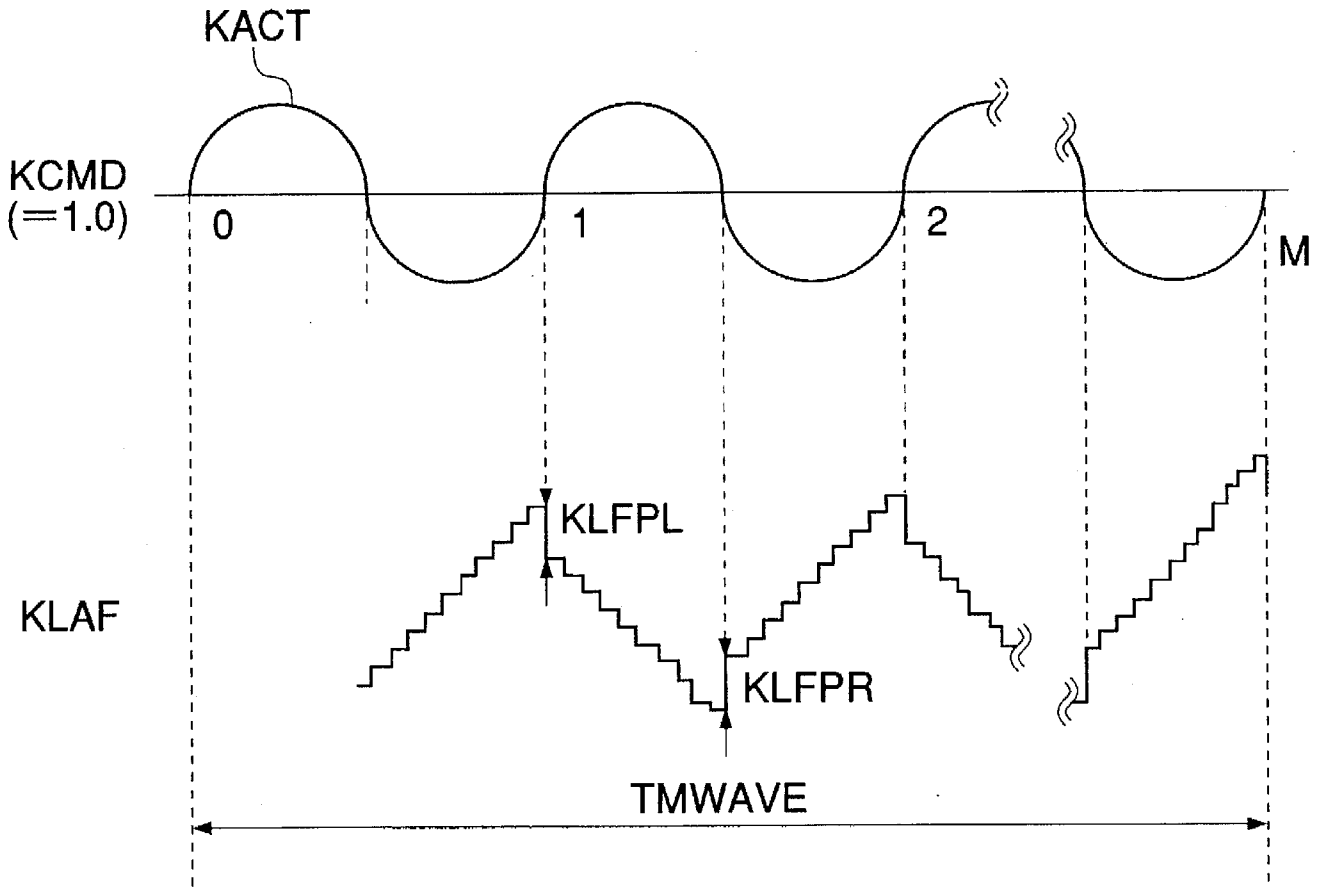

Next, the manner of determination of the response deterioration will be described with reference to FIGS. 33A and 33B. During execution of this determination, the normal PID feedback control is stopped or inhibited by setting and holding the desired air-fuel ratio KCMD to and at 1.0, and PI feedback control is executed by the use of the integral term by which the PID correction coefficient KLAF is progressively decreased so long as the actual equivalent ratio KACT is larger than 1.0, and progressively increased so long as the same is smaller than 1.0, and the proportional term which is applied to decrease or increase the PID correction coefficient KLAF when the actual equivalent ratio KACT changes across 1.0 in an enriching direction or in a leaning direction. Then, a time period TMWAVE is measured, which is required for the actual equivalent ratio KACT to be inverted with respect to 1.0 a predetermined number of times M×2. A repetition period of inversion tmCYCL (=TMWAVE/M) is calculated based on the time period TMWAVE. When the tmCYCL value exceeds a predetermined reference period tmCYCLOCK, it is determined that the LAF sensor 17 suffers from the response deterioration.

Figure 34:
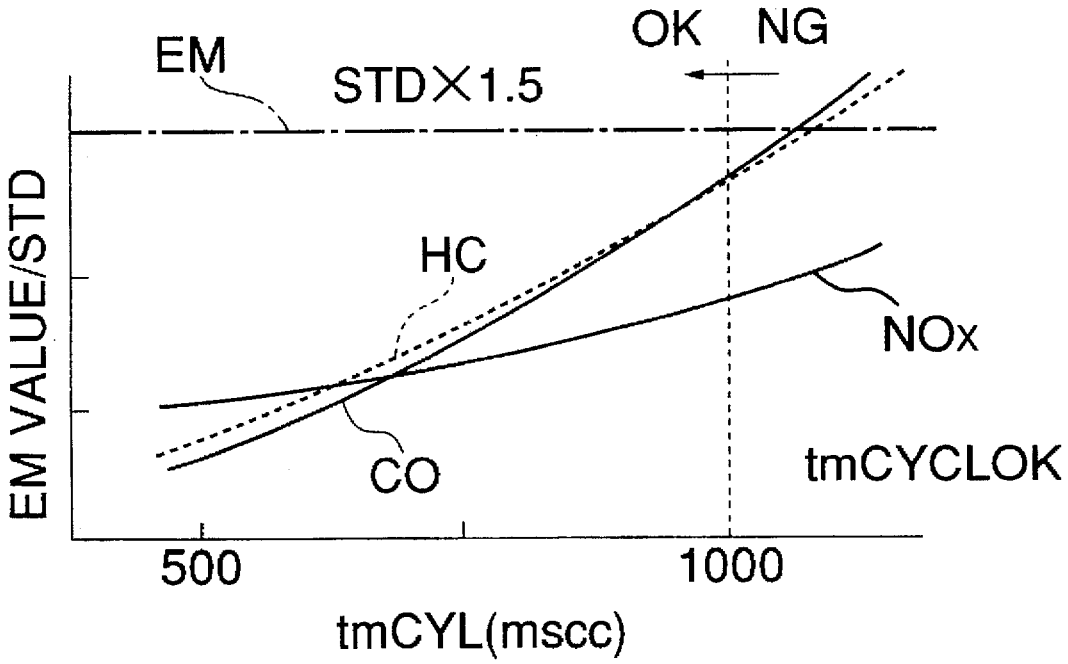
FIG. 34 is a diagram useful in explaining how a reference value for determining the response deterioration of the LAF sensor is set.

In this embodiment, the predetermined reference period tmCYCLOCK is set to 1.5 times as long as a normal repetition period tmCYCSTD. This is based on the that there is a correlation between the repetition period of inversion of the LAF sensor 17 and exhaust emission characteristics of the engine as shown in FIG. 34. That is, the predetermined reference period tmCYCLOCK is set based on this correlation such that it corresponds to an allowable limit of degradation of exhaust emission characteristics.

Figure 35:
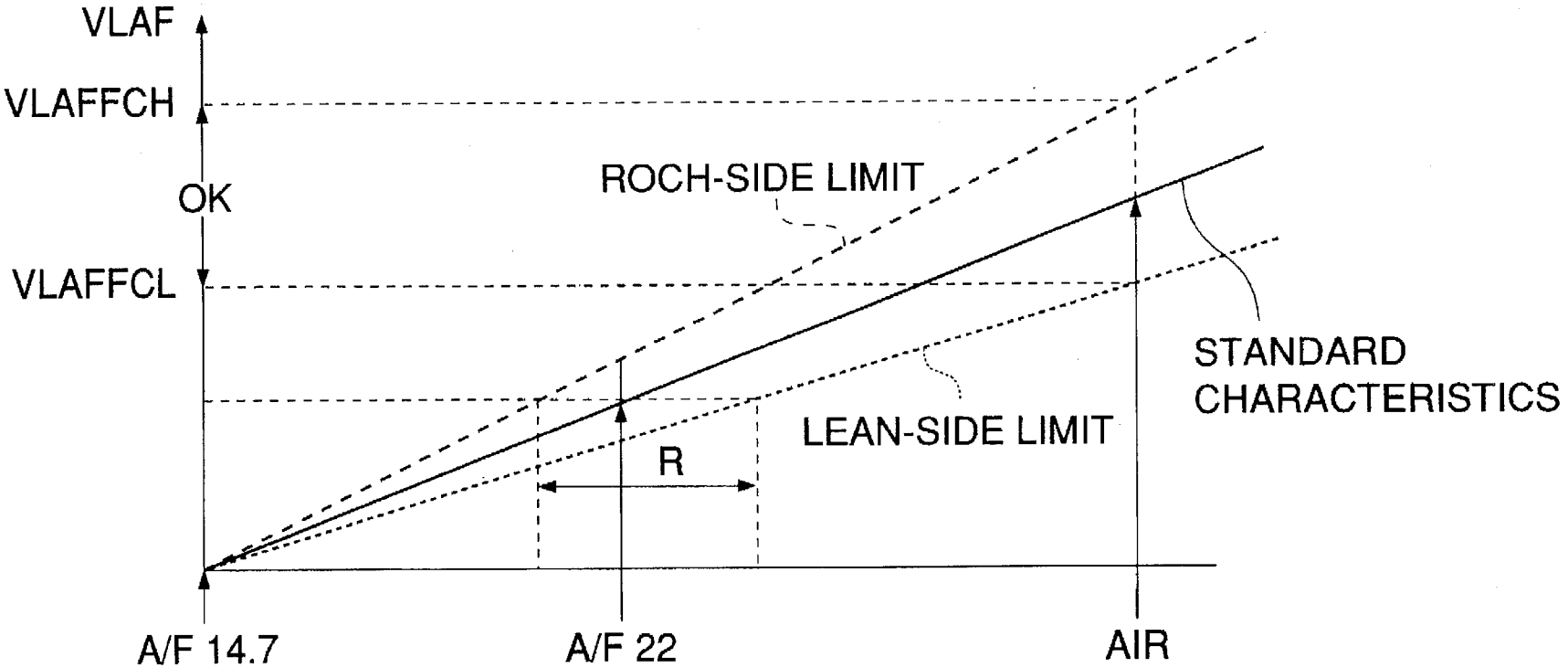
FIG. 35 is a diagram useful in explaining how deterioration of the LAF sensor in respect of its output with respect to a lean air-fuel ratio (lean output deterioration) is determined.

Next, the manner of determining the lean output deterioration will be described with reference to FIG. 35. According to this determination, it is determined that the LAF sensor 17 suffers from the lean output deterioration when the output VLAF from the LAF sensor 17 exhibited upon the lapse of a predetermined time period after the start of fuel cut when exhaust gases contain almost no fuel (i.e. air substantially prevails in the exhaust pipe), has continuously lain outside a range defined by predetermined upper limit and lower limit values VLAFFCH and VLAFFCL. The predetermined upper and lower limit values VLAFFCH and VLAFFCL correspond to a tolerance control range R of the air-fuel ratio A/F applied when the LAF sensor output VLAF indicates an A/F value of 22.

Figure 36:
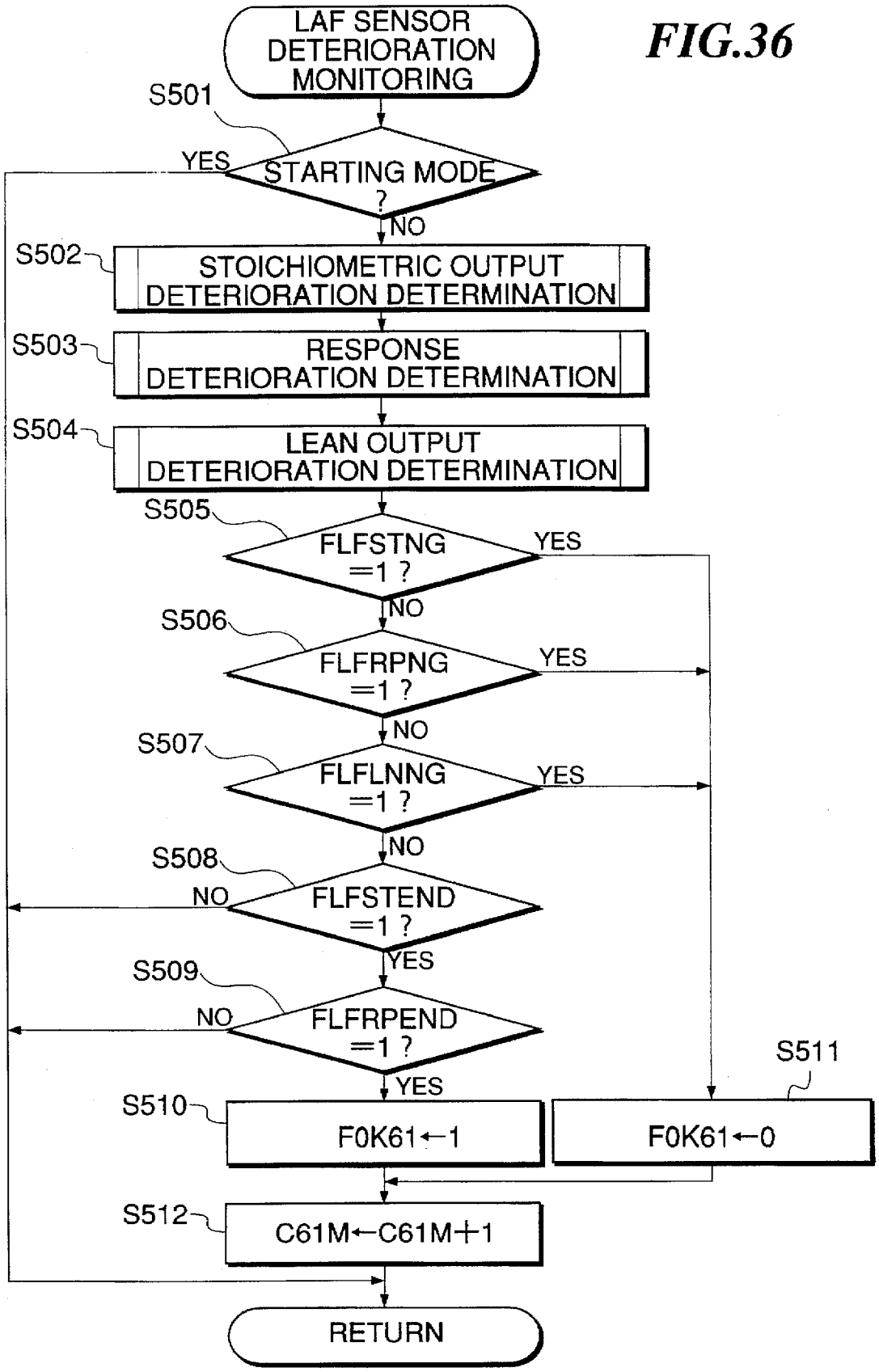
FIG. 36 is a flowchart showing a main routine for determining whether the LAF sensor has been deteriorated.

FIG. 36 shows a subroutine for executing the step S401 of the FIG. 31 for the determination of deterioration of the LAF sensor, which is executed at predetermined time intervals of e.g. 10 msec.

First, at a step S501, it is determined whether or not the engine is in the starting mode, i.e. being cranked. If the engine is in the starting mode, the present processing is immediately terminated, whereas if the engine is not in the starting mode, determinations of the stoichiometric output deterioration, the response deterioration, and the lean output deterioration are executed sequentially at respective steps S502, S503, and S504. Then, it is determined at a step S505 whether or not a stoichiometric output deterioration flag FLFSTNG, which, when set to "1", indicates that the stoichiometric output deterioration has been detected, assumes "1". If FLFSTNG=0 holds at the step S505, it is determined at a step S506 whether or not a response deterioration flag FLFRPNG, which, when set to "1", indicates that the response deterioration has been detected, assumes "1". If FLFRPNG=0 at the step S506, it is determined at a step S507 whether or not a lean output deterioration flag FLFLNNG, which, when set to "1", indicates that the lean output deterioration has been detected, assumes "1".

If any of the answers to the questions of the steps S505 to S507 is affirmative (YES), i.e. any of the above types of the LAF sensor deterioration has been detected, an OK flag FOK61, which, when set to "1", indicates that the LAF sensor 17 has not been deteriorated, is set to "0" at a step S511, and the count of a counter C61M is incremented by "1" at a step S512, followed by terminating the present program.

On the other hand, if all the answers to the questions of the steps S505 to S507 are negative (NO), it is determined at a step S508 whether or not a stoichiometric output deterioration determination termination flag FLFSTEND, which, when set to 1, indicates that the stoichiometric output deterioration determination has been terminated, assumes "1". If FLFSTEND=1 holds at the step S508, it is determined at a step S509 whether or not a response deterioration determination termination flag FLFRPEND, which, when set to "1", indicates that the response deterioration determination has been terminated, assumes "1". If the answer to the question of either the step S508 or the step S509 is negative (NO), the present program is immediately terminated, whereas both the answers to these questions are affirmative (YES), the OK flag FOK61 is set to "1" at a step S510, followed by the program proceeding to the step S512.

Figure 37:
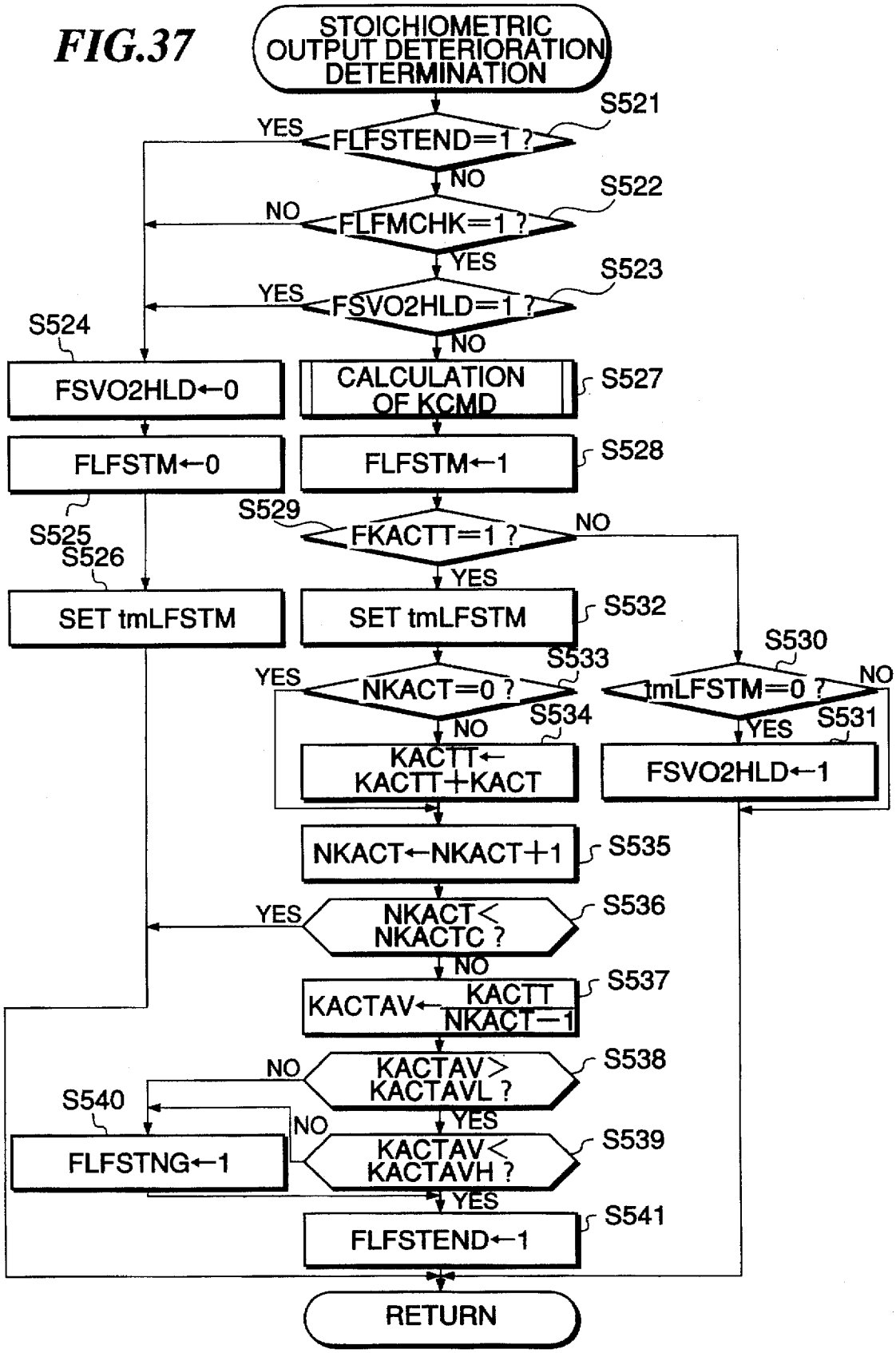
FIG. 37 is a subroutine for executing a step S502 of the FIG. 36 routine for determining the stoichiometric output deterioration of the LAF sensor.

FIG. 37 shows a subroutine for executing the step S502 of the FIG. 36 routine for executing the stoichiometric output deterioration determination.

First, at a step S521, it is determined whether or not the stoichiometric output deterioration determination termination flag FLFSTEND assumes "1". If FLFSTEND=0 holds, it is determined at a step S522 whether or not a first monitoring condition flag FLFMCHK, which, when set to "1", indicates that first monitoring conditions are fulfilled, assumes "1". The first monitoring conditions are for permitting execution of the stoichiometric output deterioration determination and the response deterioration determination. The flag FLFMCHK is set by a subroutine, shown in FIG. 41, described hereinafter.

If the answer to the question of the step S522 is affirmative (YES), it is determined at a step S523 whether or not an O2 sensor output (VMO2) monitoring flag FSVO2HLD assumes "1". If FVO2HLD=0 holds, the program proceeds to a step S527, whereas if the answer to the question of the step S521 or the step S523 is affirmative (YES), or if the answer to the question of the step S522 is negative (NO), the VMO2 monitoring flag FSVO2HLD is set to "0" at a step S524, and a stoichiometric output deterioration determination execution flag FLFSTM, which, when set to "1", indicates that the stoichiometric output deterioration determination is being executed, is set to "0" at a step S525. Then, a downcount timer tmLFSTM is set to a predetermined time period TLFSTM at a step S526, followed by terminating the program.

At a step S527, the desired equivalent ratio KCMD is calculated by executing a subroutine shown in FIG. 38, described hereinafter, and then at a step S528, the stoichiometric output deterioration determination flag FLFSTM is set to "1", followed by the program proceeding to a step S529.

At the step S529, an inversion flag FKACTT, which, when set to "1", indicates that a predetermined time period has elapsed after inversion of the output from the O2 sensor, assumes "1". If FKACTT=0 holds at the step S529, it is determined at a step S530 whether or not the count of the downcount timer tmLFSTM set at the step S526 or a step S532, referred to hereinafter, is equal to "0". If tmLFSTM>0 holds at the step S530, i.e. if the predetermined time period TLFSTM has not elapsed, the present program is immediately terminated, whereas if tmLFSTM=0 holds at the same, the VMO2 monitoring flag FSVO2LHD is set to "1" at a step S531, followed by terminating the program.

If FKACTT=1 holds at the step S529, i.e. if the output from the O2 sensor has been inverted, the downcount timer tmLFSTM is set to the predetermined time period TLFSTM and started at the step S532, and then it is determined at a step S533 whether or not the count of the count NKACT of an NKACT counter is equal to "0". When this step is first executed, NKACT=0 holds, so that the program jumps to a step S535, wherein the count NKACT of the NKACT counter is incremented by "1". Then, it is determined at a step S536 whether or not the count NKACT of the NKACT counter is smaller than a predetermined value NKACTC (e.g. 5). When this step is first executed, NKACT<NKACTC holds, and the present program is immediately terminated.

If it is determined that the output from the O2 sensor has been inverted, the answer to the question of the step S533 is negative (NO), and then a cumulative value KACTT of the actual equivalent ratio KACT is calculated at a step S534 by the use of the following equation (28), followed by the program proceeding to a step S535:

$$KACTT=KACTT+KACT \tag{28}$$

When NKACT=NKACTC holds at the step S536, the program proceeds to a step S537, wherein the average value KACTAV of the actual equivalent ratio KACT is calculated by the use of the following equation:

$$KACTAV=KACTT/(NKACT-1) \tag{29}$$

Figures 32A, 32B:
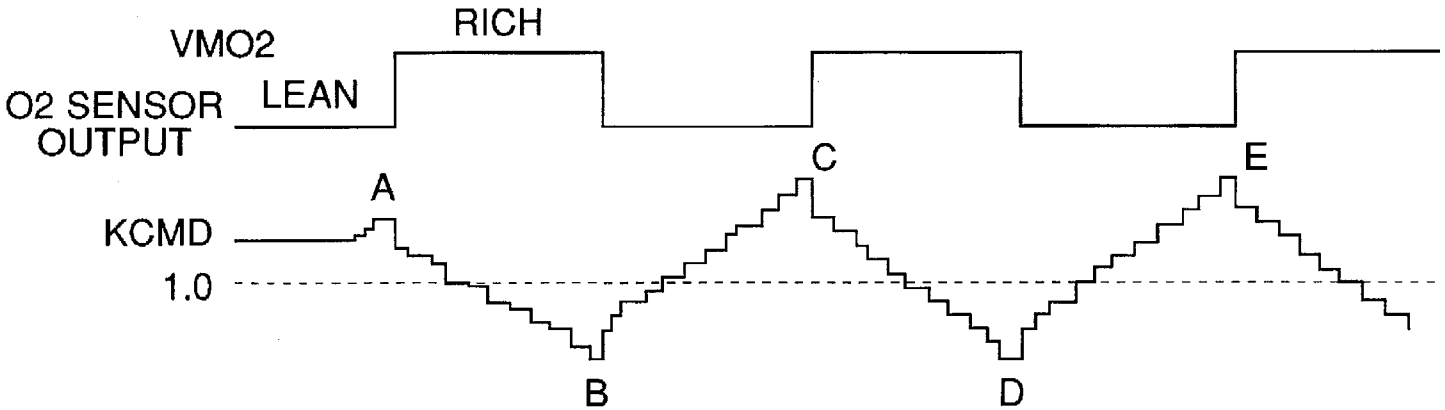

Thus, the average value KACTAV is obtained as an average value of KACT values obtained at time points B, C, D, and E appearing in FIG. 32B.

At the following steps S538 and S539, it is determined whether or not the KACTAV value is larger than a predetermined lower limit value KACTAVL, and whether or not the same is smaller than a predetermined higher limit value KACTAVH, respectively. If KACTAVL<KACTAV<KACTAVH holds, it is determined that the LAF sensor is not deteriorated in respect of the stoichiometric output, and then the program jumps to a step S541, wherein the stoichiometric output deterioration determination termination flag FLFSTEND is set to "1", followed by terminating the program.

Further, if KACTAV≦KACTAVL or KACTAV≧KACTAVH holds at the step S538 or S539, it is determined that the LAF sensor 17 suffers from the stoichiometric output deterioration, and then the flag FLFSTNG is set to "1" at a step S540, followed by the program proceeding to the step s541.

Figure 38:
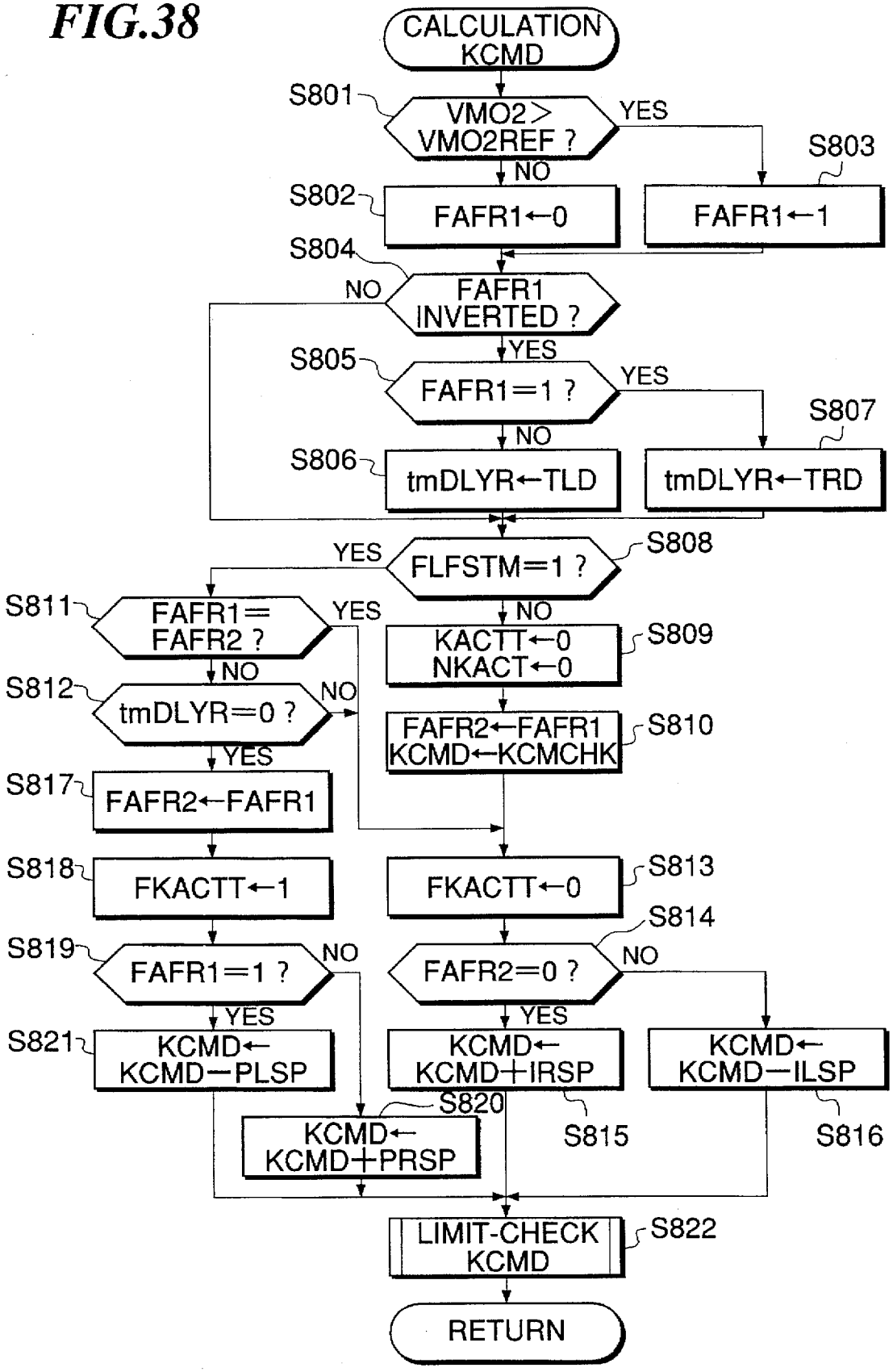
FIG. 38 is a subroutine for executing a step S527 of the FIG. 37 routine for calculating the desired air-fuel ratio KCMD during determination of the stoichiometric output deterioration.

FIG. 38 shows a subroutine for executing the step S527 of the FIG. 37 routine for calculating the desired equivalent ratio KCMD during the stoichiometric output determination.

First, at a step S801, it is determined whether or not the output VMO2 from the O2 sensor 18 is higher than a predetermined reference value VMO2REF. If VMO2>VMO2REF holds, which means that the output from the O2 sensor indicates an air-fuel ratio richer than the stoichiometric air-fuel ratio, a first rich flag FAFR1 is set to "1" at a step S803, whereas if VMO2<VMO2REF holds, which means that the output from the O2 sensor indicates an air-fuel ratio leaner than the stoichiometric air-fuel ratio, the flag FAFR1 is set to "0" at a step S802, followed by the program proceeding to a step S804.

At the step S804, it is determined whether or nor the first rich flag FAFR1 has been inverted. If the first rich flag FAFR1 has not been inverted, the program jumps to a step S808, whereas if the same has been inverted, it is determined at a step S805 whether or not the first rich flag FAFR1 assumes "1". If FAFR1=1 holds at the step S805, a downcount timer tmDLYR is set to a predetermined rich-side time period TRD and started at a step S807 to measure a time period after inversion of the first rich flag FAFR1, whereas if FAFR1=0 holds at the step S805, the downcount timer tmDLYR is set to a predetermined lean-side time period TLD at a step S806, followed by the program proceeding to a step S808.

At the step S808, it is determined whether or not the stoichiometric output deterioration determination execution flag FLFSTM assumes "1". If FLFSTM=0 holds, and hence the stoichiometric output deterioration determination is started in this loop, the cumulative value KACTT of the actual equivalent ratio KACT and the count KNACT of the counter NKACT to be incremented at the step S535 are both set to "0" at a step S809. Then, a second rich flag FAFR2 is set to a value equal to the first rich flag FAFR1, and the desired equivalent ratio KCMD is set to a predetermined value KCMCHK (e.g. 1.0) at a step S810, followed by the program proceeding to a step S813.

At the step S813, the inversion flag FKACTT is set to "0", and then it is determined at a step S814 whether or not the second rich flag FAFR2 assumes "0". If FAFR2=0 holds at the step S814, a rich-side integral term IRSP is added to the desired equivalent ratio KCMD at a step S815, whereas if FAFR2=1 at the same step, a lean-side integral term ILSP is subtracted from the KCMD value at a step S816, followed by the program proceeding to a step S822.

If FLFSTM=1 holds at the step S822, i.e. the stoichiometric output determination is being executed, the program proceeds to a step S811, wherein it is determined whether or not the first rich flag FAFR1 and the second rich flag FAFR2 are equal to each other. If FAFR1=FAFR2 holds at the step S811, the program proceeds to the step S813, whereas if FAFR≠FAFR2 holds at the step S811, it is determined at a step S812 whether or not the count of the downcount timer tmDLYR started at the step S806 or S807 is equal to "0". Immediately after inversion of the first rich flag FAFR1, tmDLYR>0 holds, and hence the program proceeds to the step S813, and when tmDYLR=0 holds, the second rich flag FAFR2 is made equal to the first rich flag FAFR1 at a step S817, and then the inversion flag FKACTT is set to "1" at a step S818.

At the following step S819, it is determined whether or not the first rich flag FAFR1 assumes "1". If FAFR1=0 holds, a rich-side proportional term PRSP is added to the desired equivalent ratio KCMD at a step S820, whereas if FAFR1=1 holds, a lean-side proportional term PLSP is subtracted from the KCMD value at a step S821, followed by the program proceeding to a step S822.

Figure 39:
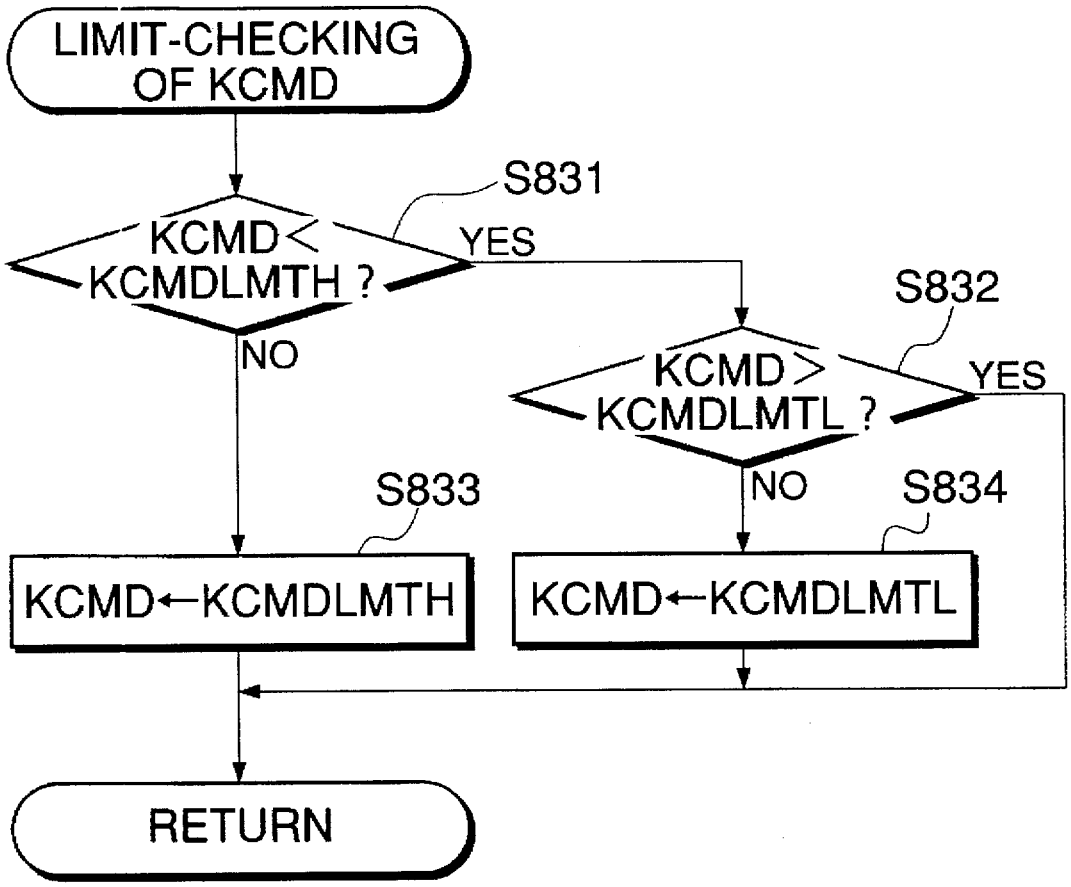
FIG. 39 is a flowchart for executing a step S822 of the FIG. 38 subroutine for limit-checking of the KCMD value.

At the step S822, a subroutine shown in FIG. 39 is executed for limit-checking of the KCMD value, followed by terminating the present program.

In the FIG. 39 subroutine, the KCMD value is compared with predetermined upper and lower limit values KCMDLMTH and KCMDLML at respective steps S831 and S832. If the KCMD value is larger than the predetermined upper limit value KCMDLMTH, the desired equivalent ratio KCMD is set to the predetermined upper limit value KCMDLMTH at a step S833, whereas if the KCMD value is smaller than the predetermined lower limit value KCMDLMTL, the desired equivalent ratio KCMD is set to the predetermined lower limit value KCMDLML at a step S834.

According to the FIG. 38 subroutine described above, during execution of the stoichiometric output deterioration determination, the desired equivalent ratio KCMD is subjected to the proportional/integral control in response to the output VMO2 from the O2 sensor 18. It should be noted that in the example of FIGS. 32A and 32B, referred to hereinbefore, both the rich-side time period TRD and the lean-side time period TLD to which the timer tmDLYR is set are "0".

Figure 40:
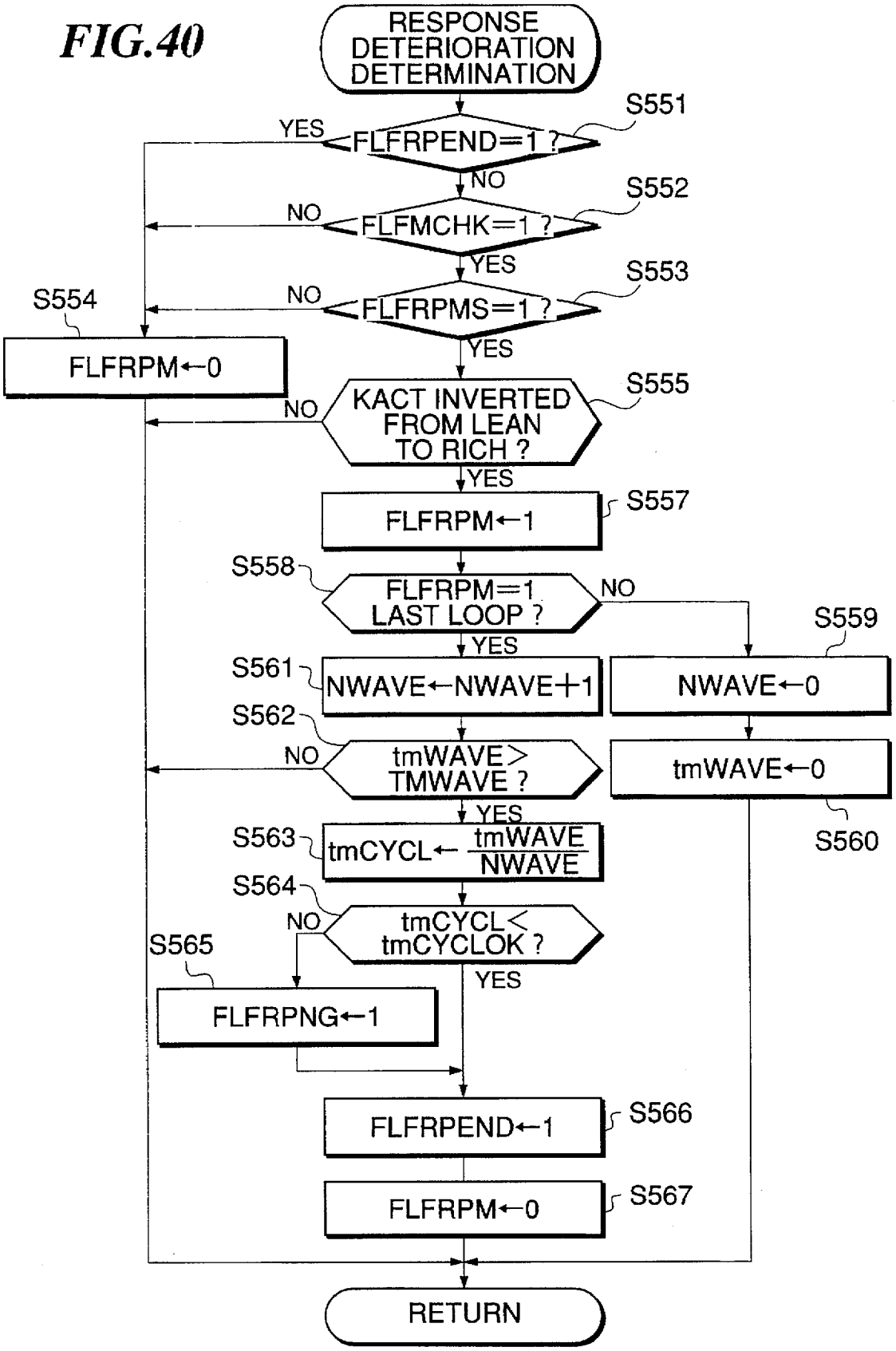
FIG. 40 is a flowchart for executing a step S503 of the FIG. 36 routine for determining the response deterioration of the LAF sensor.

FIG. 40 shows a subroutine for executing the step S504 of the FIG. 36 routine for determining the response deterioration of the LAF sensor 18.

First, at a step S551, it is determined whether or not the response deterioration determination flag FLFRPEND assumes "1". If FLAFRPEND=0 holds at the step S551, it is determined at a step S552 whether or not the first monitoring condition flag FLFMCHK assumes "1". If FLFMCHK=1 holds, i.e. if the first monitoring conditions are fulfilled, it is determined at a step S553 whether or not a response deterioration determination start flag FLFRPMS, which, when set to "1", indicates that conditions for starting the response deterioration determination are fulfilled, assumes "1". If FLFRPEND=1 at the step S551, FLFMCHK=0 at the step S552, or if FLFRPMS=0 at the step S553, a response deterioration determination execution flag FLFRPM, which, when set to "1", indicates that the response deterioration determination is being executed, is set to "0" at a step S554, followed by termination the program.

On the other hand, if the response deterioration determination start flag FLFRPMS assumes "1" at the step S553, it is determined at a step S555 whether or not the actual equivalent ratio KACT has been inverted in an increasing direction with respect to 1.0, i.e. changed from a value smaller than 1.0 to a value larger than 1.0. If the actual equivalent ratio KACT has not been inverted, the present program is immediately terminated, whereas if the same has been inverted, the response deterioration determination flag FLFRPM is set to "1" at the step S557, and then it is determined at a step S558 whether or not the flag FLFRMP assumed "1" in the immediately preceding loop. If FLFRPM=0 held in the immediately preceding loop, an NWAVE counter and a tmWAVE upcount timer are both set to "0" at respective steps S559 and S560, followed by terminating the program.

If it is determined at the step S558 that FLFPRM=1 held in the immediately preceding loop as well, the count NWAVE of the NWAVE counter is incremented by "1" at a step S561, and it is determined at a step S562 whether or not the count tmWAVE of the tmWAVE upcount timer has exceeded a predetermined time period TMWAVE. If tmWAVE≦TMWAVE holds, the present program is immediately terminated, whereas if tmWAVE>TMWAVE holds, the repetition period tmCYCL is calculated by the use of the following equation (30):

$$tmCYCL=tmWAVE/NWAVE \quad (30)$$

At the following step S564, it is determined whether or not the repetition period tmCYL is shorter than a predetermined repetition period tmCYCLOk. If tmCYCL<tmCYLOK holds, the termination flag FLFRPEND is set to "1" at a step S566, and the deterioration determination execution flag FLFRPM is set to "0" at a step S567, followed by terminating the present program.

If tmCYCL≧tmCYCLOK holds at the step S564, it is determined that the LAF sensor 17 is deteriorated in respect of response, so that the response deterioration determination flag FLFRPNG is set to "1" at a step S565, followed by the program proceeding to the step S566.

It should be noted that during execution of the response deterioration determination (FLFRPM=1), the ordinary PID feedback control is stopped or inhibited and the PI feedback control is executed using the desired equivalent ratio KCMD (=1.0) as a threshold value, as shown in FIG. 33.

Figure 41:
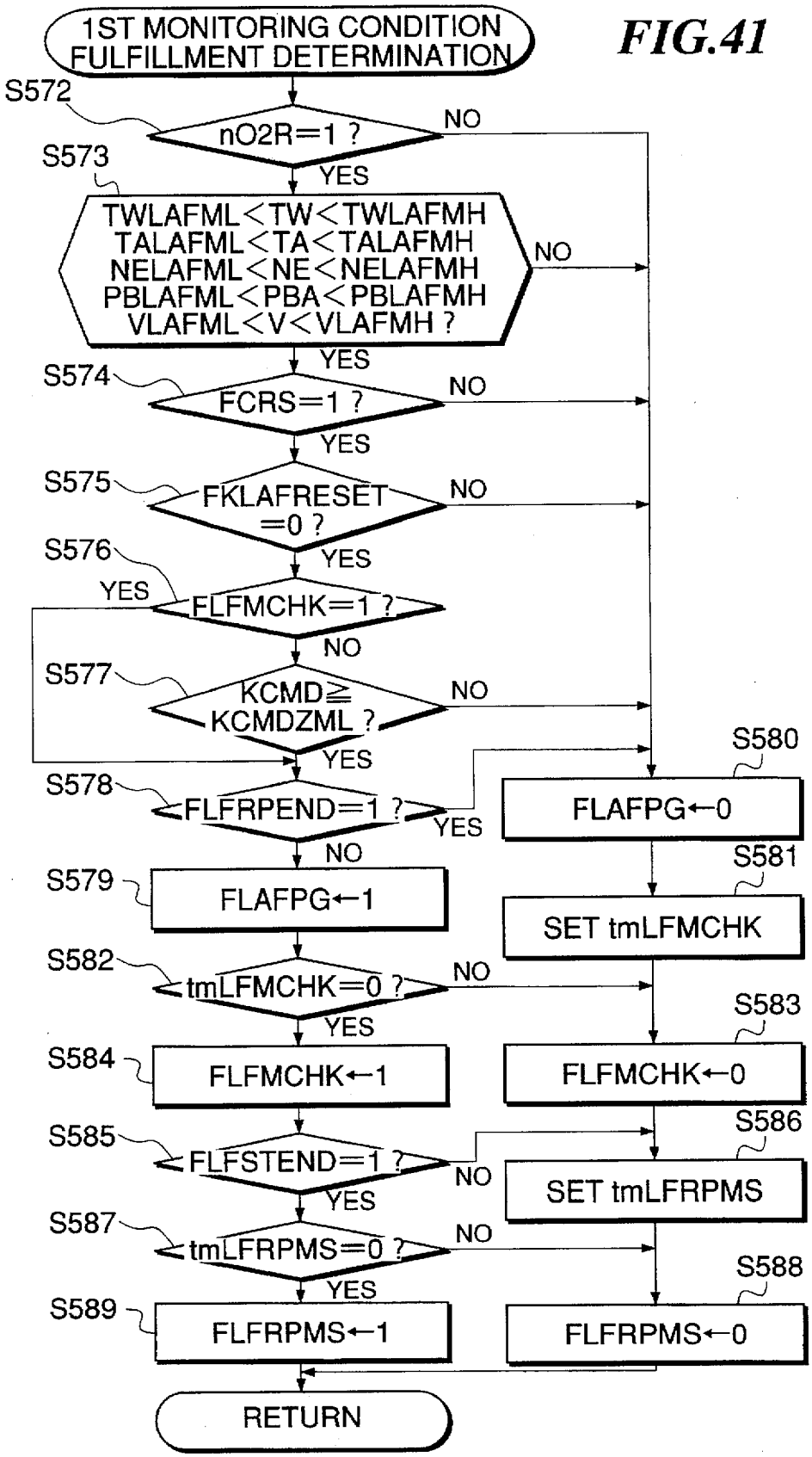
FIG. 41 is a flowchart showing a background routine for determining whether or not conditions for determining the stoichiometric output deterioration and the response deterioration of the LAF sensor (first monitoring conditions) are fulfilled.

FIG. 41 shows a routine for determining whether or not the first monitoring conditions are fulfilled, which is executed as background processing when no higher priority processing is carried out.

First, at a step S572, it is determined whether or not an activation flag nO2R, which, when set to "1", indicates that the O2 sensor 18 has been activated, assumes "1". If nO2R=1 holds, it is determined at a step S573 whether or not the engine 1 and the vehicle on which the engine 1 is installed are in a predetermined operating region.

More specifically, it is determined whether or not the engine coolant temperature TW is within a range defined by predetermined upper and lower limit values TWLAFMH and TWLAFML, the intake air temperature TA within a range defined by predetermined upper and lower limit values TALAFMH and TALAFML, the engine rotational speed NE within a range defined by predetermined upper and lower limit values NELAFMH and NELAFML, the intake pipe absolute pressure PBA within a range defined by predetermined upper and lower limit values PBLAFMH and PBLAFML, and the vehicle speed V within a range defined by upper and lower limit values VLAFMH and VLAFML. If all the answers to these questions are affirmative (YES), it is determined that the engine 1 and the vehicle are in the predetermined operating region.

Further, it is determined at a step S574 whether or not a flag FCRS, which, when set to "1", indicates that the vehicle is in a cruising condition in which the rate of change in the vehicle speed V is small, assumes "1". If FCRS=1 holds, it is determined at a step S575 whether or not the KLAF reset flag FKLAFRESET assumes "0".

If any of the answers to the questions of the steps S527 to S575 are negative (NO), it is determined that the first monitoring conditions are not fulfilled, and then the program proceeds to a step S580, wherein a purge-cut flag FLAFPG, which, when set to "1", indicates that the purging of evaporative fuel should be inhibited, is set to "0", and then a tmLFCHMK downcount timer is set to a predetermined time period TLFMCHK and started at a step S581. The first monitoring condition flag FLFMCHK is set to "0" at a step S583, a tmLFRPMS downcount timer is set to a predetermined time period TLFRPMS and started at a step S568, and the response deterioration determination start flag FLFRPMS is set to "0" at a step S588, followed by terminating the program.

If FKLAFRESET=0 holds at the step S575, which means that the engine is operating in the air-fuel ratio feedback control region, it is determined at a step S576 whether or not the first monitoring flag FLFMCHK assumes "1". If FLFMCHK=1 holds, the program jumps to a step S578, whereas if FLFMCHK=0 holds, it is determined at a step S577 whether or not the desired equivalent ratio KCMD is equal to or larger than a predetermined value KCMDZML (which is set e.g. to a value corresponding to the stoichiometric air-fuel ratio, i.e. 1.0). If KCMD<KCMDZML holds at the step S577, it is determined that the first monitoring conditions are not fulfilled, and then the program proceeds to the step S580, whereas if KCMD≧KCMDZML holds, the program proceeds to the step S578.

At the step S578, it is determined whether or not the response deterioration determination flag FLRRPEND assumes "1". If FLFRPEND=1 holds, which means that the response deterioration determination has been terminated, the program proceeds to the step S580, whereas if FLFRPEND=0 holds, the purge-cut flag FLAFPG is set to "1" at a step S579 to inhibit purging of evaporative fuel, and then it is determined at a step S582 whether or not the count of the downcount timer tmLFMCHK started at the step S581 is equal to "0". When this step is first executed, tmLFMCHK>0 holds, so that the program proceeds to the step S583, and when tmLFMCHK=0 holds, it is judged that the first monitoring conditions are fulfilled, and the flag FLFMCHK is set to "1" at a step S584. Then, it is determined at a step S585 whether or not the stoichiometric output deterioration determination termination flag RLFSTEND assumes "1".

If FLFSTEND=0 holds at the step S585, which means that the stoichiometric output deterioration determination has not been terminated, the program proceeds to a step S586, whereas if FLFSTNED=1 holds after termination of the stoichiometric output deterioration determination, the program proceeds to a step S587, wherein it is determined whether or not the count of the downcount timer tmLFRPMS is equal to "0". When this step is first executed, tmLFRPMS>0 holds, so that the program proceeds to the step S588, and when tmLFRPMS=0 holds, the response deterioration determination start flag FLFRPMS is set to "1" at a step S589, thereby permitting starting of the response deterioration determination.

FIG. 42 shows a subroutine for executing the step S504 for determining the lean output deterioration.

First, at a step S601, it is determined whether or not a lean output deterioration determination-enabling flag FLFFCLN assumes "1", which is set to "1" by executing a subroutine shown in FIG. 44, referred to hereinafter, to indicate that second monitoring conditions, i.e. conditions for executing the lean output deterioration determination, are fulfilled. If FLFFCLN=0 holds, which means that the second monitoring conditions are not fulfilled, it is determined at a step S602 whether or not a lean output deterioration termination flag FLNJG, which, when set to "1", indicates that the lean output deterioration determination has been terminated, assumes "1". If FLNJG=0 holds, the program jumps to a step S605, whereas if FLNJG=1 holds, the flag FLNJG is set to "0" at a step S603, and then a check flag FFCCHK, which, when set to "1", indicates that the determination as to whether the output VLAF from the LAF sensor 17 falls within a range defined by predetermined upper and lower limit values has been completed, is set to "0" at a step S604, followed by the program proceeding to the step S605.

At the step S605, a CFCCHK check counter for setting a repetition period for monitoring the VLAF value is set to a predetermined value NFCCHK, and then a CIPFCST stable time period counter for measuring a time period after the variation in the VLAF value comes to be within a predetermined range is set to a predetermined value NIPFCST at a step S611, followed by the program proceeding to a step S622.

If FLFFCLN=1 holds at the step S601, which means that the second monitoring conditions are fulfilled, it is determined at a step S606 whether or not the count CFCCHK of the check counter set at the step S605 is equal to "0". When this step is first executed, CFCCHK>0 holds, so that the count CFCCHK of the check counter is decremented by "1" at a step S607, and then the program proceeds to a step S622. If CFCCHK=0 holds at the step S606, the program proceeds to a step S608, wherein the CFCCHK check counter is set to the predetermined time period NFCCHK again. Then, it is determined at a step S609 whether or not the check flag FFCHK assumes "1". If FFCCHK=0 holds, it is determined at a step S610 whether or not the variation in the output VLAF from the LAF sensor 17 is within the aforementioned predetermined range.

If FFCCHK=1 holds or if the variation in the VLAF value exceeds the predetermined range, the program proceeds to the step S611 without executing monitoring of the VLAF value, whereas if FFCCHK=0 holds and at the same time the variation in the VLAF value is small, i.e. within the predetermined range, it is determined at a step S612 whether or not the count CIPFCST of the stable time period counter set at the step S611 is equal to "0". When this step is first executed, CIPFCST>0 holds, so that the program proceeds to a step S613, wherein the count CIPFCST of the stable time period counter is decremented by "1", and then the program proceeds to the step S622. If CIPFCST=0 holds at the step S612, it is determined whether or not the VLAF value is within the range defined by the predetermined upper and lower limit values VLAFFCH and VLAFFCL, referred to hereinbefore with reference to FIG. 35, (at steps S614 and S615). If VLAF>VLAFFCH or VLAF<VLAFFCL holds, which means that the VLAF value is outside the above range, the count CIPFCNG of an NG counter is incremented by "1" at a step S616, and then it is determined at a step S617 whether or not an overflow from the NG counter occurs. If no overflow from the NG counter occurs, the program jumps to a step S621, whereas if an overflow from the counter NG occurs, the NG counter is set to a predetermined value FF (hexadecimal) at a step S618, followed by the program proceeding to the step S621.

On the other hand, if the determinations at the steps S614 and S615 provide a result of VLAFFCL≦VLAF≦VLAFFCH, which means that the VLAF value is within a range of tolerance, the program proceeds to a step S619, wherein it is determined whether or not the count CIPFCNG of the NG counter is equal to "0". If CIPFCNG=0 holds, the program jumps to the step S621, whereas if CIPFCNG>0 holds, the count CIPFCNG of the NG counter is decremented by 1 at a step S620, followed by the program proceeding to the step S621.

At the step S621, the check flag FFCCHK is set to "1", and then the program proceeds to the step S622.

Figure 43:
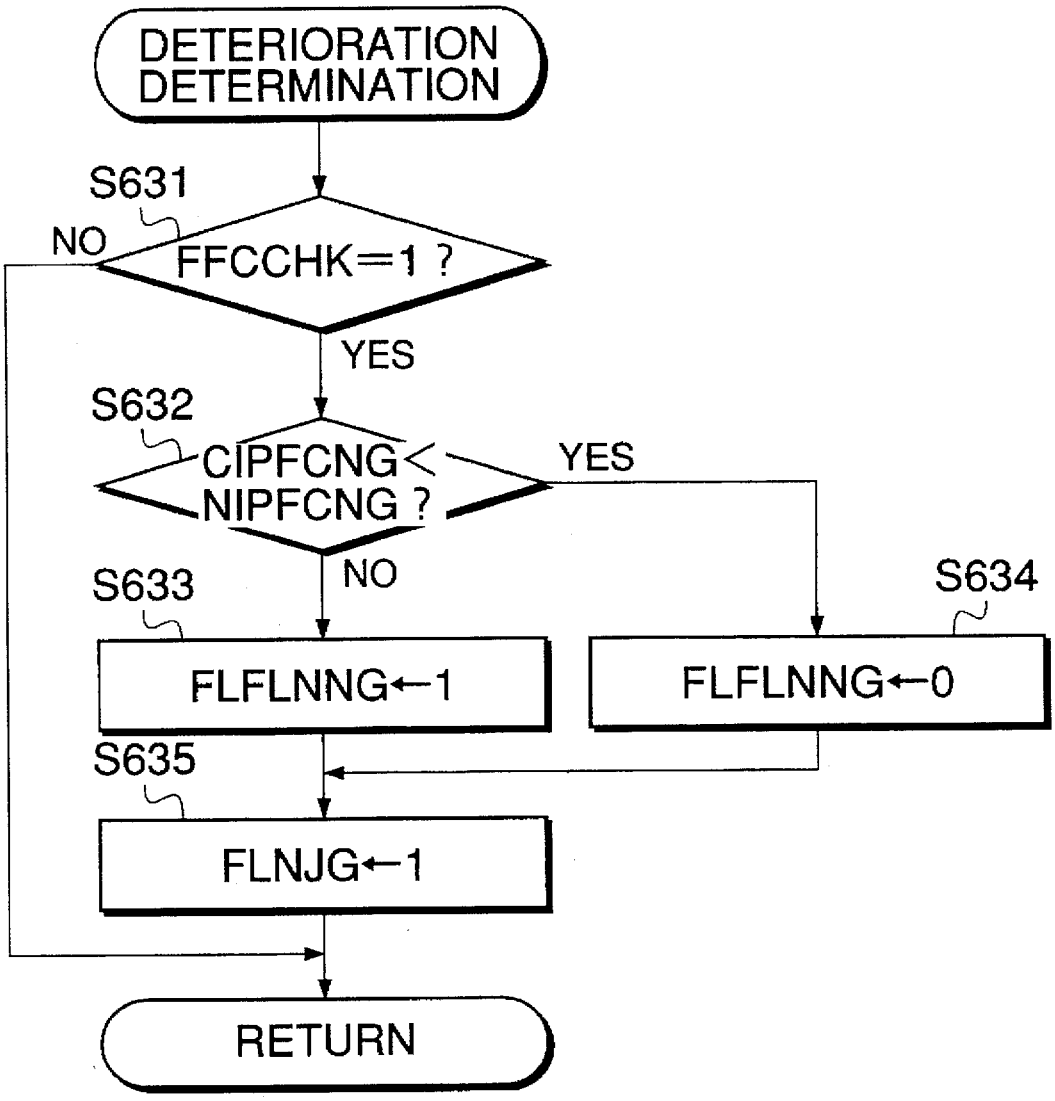
FIG. 43 is a flowchart showing a subroutine for executing a step S622 of the FIG. 42 subroutine.

At the step S622, a subroutine shown in FIG. 43 is executed. More specifically, it is determined at a step S631 whether or not the check flag FFCCHK assumes "1". If FFCCHK=0 holds, the present program is immediately terminated.

If FFCCHK=1 holds at the step S631, it is determined at a step S632 whether or not the count CIPFCNG of the NG counter is smaller than a predetermined reference value NIPFCNG (e.g. 2). If CIPFCNG<NIPFCNG holds, it is determined that the LAF sensor does not suffer from the lean output deterioration, so that the lean output deterioration flag FLFLNNG is set to "0" at a step S634, followed by the program proceeding to a step S635, whereas if CIPFCNG≧NIPFCNG holds, it is judged that the LAF sensor suffers from the lean output deterioration, so that the lean output deterioration flag FLFLNNG is set to "1" at a step S633, and then at the following step S635, the lean output deterioration termination flag FLNJG is set to "1", followed by terminating the program.

According to the FIGS. 42 and 43 subroutines described above, when the output VLAF from the LAF sensor 17 is outside the range defined by the predetermined upper and lower limit values VLAFFCH and VLAFFCL, the count CIPFNG of the NG counter is incremented at the step S616, whereas if the output VLAF is within the range, the count CIPFNG of the NG counter is decremented at the step S620. When the count CIPFNG of the NG counter becomes equal to or larger than the predetermined reference value NIPFCNG, it is determined at the step S633 that the LAF sensor 17 suffers from the lean output deterioration.

Figure 44:
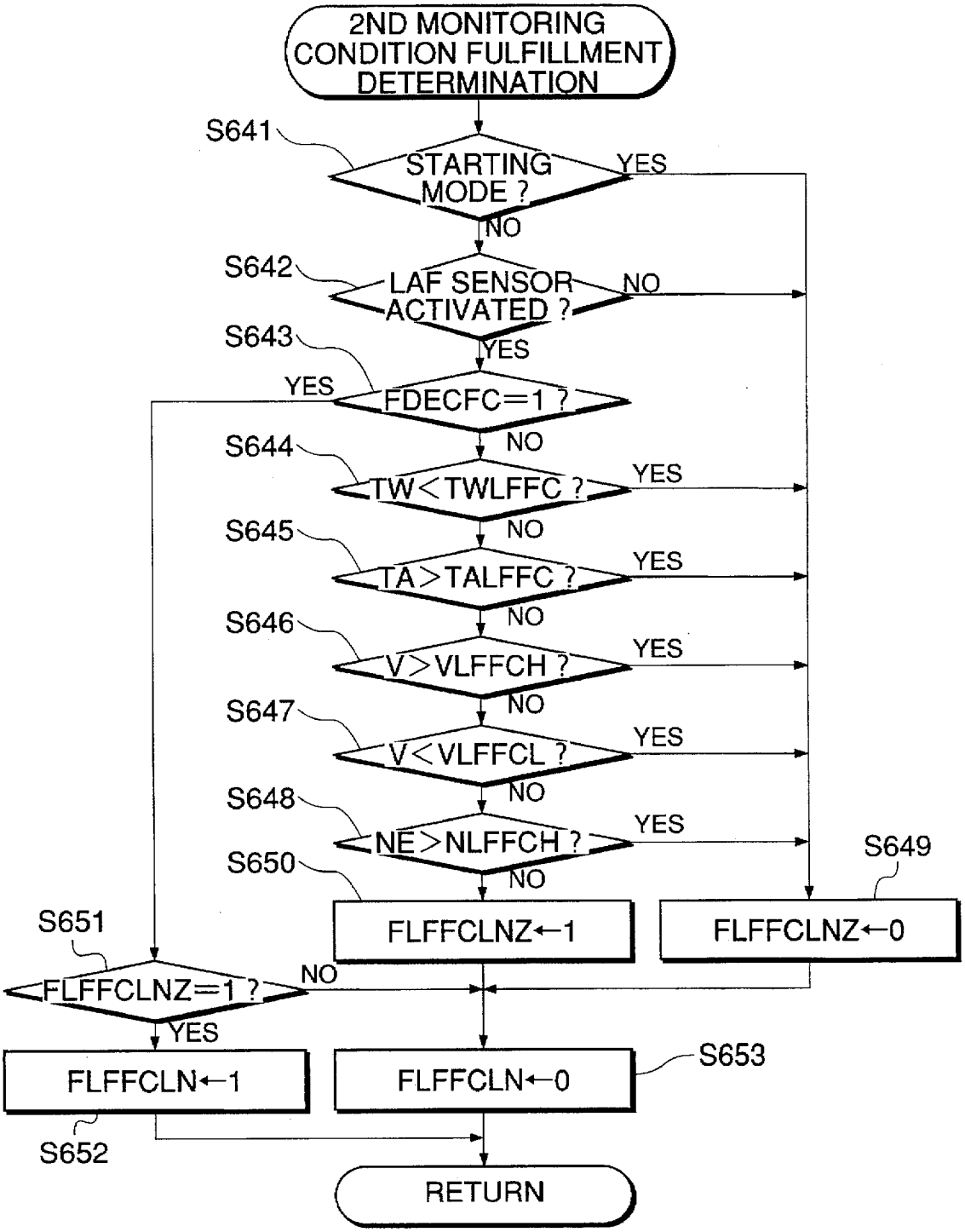
FIG. 44 is a flowchart showing a background routine for determining whether or not conditions for determining the lean output deterioration of the LAF sensor (second monitoring conditions) are fulfilled.

FIG. 44 shows the aforementioned subroutine for determining whether the second monitoring conditions, i.e. the conditions for executing the lean output deterioration determination are fulfilled. This routine is executed as background processing similarly to the FIG. 41 routine.

First, at a step S641, it is determined whether or not the engine is in the starting mode. If the engine is in the starting mode, a lean region flag FLFFCLNZ, which, when set to "1", indicates that the engine and the vehicle (vehicle speed V) are in a predetermined lean control region, is set to "0" at a step S649, and the lean output deterioration determination-enabling flag FLFFCLN is set to "0" at a step S653, followed by terminating the program.

If the engine is not in the starting mode, it is determined at a step S642 whether or not the LAF sensor 17 has been activated. If the LAF sensor 17 has not been activated, the program proceeds to the step S649, whereas if the same has been activated, it is determined at a step S643 whether or not a decelerating fuel-cut flag FDECFC, which, when set to "1", indicates that the engine is in a decelerating fuel-cut condition in which the engine is decelerating and at the same time fuel cut is being carried out, is equal to "1". If FDECFC=0 holds, i.e. if the engine is not in the decelerating fuel-cut condition, it is determined at a step S644 whether or not the engine coolant temperature TW is lower than a predetermined value TWLFFC. If TW≧TWLFFC holds, it is determined at a step S645 whether or not the intake air temperature TA is higher than a predetermined value TALFFC. If TA≦TALFFC holds, it is determined at steps S646 and 647 whether or not the vehicle speed V is within a range defined by predetermined upper and lower limit values VLFFCH and VLFFCL. If VLFFCL≦V≦VLFFCH holds, it is determined at a step S648 whether or not the engine rotational speed NE is higher than a predetermined value NLFFCH.

If any of the answers to the questions of the step S644 to S648 is affirmative (YES), it is judged that the engine is not in the lean control region, and then the program proceeds to the step S649, whereas if all the answers to the questions of the steps S644 to S648 are negative (NO), it is judged that the engine is in the lean control region, so that the lean control region flag FLFFCLNZ is set to "1" at the step S650, and the lean output deterioration determination-enabling flag FLFFCLN is set to "0" at a step S653, thereby inhibiting the lean output deterioration determination.

If FDECFC=1 holds at the step S643 thereafter, which means that the engine is in the decelerating fuel-cut condition, it is determined at a step S651 whether or not the lean control region flag FLFFCLNZ assumes "1". If FLFFCLNZ=0, i.e. if the engine was not in the lean control region immediately before the engine has entered the decelerating fuel-cut condition, the program proceeds to the step S653, thereby inhibiting the lean output deterioration determination, whereas if FLFFCLNZ=1 holds at the step S651, the lean output deterioration determination-enabling flag FLFFCLN is set to "1" at a step S652, thereby permitting the lean output deterioration determination.

As described above, by executing the FIG. 44 subroutine, the lean output deterioration determination is permitted when the engine enters the decelerating fuel-cut condition from the lean control region in which the lean control region flag FLFFCLNZ is set to "1".

Although in the above described embodiment, the sampled value of the sensor output VLAF to be selected is changed to a value sampled at later timing, this is not limitative, but at least one of the feedback control gains KPOBSV, KIOBS and KDOBSV of the equations (24A) to (24C) may changed to a smaller value.

Figure 45:
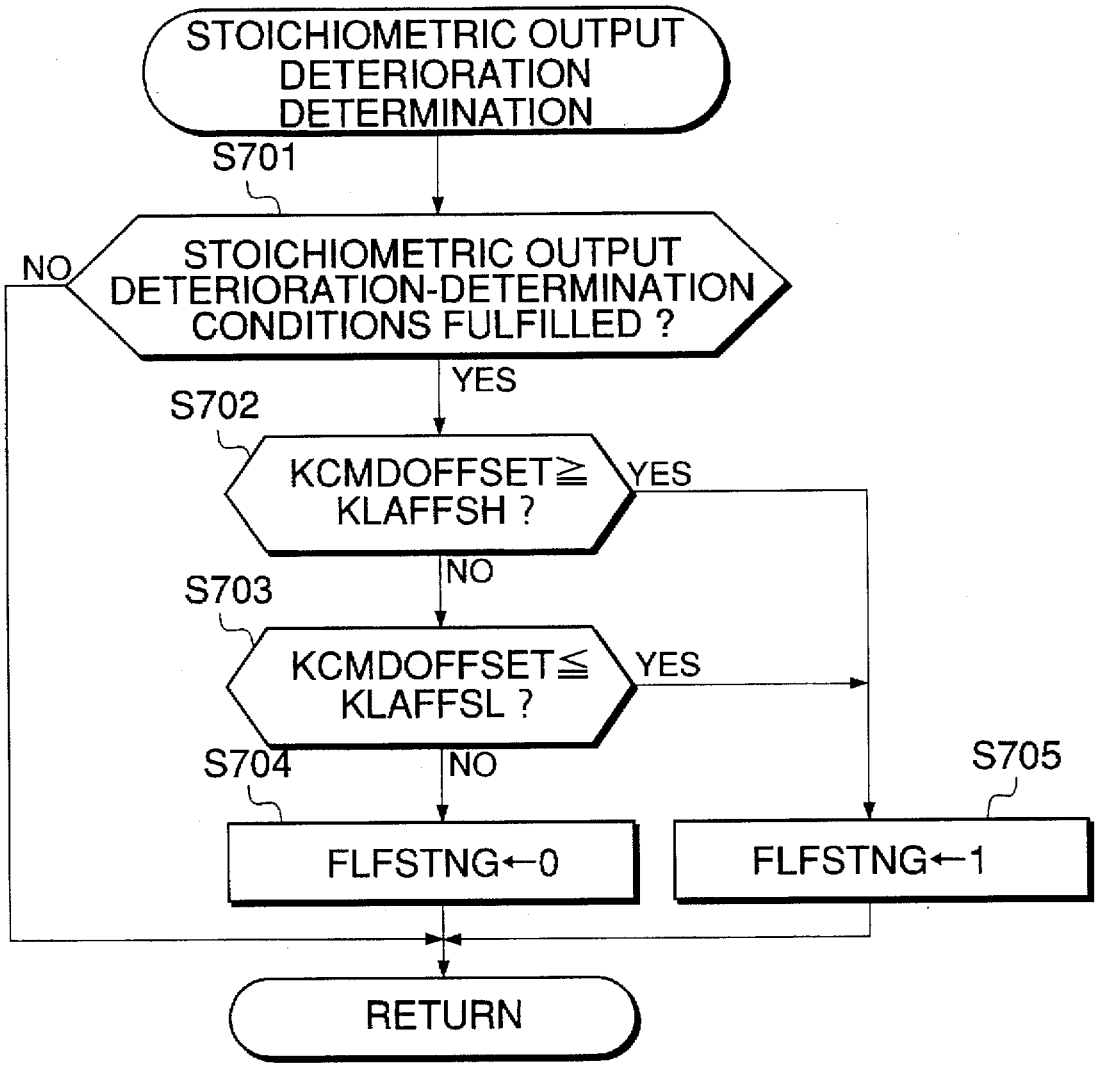
FIG. 45 is a flowchart showing a variation of the subroutine for determining the stoichiometric output deterioration.

Further, the stoichiometric output deterioration may be determined by executing a routine shown in FIG. 45.

At a step S701 in the figure, it is determined whether or not the first monitoring conditions (conditions for executing the stoichiometric output deterioration determination) are fulfilled. If the conditions are not fulfilled, the present program is immediately terminated, whereas if the conditions are fulfilled, it is determined at a step S702 whether or not the addend term KCMDOFFSET calculated in the FIG. 7 subroutine is equal to or larger than a predetermined upper limit value KLAFFSH. If KCMDOFFSET<KLAFFSH holds at the step S702, it is determined at a step S703 whether or not the addend term KCMDOFFSET is equal to or smaller than a predetermined lower limit value KLAFFSL. If KCMDOFFSET≧KLAFFSH or KCMDOFFSET≦KLAFFSL holds, it is judged that the LAF sensor 17 suffers from the stoichiometric output deterioration, and then the stoichiometric output deterioration flag FLFSTNG is set to "1" at a step S705, whereas if the addend term KCMDOFFST is within the range defined by the predetermined upper and lower limit values KLAFFSH and KLAFFSL, it is judged that the LAF sensor 17 does not suffer from the stoichiometric output deterioration, so that the flag FLFSTNG is set to "0" at a step S704.

The addend term KCMDOFFSET is an average value of the correction term DKCMDO2 for correcting the desired equivalent ratio KCMD, which is set according to the O2 sensor output to such a value as to compensate for the influence of the stoichiometric output deterioration of the LAF sensor 18. Therefore, it can be determined that the LAF sensor 18 suffers from the stoichiometric output deterioration when the KCMDOFFSET value falls outside a predetermined allowable range.

Figure 46A:
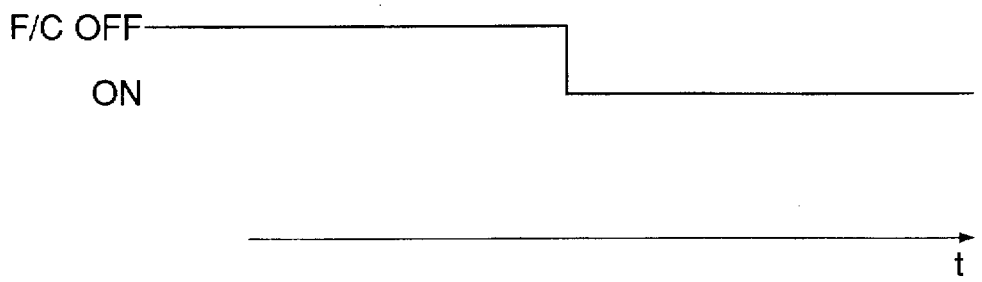
Figure 46B:
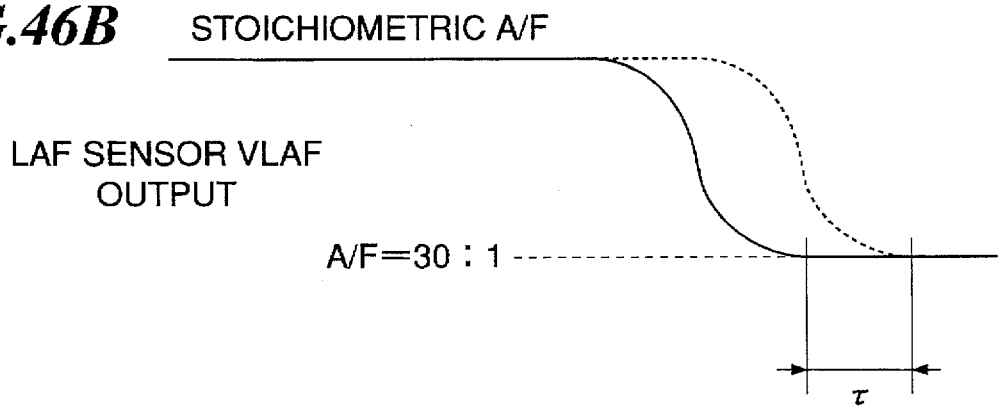

Still further, the response deterioration of the LAF sensor 17 may be determined in the following manner:

Referring to FIGS. 46A and 46B, a detecting time period TDET from the time the fuel-cut is started to the time the LAF sensor output shows an air-fuel ratio A/F of 30 is empirically determined in advance by the use of a LAF sensor functioning normally. The determined detecting time period TDET is set to a reference time TDETREF. In actual operation of the engine, a value of the detecting time period TDET is measured, which is obtained when a change occurs from a condition where the air-fuel ratio is controlled to the stoichiometric air-fuel ratio to a fuel-cut state, and a difference time $\tau$(=TDET−TDETREF) between the measured value of the detecting time period TDET and the reference time period TDETREF is determined. The difference time $\tau$ becomes longer as the response characteristic of the LAF sensor is deteriorated. Therefore, it is determined that the LAF sensor suffers from the response deterioration when the difference time $\tau$ exceeds a predetermined time period.

Next, an air-fuel ratio control system for an internal combustion engine according to a second embodiment of the invention will be described with reference to FIGS. 47 to 59. The whole arrangement of the engine and the air-fuel ratio control system according to the second embodiment is identical with that of FIG. 1, and illustration thereof is therefore omitted. The present embodiment is also applied to a four-cylinder internal combustion engine. Component parts and elements of the engine corresponding to those of the first embodiment are designated by identical reference numerals.

FIG. 47 shows the interior construction of the ECU 5 employed in the air-fuel ratio control system according to the present embodiment.

The ECU 5 is comprised of a microprocessor 62 and input/output ports. The microprocessor 62 has a central processing unit (hereinafter referred to as "the CPU") 64 which executes application programs stored as firmware in a ROM 76 to carry out feedforward control and feedback control of the air-fuel ratio of a mixture supplied to the engine 1, both described in detail hereinafter.

The output signal from the LAF sensor 17 is supplied via the low-pass filter 22 to a first detection circuit 66 which executes a predetermined linearization operation to determine a value of the air-fuel ratio A/F proportional to the concentration of oxygen in exhaust gases over a wide range of air-fuel ratio, and delivers a signal indicative of the determined A/F value to a multiplexer 68. The output signal from the O2 sensor 19 is supplied via the low-pass filter 23 to a second detection circuit 70 which generates a signal indicative of a lean state or a rich state of the mixture with respect to the stoichiometric air-fuel ratio based on the output signal from the O2 sensor 19 having an output characteristic as shown in FIG. 8, and delivers the signal indicative of the lean or rich state of the mixture to the multiplexer 68. Output signals from other sensors referred to hereinbefore are also supplied to the multiplexer 68. The multiplexer 68 changes over channels thereof in synchronism with predetermined timing of changeover to sequentially deliver the signals input thereto to an analog-to-digital converter 72 in a time-shared manner, where they are converted to digital data and stored in predetermined buffer areas of a random access memory (RAM) 74 and/or used in arithmetic operations by the CPU 64. In the present embodiment, the analog-to-digital converter 72 carries out analog-to-digital conversion of the signals from the second detection circuit 70 whenever the crankshaft rotates through a predetermined crank angle (e.g. 15 degrees).

Further, an output signal from the crank angle position sensor 14 is supplied to a waveform-shaping circuit 78 where the output signal is shaped into a rectangular waveform as a binary logic signal. Pulses of the binary logic signal are counted by a counter 80 connected to the waveform-shaping circuit 78 and the count of the counter 80 is stored in a predetermined buffer area of the RAM 74 and/or used in arithmetic operations by the CPU 64.

The microprocessor 62 includes the aforesaid read only memory (ROM) 76 which stores, in addition to the application programs, valve timing maps for selecting between the high-speed valve timing and the low-speed valve timing, and other maps to be retrieved, referred to hereinafter. The CPU 64 executes the application programs by the use of data stored in the RAM 74 and the ROM 76 to determine the optimum fuel injection amount, etc., and based on which it controls the fuel injection valves 12, the auxiliary air amount control valve 7, the EGR control valve 32 of the EGR system 30, and the purge control valve 44 of the evaporative emission control system 40 via driving circuits 82 to 88.

Figure 48:
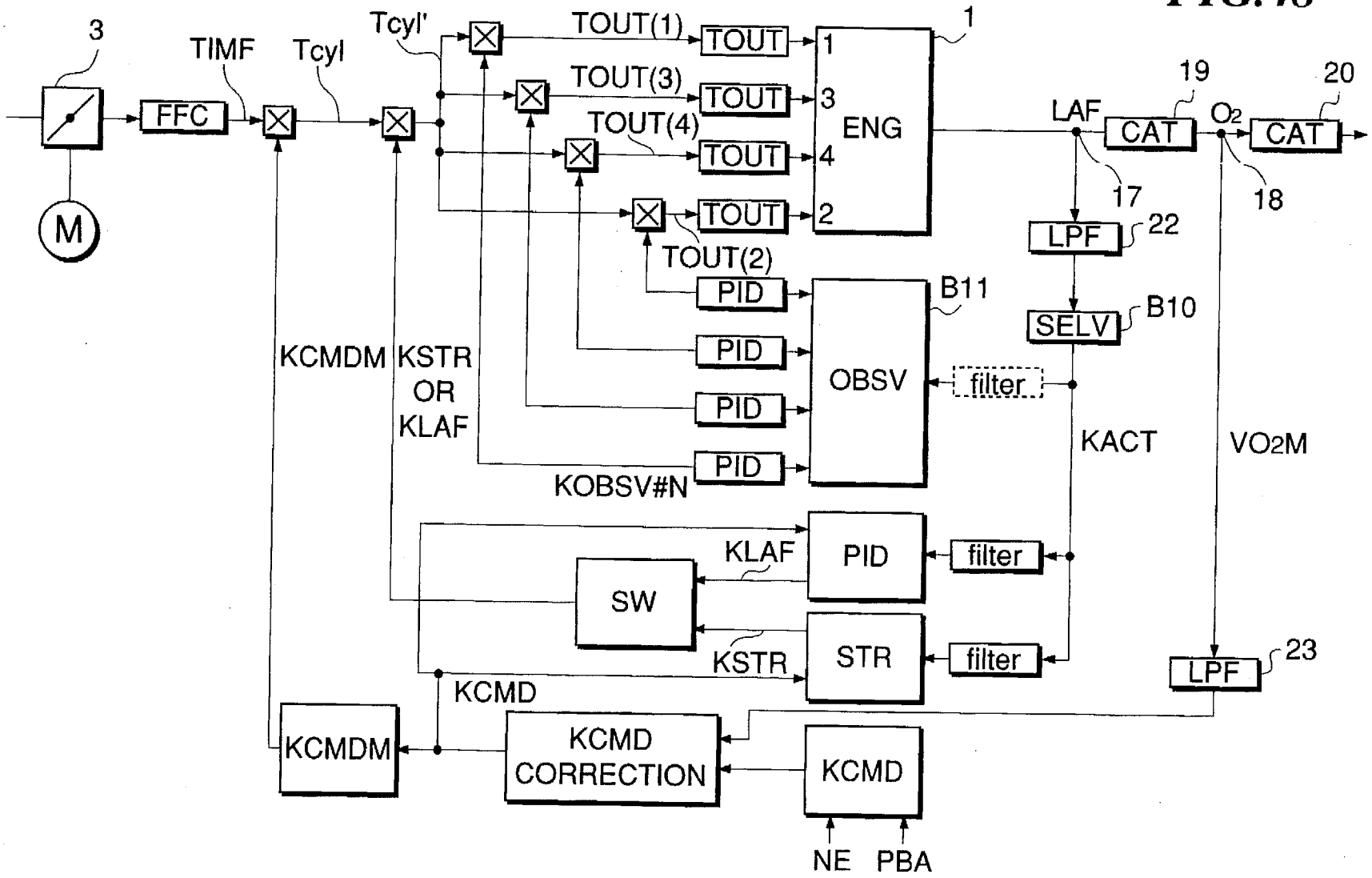
FIG. 48 is a block diagram useful in explaining functions of the air-fuel ratio control system.

FIG. 48 shows the functions of the air-fuel ratio control system according to the second embodiment. The control system includes a feedforward control block for compensating for characteristics of the intake system of the engine 1, and first to third feedback control blocks. The control functions shown in FIG. 48 are exhibited through execution of the application programs.

A main routine for carrying out the air-fuel ratio control according to the present embodiment will now be described with reference to FIG. 49. This main routine is executed in synchronism with generation of each TDC signal pulse.

At a step S1400, the detected values of the engine rotational speed NE, the intake pipe absolute pressure PBA, the throttle valve opening $\theta$TH, the engine coolant temperature TW, etc. from the respective sensors are read into the RAM 74, and at a step S1500, a basic fuel injection amount TIMF is determined by the feedforward control block. At a step S1600, a desired air-fuel ratio coefficient KCMD, a final desired air-fuel ratio correction coefficient KCMDM, etc. are determined by the first feedback control block. At a step S1700, correction coefficients KSTR, KLAF, etc. for adaptive feedback control are determined by the second feedback control block. At a step S1800, a cylinder-by-cylinder PID (air-fuel ratio feedback control) correction coefficient KOBSV#N is determined by the third feedback control block. Finally, at a step S1900, the basic fuel injection amount TIMF is multiplied by the final desired air-fuel ratio correction coefficient KCMDM, the correction coefficients KSTR, KOBSV#N, etc. to obtain a final value of the cylinder-by-cylinder fuel injection amount TOUT(N), to drive the fuel injection valves 12.

Next, the functions of the control blocks will be described. First, the feedforward control block (designated by "FFC" in FIG. 48) is disclosed in Japanese Patent Application No. 6-197238 filed by the assignee of the present application. An outline of the function of the FFC is as follows: A fluid dynamics model (mathematical model) is constructed, which defines all the effective volumes of fluid passages of a portion of the intake system extending from a location immediately downstream of the throttle valve 3 to the intake ports of the cylinders (including the chamber (surge tank) 9, etc.), and the throttle valve opening θTH and the intake pipe absolute pressure PBA are applied to the fluid dynamics model to thereby determine the optimum basic fuel injection amount TIMF applicable to all operating conditions of the engine including not only a steady engine operating condition but also transient engine operating conditions.

Figure 49:
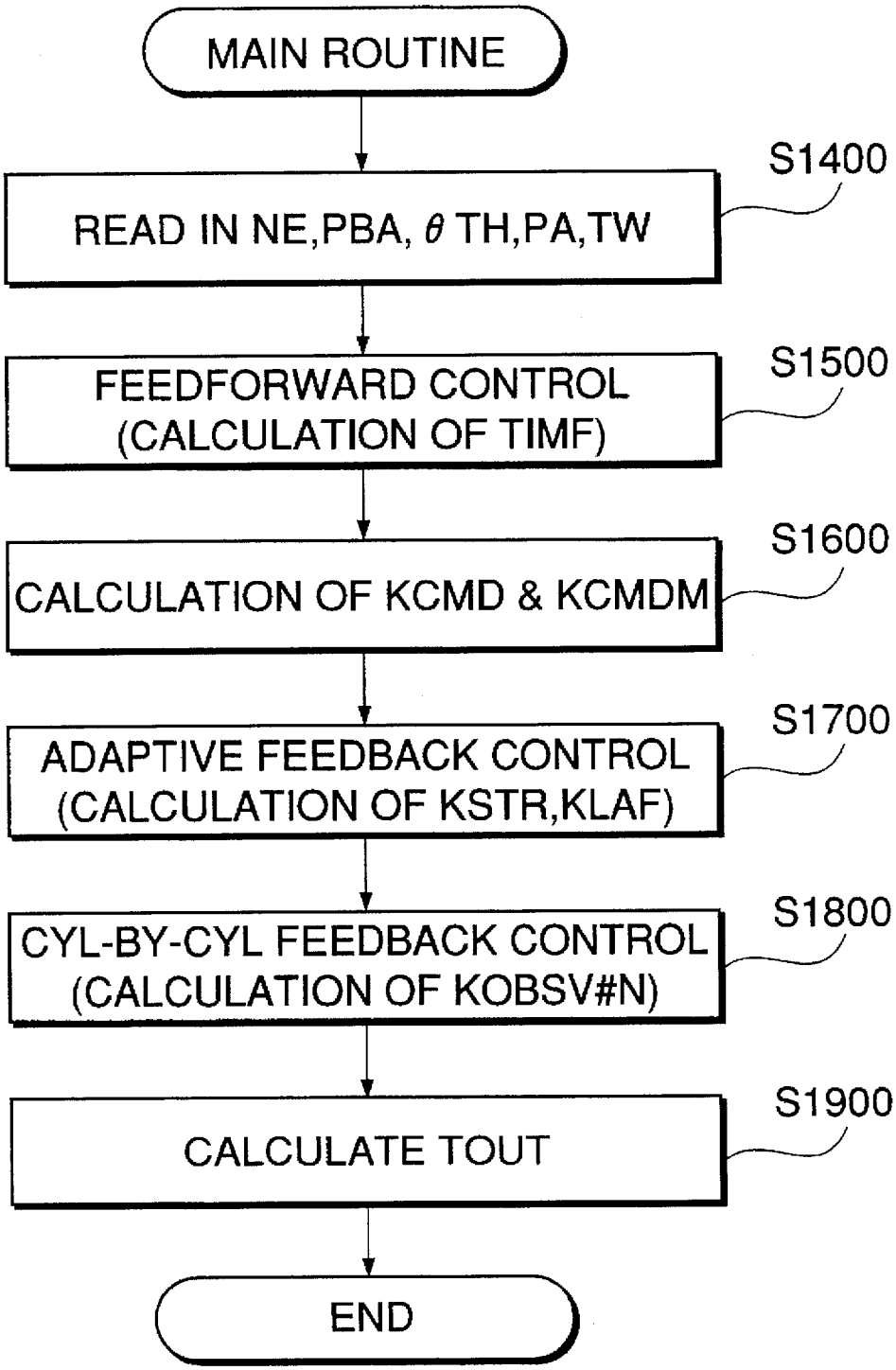
FIG. 49 is a flowchart showing a main routine executed by the air-fuel ratio control system.
Figure 50:
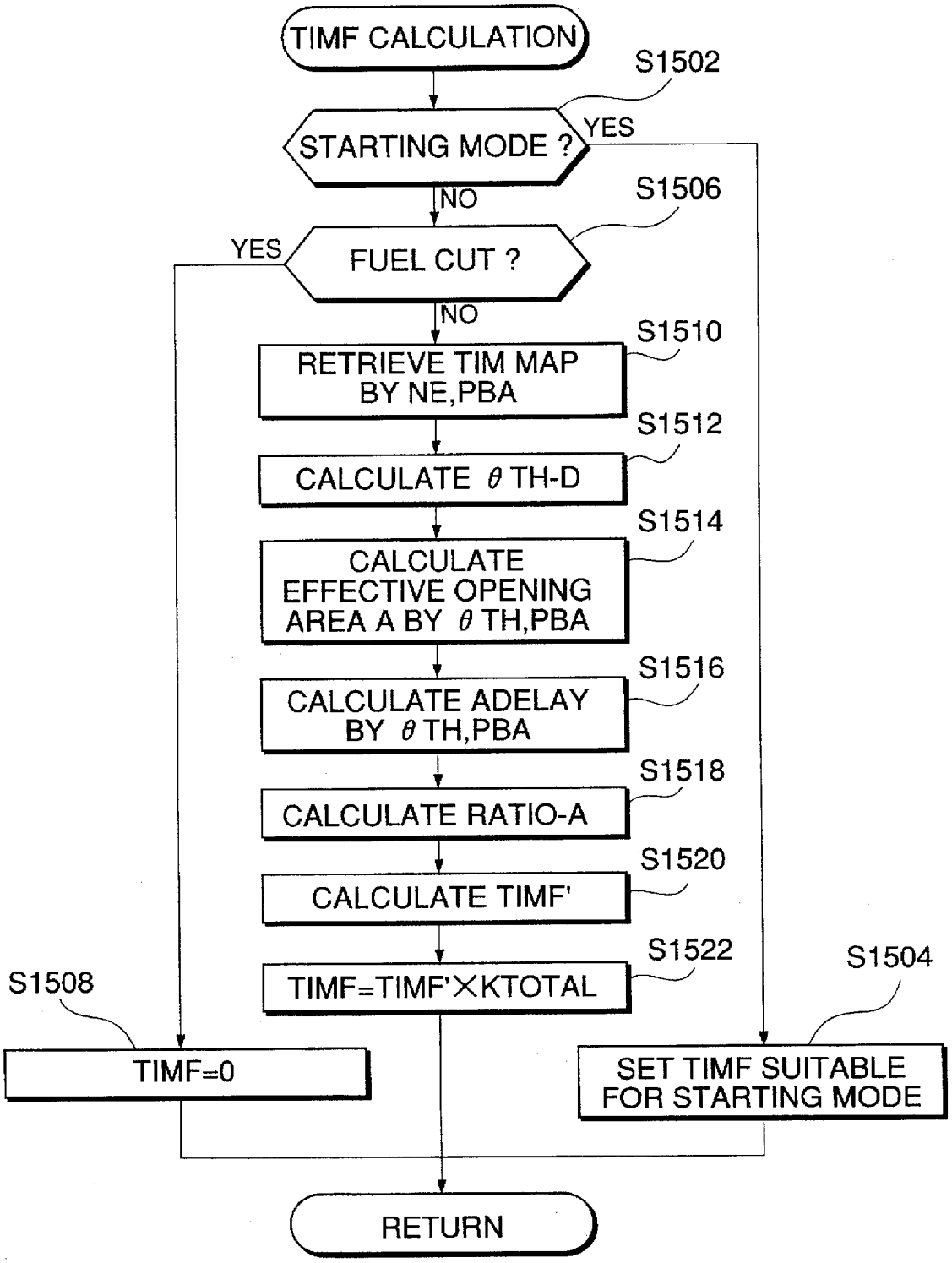
FIG. 50 is a flowchart showing a subroutine for executing a step S1500 of the FIG. 49 routine by a feedforward section.
Figure 51:
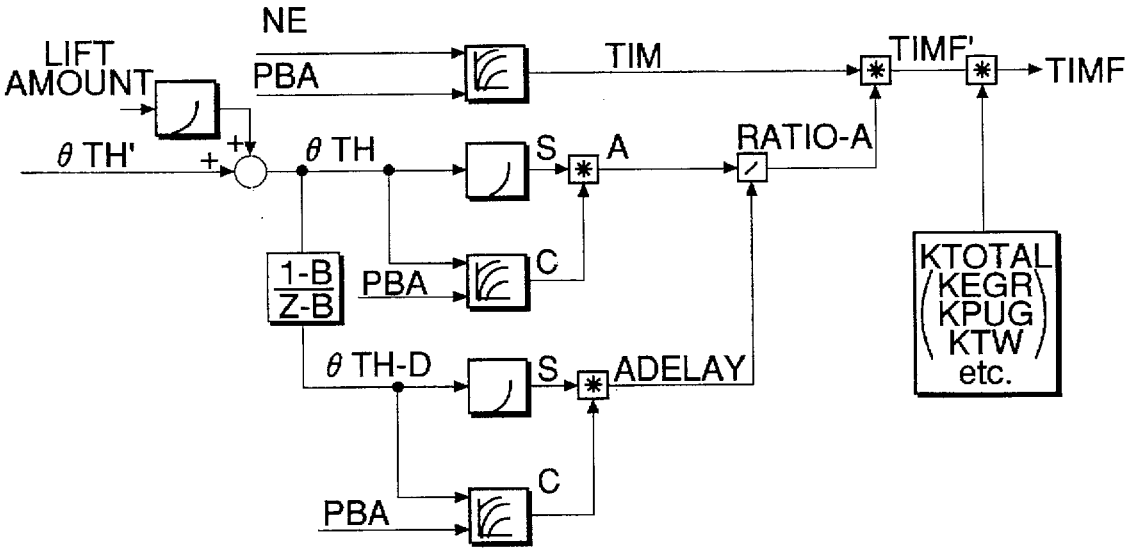
FIG. 51 is a block diagram useful in explaining functions of the feedforward section.
Figure 52:
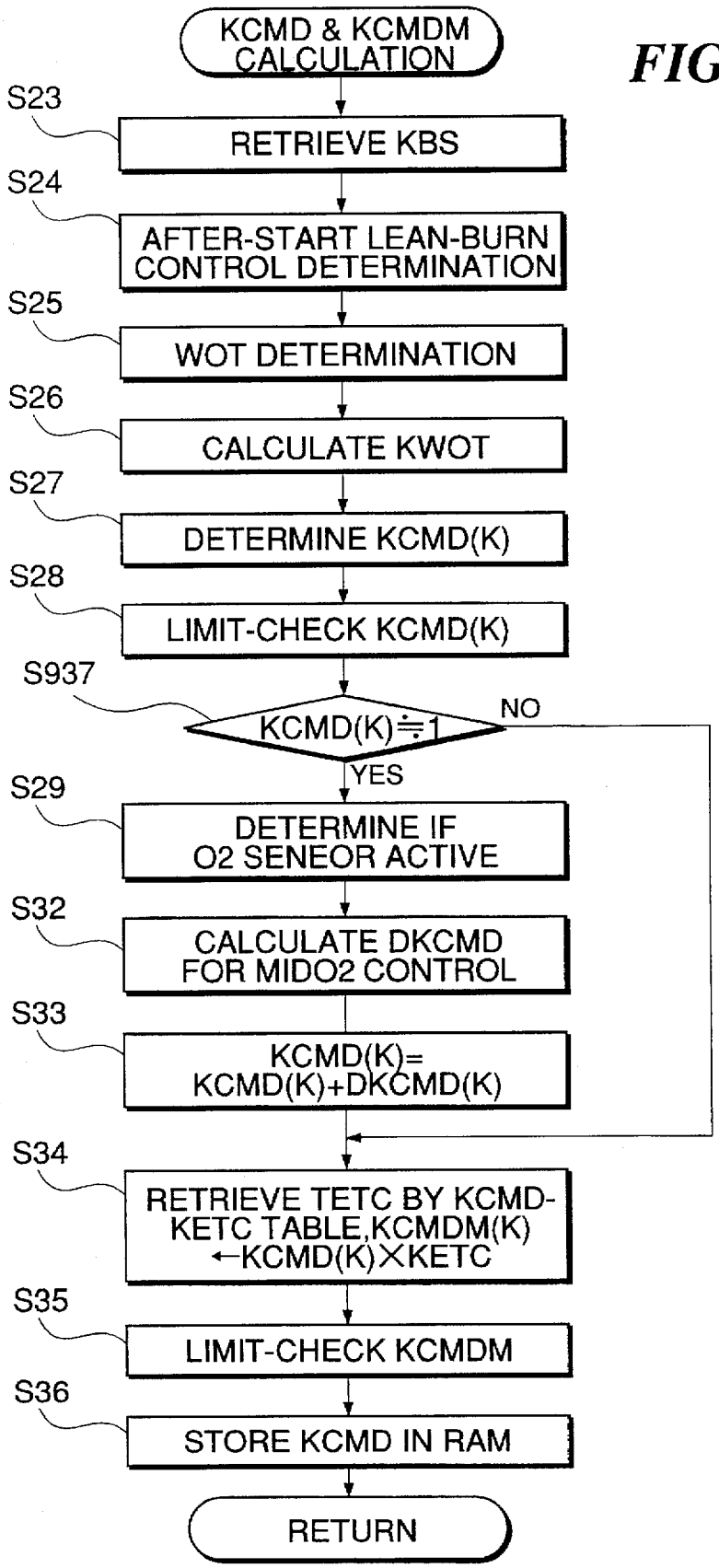
FIG. 52 is a flowchart showing a subroutine for executing a step S1600 of the FIG. 49 routine by a first feedback section.

FIG. 50 shows a subroutine for executing the step S1500 of the FIG. 49 main routine to calculate the basic fuel injection amount TIMF. FIG. 51 is a block diagram which is useful in explaining operations executed by this subroutine.

Referring to FIG. 50, at a step S1502, it is determined whether or not the engine is in the starting mode. If the engine is in the starting mode, a TIMF value suitable for the starting mode is set at a step S1504, whereas if the engine is not in the starting mode, it is determined at a step S1506 whether or not fuel cut is being carried out. If fuel cut is being carried out, a TIMF value (=0) suitable for fuel cut is set at a step S1508, whereas if fuel cut is not being carried out, the program proceeds to steps S1510 et seq. to set a TIMF value suitable for an ordinary or steady operating condition of the engine.

At the step S1510, a fuel injection amount (basic value) TIM for the steady engine operating condition is determined by retrieving a TIM map according to the engine rotational speed NE and the intake pipe absolute pressure PBA. The TIM map has map values of the basic value TIM determined in advance by the speed-density method according to the engine rotational speed NE and the intake pipe absolute pressure PBA.

At a step S1512, the throttle valve opening θTH value is applied to a first-order delay transfer function (1−B)/(Z−B) to calculate a first-order delay value θTH-D of the throttle valve opening θTH. More specifically, when the engine is in a transient operating condition, variation of the throttle valve opening θTH does not directly correspond to the amount of intake air flowing through the intake ports. Therefore, the first-order delay value θTH-D is used as an approximate value of the intake air amount. The symbol B of the transfer function represents a coefficient.

At a step S1514, as shown in FIG. 51, maps stored in the ROM 76 are retrieved to determine a throttle projected area S (area of opening of the throttle valve projected along the longitudinal axis of the intake pipe 2) corresponding to the throttle valve opening θTH, and a correction coefficient C (the product of a flow rate coefficient α and a gas expansion correction coefficient ε corresponding to the throttle valve opening θTH and the intake pipe absolute pressure PBA, and the throttle projected area S is multiplied by the correction coefficient C to calculate the effective opening area A of the throttle valve applicable to the steady operating condition of the engine.

At a step S1516, as shown in FIG. 51, maps stored in the ROM 76 are retrieved to determine a throttle projected area S corresponding to the first-order delay value θTH-D of the throttle valve opening θTH, and a correction coefficient C corresponding to the first-order delay value θTH-D of the throttle valve opening θTH and the intake pipe absolute pressure PBA, and the throttle projected area S is multiplied by the correction coefficient C to calculate the effective opening area ADELAY of the throttle valve applicable to a transient operating condition of the engine.

At a step S1518, a ratio RATIO-A of the effective opening area A of the throttle valve applicable to the steady operating condition of the engine to the effective opening area ADELAY of the throttle valve applicable to the transient operating condition of the engine is calculated by the use of the following equation (31):

$$RATIO\text{-}A=(A+ABYPASS)/(ADELAY+ABYPASS) \quad (31)$$

where ABYPASS represents the sectional area of the auxiliary passage.

At a step S1520, the basic value TIM of the fuel injection amount is multiplied by the ratio RATIO-A to determine a basic fuel injection amount TIMF' suitable for the steady operating condition and the transient operating condition. That is, the ratio RATIO-A assumes a value of 1 in the steady operating condition of the engine, while the same assumes a value other than "1" in the transient operating condition of the engine, so that the basic fuel injection amount TIMF' is applicable to both of the conditions.

At a step S1522, a map stored in the ROM 76 is retrieved according to the engine rotational speed NE, the intake pipe absolute pressure PBA, the intake air temperature TA, the engine coolant temperature TW, concentration PUG of evaporative fuel being purged, an exhaust gas recirculation ratio, etc. to determine a correction coefficient KTOTAL. The basic fuel injection amount TIMF' is multiplied by the correction coefficient KTOTAL to determine the basic fuel injection amount TIMF which has thus been corrected for the influences of the EGR system 30 and the evaporative emission control system 40.

Thus, the feedforward control block determines the optimum value of the basic fuel injection amount TIMF corresponding to the amount of air drawn into the cylinder, based on the throttle valve opening θTH and the intake pipe absolute pressure PBA irrespective of a variation in the amount of air drawn into the cylinder due to a change in the operating condition of the engine.

Next, the first feedback control block will be described. This control block is comprised of function blocks designated by KCMD, KCMD CORRECTION, and KCMDM in FIG. 48, and carries out its operation at the step S1600 of the FIG. 49 main routine according to a subroutine shown in FIG. 52.

This subroutine is similar to the FIG. 5 subroutine of the first embodiment and distinguished therefrom only in that an additional step S937 is inserted between the steps S28 and S29, for determining whether or not the desired air-fuel ratio KCMD(k) is equal to 1.0 or a value close thereto. Therefore, in FIG. 52, steps corresponding to those of the FIG. 5 are designated by identical step numbers, and description thereof is be omitted. If the desired air-fuel ratio KCMD(k) is equal to 1 or a value close thereto, the program proceeds to the step S29, whereas if the desired air-fuel ratio KCMD (k) is not equal to 1 or a value close thereto, it means e.g. that the engine is in the lean-burn condition, so that the program jumps to the step S34.

Thus, the first feedback control block carries out the correction of the basic value KBS for the steady operating condition of the engine based on the output from the O2 sensor 18 to obtain the desired air-fuel ratio coefficient KCMD and the final desired air-fuel ratio correction coefficient KCMDM. The basic fuel injection amount TIMF is multiplied by the final desired air-fuel ratio correction coefficient KCMDM to calculate a required fuel injection amount Tcyl, i.e. an amount of fuel required by each cylinder, which enables the air-fuel ratio to be controlled to the optimum value for the three-way catalysts (catalytic converters).

Next, the second feedback control block will be described. This control block is comprised of an adaptive control device designated by "STR", a PID controller by "PID", and a switching mechanism by "SW", as shown in FIG. 48. The functions of these component elements will be described below, which are realized through execution of predetermined application programs by the CPU 64. Details of the second feedback control block are disclosed in Japanese Patent Application No. 6-340021, and an outline thereof will be briefly described herein.

The desired air-fuel ratio coefficient KCMD may be dull due to delay of response of the engine if the required fuel injection amount Tcyl, which is obtained merely by multiplying the basic fuel injection amount TIMF calculated in the feedforward control block by the final desired air-fuel ratio correction coefficient KCMDM, is applied as it is to fuel injection control. Therefore, the second feedback control block dynamically compensates for the delay of response of the engine 1 in controlling the air-fuel ratio based on the desired air-fuel ratio coefficient KCMD by correcting the required fuel injection amount Tcyl by a feedback correction coefficient KSTR calculated by the use of the adaptive control device STR. Further, the adaptive control device STR has relatively high control responsiveness so that the control stability can lower due to oscillation of the control amount when the desired air-fuel ratio coefficient KCMD undergoes a large variation depending on operating conditions of the engine. To overcome this disadvantage, the required fuel injection amount Tcyl is corrected by the PID correction coefficient KLAF obtained by the PID controller PID. The switching mechanism SW is provided to switch between the correction coefficients KSTR and KLAF depending on operating conditions of the engine. Further, changeover of the feedback control coefficients which are determined by different control methods and hence different from each Other results in a sudden change in the operation amount, causing instability of the control amount, and hence lowered stability of the fuel injection control. To avoid such inconvenience, the switching mechanism SW is adapted to make smooth changeover of the coefficients to prevent a discontinuity in the operation amount upon changeover of the feedback coefficients.

First, the PID controller PID dynamically corrects the desired air-fuel ratio coefficient KCMD based on the air-fuel ratio (hereinafter referred to as "the actual air-fuel ratio KACT") estimated at the confluent portion of the exhaust system by a sampling block (designated by "SELV" in FIG. 48). The sampling block SELV has a function of calculating the actual air-fuel ratio KACT based on the output signal from the LAF sensor 17. The actual air-fuel ratio KACT is used in the third feedback control block as well to perform predetermined feedback control. Details of the sampling block SELV will be described in relation to the third feedback control block.

First, the PID controller PID calculates a difference DKAF between the desired air-fuel ratio coefficient KCMD and the actual air-fuel ratio KACT by the use of the following equation (32):

$$DKAF(k)=KCMD(k-d')-KACT(k) \tag{32}$$

where the symbol d' represents an ineffective time period before the KCMD value reflects on the KACT value. Therefore, KCMD(k–d') represents a value of the desired air-fuel ratio KCMD assumed earlier by a control period corresponding to the ineffective time period than the present loop or control cycle. KACT(k) represents a value of the actual air-fuel ratio obtained in the present loop or control cycle. Throughout the specification, the air-fuel ratio is actually expressed in terms of the equivalent ratio, i.e. Mst/M=1/λ (Mst represents the stoichiometric air-fuel ratio, M a ratio A/F of the consumption amount of air and the consumption amount of fuel, and A an excess air ratio).

Then, the difference DKAF(k) is multiplied by predetermined coefficients to obtain a P term KLAFP(k), an I term KLAFI(k), and a D term KLAFD(k) by the use of the following equations (26A), (26B), and (26C), respectively:

$$KLAFP(k)=DKAF(k)\times KP \tag{26A}$$

$$KLAFI(k)=DKAF(k)\times KI+KLAFI(k-1) \tag{26B}$$

$$KLAFD(k)=(DKAF(k)-DKAF(k-1))\times KD \tag{26C}$$

Thus, the P term is obtained by multiplying the control difference DKAF(k) by a proportional gain KP, the I term by adding the product of the control difference and an integral gain KI to the immediately preceding value KLAF(k–1) of the PID correction coefficient, and the D term by multiplying the difference between the present value DKAF(k) and the immediately preceding value DKAF(k–1) of the control difference. The gains KP, KI and KD are determined by retrieving respective maps according to the engine rotational speed NE and the intake pipe absolute pressure PBA. Further, the present value KLAF(k) of the PID correction coefficient KLAF based on the PID control method is calculated by the PID controller PID by adding an offset value of 1.0 to the sum of the above terms by the use of the equation (27):

$$KLAF(k)=KLAFP(k)+KLAFI(k)+KLAFD(k)+1.0 \tag{27}$$

Next, the function of the adaptive controller STR will be described with reference to FIG. 53. The adaptive controller STR is comprised of a STR controller and a parameter adjusting mechanism. The STR controller is supplied with the desired air-fuel ratio coefficient KCMD(k) from the first feedback control block and the actual air-fuel ratio KACT(k) from the sampling block (SELV) as well as a coefficient vector identified by a parameter adjustment law (mechanism) proposed by Landau et al. to carry out adaptive digital signal processing to calculate a feedback correction coefficient KSTR(k). In other words, the feedback correction coefficient KSTR(k) is calculated by a recurrence formula.

According to this method, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real". This method is known and described e.g. in "Computrole" No. 27, CORONA PUBLISHING CO., LTD., Japan, pp. 28–41, "Automatic control handbook" OHM, LTD., Japan, pp. 703–707, "A Survey of Model Reference Adaptive Techniques—Theory and Application" I. D. LANDAU "Automatica" Vol. 10, pp. 353–379, 1974, "Unification of Discrete Time Explicit Model Reference Adaptive Control Designs", I. D. LANDAU et al. "Automatica" Vol. 17, No. 4, pp. 593–611, 1981, and "Combining Model Reference Adaptive Controllers and Stochastic Self-tuning Regulators", I. D. LANDAU, "Automatica" Vol. 18, No. 1., pp. 77–84, 1992.

Now, the adaptive control technique using the parameter adjustment law by Landau et al. will be described. According to this adjustment law, if polynomials of the denominator and numerator of the transfer function $A(Z^{-1})/B(Z^{-1})$ of the object of control by a discrete system are expressed by the following equations (33A) and (33B), the adaptive parameter $\hat{\theta}(k)$ and the input '(k) to the adaptive parameter adjusting mechanism are defined by the following equations (33C) and (33D). The equations (33A) to (33D) define an example of a plant in which m=1, n=1 and d=3 hold, i.e. a system of the first order thereof has an ineffective time as long as three control cycles. The symbol k used herein represents the same as defined before.

$$A(z^{-1}) = 1 + a1z^{-1} + \ldots + Anz^{-n} \tag{33A}$$

$$B(z^{-1}) = b0 + b1z^{-1} + \ldots + Bmz^{-m} \tag{33B}$$

$$\begin{aligned}\hat{\theta}^T(k) &= [\hat{b}0(k), \hat{B}_R(Z^{-1}, k), \hat{S}(Z^{-1}, k)] \\ &= [\hat{b}0(k), \hat{r}1(k), \ldots r_{m+d-1}(k), S0(k), \ldots, S_{n-1}(k)] \\ &= [b0(k), r1(k), r2(k), r3(k), s0(k)]\end{aligned} \tag{33C}$$

$$\begin{aligned}\zeta^T(k) &= [u(k), \ldots, u(k-m-d+1), y(k), \\ &\quad \ldots, y(k-n+1)] \\ &= [u(k), u(k-1), u(k-2), u(k-3), y(k)]\end{aligned} \tag{33D}$$

The adaptive parameter $\hat{\theta}(k)$ is expressed by the following equation (34):

$$\hat{\theta}(k)=\hat{\theta}(k-1)+\Gamma(k-1)'(k-d)e^*(k) \tag{34}$$

where the symbols F (k) and the asterisked e represent a gain matrix and an identification error signal, respectively, and can be expressed by the following recurrence formulas (35) and (36):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \tag{35}$$

$$e^*(k) = \frac{D(z^{-1})y(k) - \hat{\theta}^T(k-1)\zeta_s(k-d)}{1+\zeta^T(k-d)\Gamma(k-1)\zeta(k-d)} \tag{36}$$

Further, it is possible to provide various specific algorithms depending upon set values of λ1(k) and λ2(k). For example, if λ1(k)=1 and λ2(k)=λ(0<λ1<2), a progressively decreasing gain algorithm is provided (if λ=1, the least square method); if λ1(k)=λ1(0<λ1<1) and λ2(k)=λ2 (0<λ2<λ), a variable gain algorithm (if λ2=1, the method of weighted least squares); and if λ1(k)/λ2(k)=λ and if λ3 is expressed by the following equation (37), λ1(k)=λ3 provides a fixed trace algorithm. Further, if λ1(k)=1 and λ2(k) =0, a fixed gain algorithm is obtained. In this case, as is clear from the equation (35), Γ(k)=Γ(k−1), and hence Γ(k)=Γ (fixed value) is obtained.

$$\lambda_3(k) = 1 - \frac{\|\Gamma(k-1)\zeta(k-d)\|^2}{\sigma+\zeta^T(k-d)\Gamma(k-1)\zeta(k-d)} \cdot \frac{1}{tr\Gamma(0)} \tag{37}$$

Figure 53:
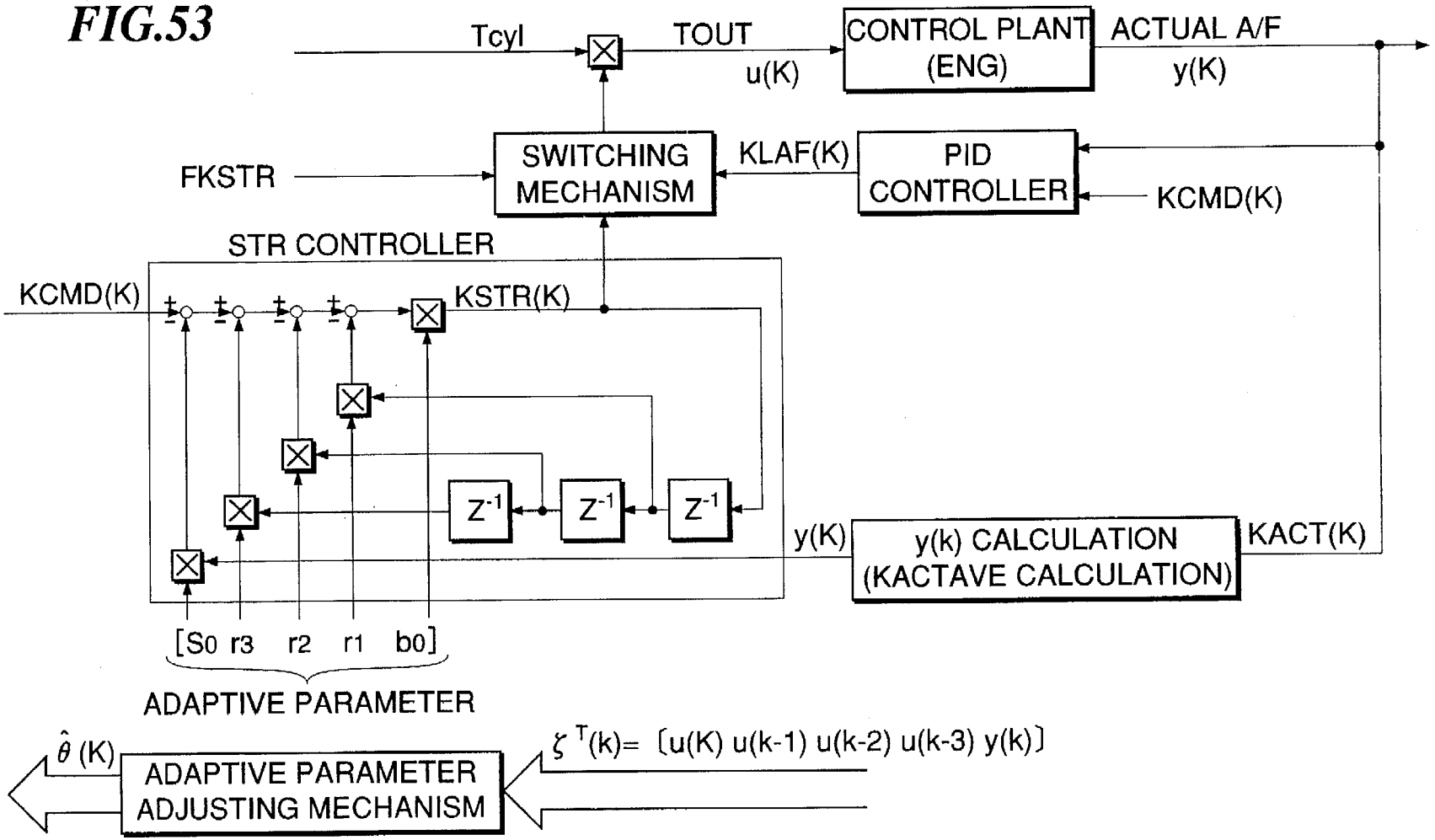
FIG. 53 is a block diagram which is useful in explaining functions of a second feedback section

In the example of FIG. 53, the STR controller (adaptive controller) and the adaptive parameter-adjusting mechanism are arranged outside the fuel injection amount-calculating system, and operate to calculate the feedback correction coefficient KSTR(k) such that the actual air-fuel ratio KACT (k) becomes equal to the desired air-fuel ratio coefficient KCMD(k−d') (d' represents the above-mentioned ineffective time period before the KCMD value reflects on the actual air-fuel ratio KACT) in an adaptive manner. That is, the STR controller forms a feedback compensator which is supplied with the coefficient vector $\hat{\theta}(k)$ adaptively identified by the adaptive parameter-adjusting mechanism and operates to make the actual air-fuel ratio KCACT(k) equal to the desired air-fuel ratio coefficient KCMD(k−d').

In this manner, the feedback correction coefficient KSTR (k) and the actual air-fuel ratio KACT(k) are determined, which are input to the adaptive parameter-adjusting mechanism, where the adaptive parameter $\hat{\theta}(k)$ is calculated and the calculated $\hat{\theta}(k)$ value is input to the STR controller. The STR controller is also supplied with the desired air-fuel ratio coefficient KCMD(k) and calculates the feedback correction coefficient KSTR(k) by the use of the following recurrence formula (38) such that the actual air-fuel ratio KACT(k) becomes equal to the desired air-fuel ratio coefficient KCMD(k):

$$KSTR(k) = \{KCMD(k-d') - s0 \times y(k) - r1 \times KSTR(k-1) - r2 \times KSTR(k-2) - r3 \times KSTR(k-3)\}/b0 \tag{38}$$

The calculated feedback correction coefficient KSTR(k) is supplied via the switching mechanism SW to a multiplier, where the required fuel injection amount Tcyl is multiplied by the coefficient KSTR(k). The corrected required fuel injection amount Tcyl' is further corrected by the cylinder-by-cylinder air-fuel ratio correction coefficient KOBSV#N obtained in the third feedback control block to provide the cylinder-by-cylinder fuel injection amount TOUT(N).

The switching mechanism SW carries out switching operation in response to a predetermined changeover flag FKSTR, such that when the engine is in an operating condition in which the desired air-fuel ratio coefficient KCMD largely changes, the PID correction coefficient KLAF(k) is selected and the required fuel injection amount Tcyl is multiplied by the selected coefficient KLAF(k), whereas when the engine is an operating condition in which the same does not largely change, the feedback correction coefficient KSTR(k) is selected and the required fuel injection amount Tcyl is multiplied by the selected coefficient KSTR(k). That is, the required fuel injection amount Tcyl is corrected by the feedback correction coefficient KSTR or the PID correction coefficient KLAF.

Next, the third feedback control block will be described. This control block basically operates to calculate the cylinder-by-cylinder air-fuel ratio KACT#N by applying the observer (designated by OBSV B11 in FIG. 48) to the air-fuel ratio at the confluent portion of the exhaust system which is estimated by the sampling block (SELV), i.e. the actual air-fuel ratio KACT, and further calculate the cylinder-by-cylinder air-fuel ratio correction coefficient KOBSV#N by the PID control (executed by blocks each designated by PID in FIG. 48) from the cylinder-by-cylinder air-fuel ratio KACT#N. The suffix #N represents the cylinder number. The fuel injection amount Tcyl' is multiplied by the cylinder-by-cylinder correction coefficient KOBSV#N to set the final fuel injection amount TOUT(N) which can equalize the cylinder-by-cylinder air-fuel ratio between the cylinders, to thereby improve the exhaust gas-purifying efficiency of the three-way catalysts 19, 20. Thus, the third feedback control block compensates for variations in air-fuel ratio between the cylinders in a feedback manner.

The sampling block SELV and the observer B11 were described in detail with respect to the first embodiment, and detailed description thereof is therefore omitted.

Figure 26:
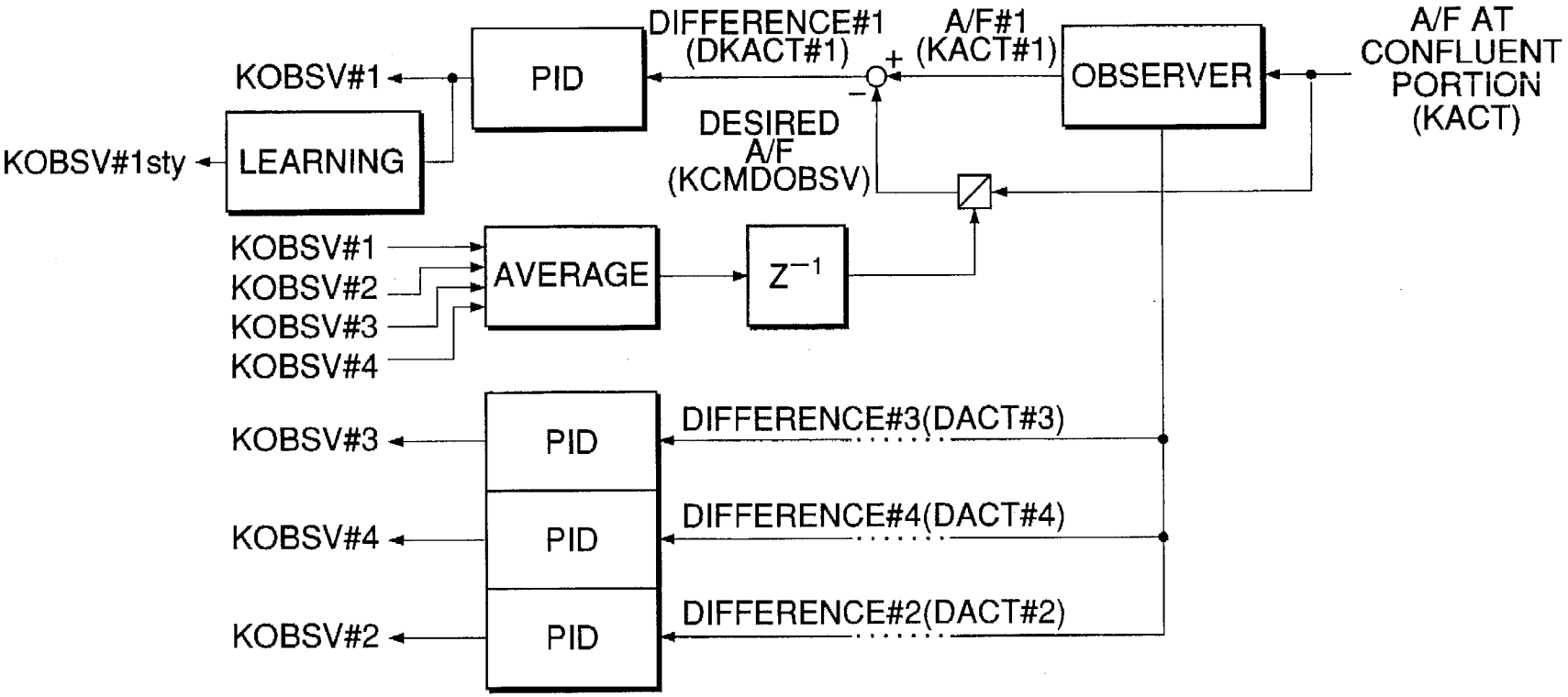
FIG. 26 is a block diagram useful in explaining how the air-fuel ratio feedback control is carried out cylinder by cylinder.
Figure 54:
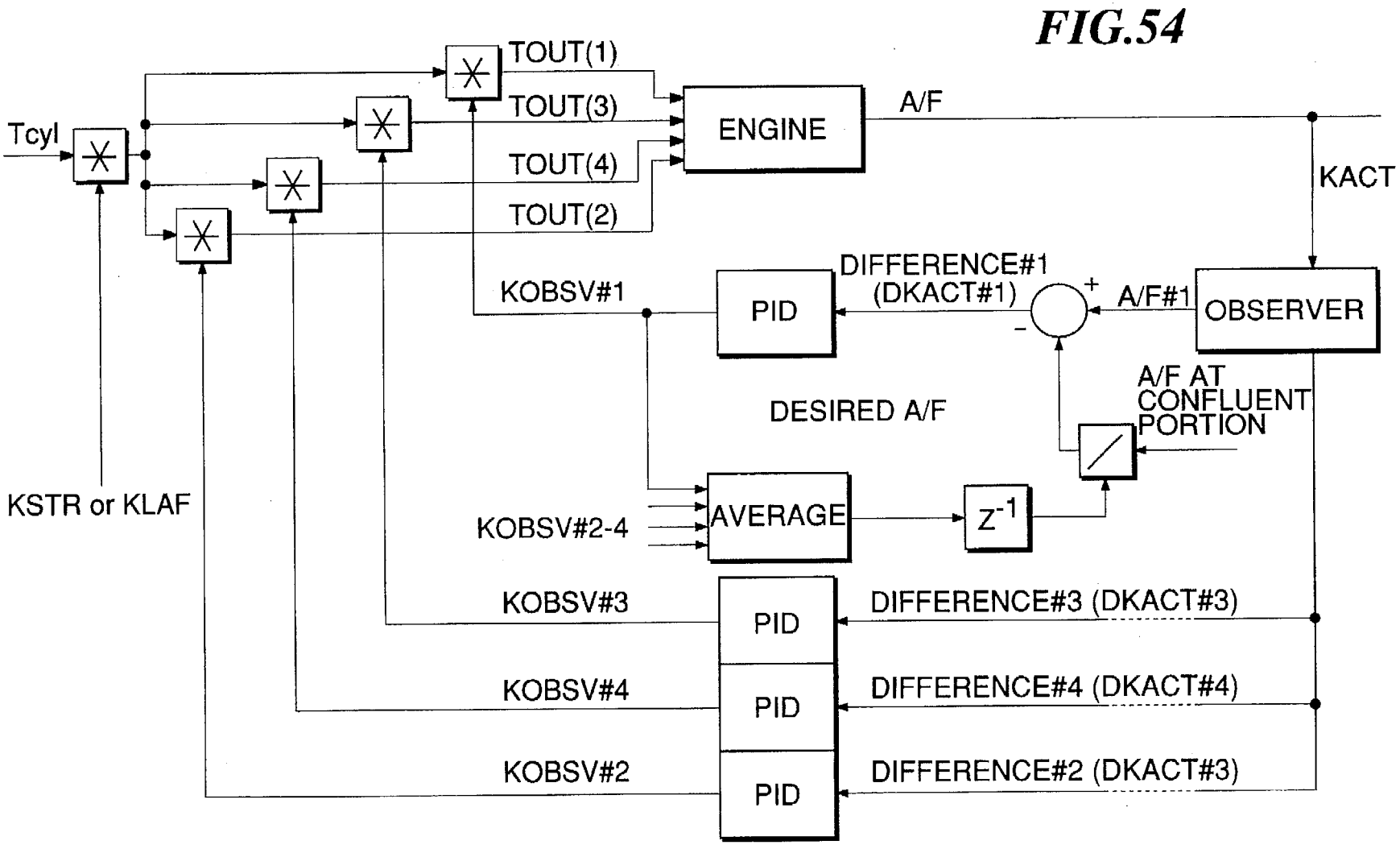
FIG. 54 is a block diagram useful in explaining functions of a third feedback section (cylinder-by-cylinder feedback section)

In the present embodiment, the cylinder-by-cylinder correction coefficient KOBSV#N is calculated in the following manner:

First, a desired value KCMDOBSV(k) is calculated in the same manner as set forth in the description of the first embodiment, with reference to FIG. 54 which substantially corresponds to FIG. 26 of the first embodiment in respect of elements explicitly shown therein.

The cylinder-by-cylinder correction coefficient KOBSV#N is calculated by the use of the following equations (39A) to (39F) in the following manner: The difference DKACT#N(m) between the cylinder-by-cylinder actual air-fuel ratio KACT#N(m) and the desired value KCMDOBSV is calculated cylinder by cylinder, and at the same time the difference DDKACT#N (twice differentiated value) between the present value DKACT#N(m) of the difference and the immediately preceding value DKACT#N(m−1) of the same is calculated. Further, the results of these calculations are applied to calculations of a KP term, a KI term and a KD term of the PID control for each cylinder #N, and finally the KP term, KI term and KD term are applied in calculating the cylinder-by-cylinder correction coefficient KOBSV#N. The symbol m represents that the parameter with (m) has the present or newest one of values calculated every 4 TDC signal pulses. That is, the cylinder-by-cylinder correction coefficient KOBSV#N for the same cylinder is calculated every 4 TDC signal pulses. In the following equations (39A) to (39F), a KPOBSV term, a KIOBSV term and a KDOBSV term which are basic gains are set to respective different values depending on operating conditions of the engine, that is, between when the engine is idling and when the engine is in an operating condition other than idling. Maps for these values is stored in the ROM 76 for retrieval according to operating conditions of the engine.

$$DKACT\#N=KACT\#N-KCMDOBSV(m) \quad (39A)$$

$$DDKACT\#N=DKACT\#N(m)-DKACT\#N(m-1) \quad (39B)$$

$$KP\#N(m)=KPOBSV-DKACT\#N(m) \quad (39C)$$

$$KI\#N(m)=KIOBSV-DKACT\#N(m)+KI(m-1) \quad (39D)$$

$$KD\#N(m)=KDOBSV-DDKACT\#N(m) \quad (39E)$$

$$KOBSV\#N(m)=KP\#N(m)+KI\#N(m)+KD\#N(m)+1.0 \quad (39F)$$

By calculating the cylinder-by cylinder correction coefficient KOBSV#N as above, it is possible to converge the cylinder-by-cylinder air-fuel ratio to the air-fuel ratio at the confluent portion of the exhaust system, as well as converge the air-fuel ratio at the confluent portion to the desired air-fuel ratio, so that the air-fuel ratios of mixtures supplied to all the cylinders are converged to the desired air-fuel ratio. The cylinder-by-cylinder fuel injection amount TOUT(N) is calculated by the use of the following equation (40):

$$TOUT(N)=Tcyl'\times KOBSV\#N \quad (40)$$

Next, details of the operations of the sampling block SELV, the observer, and the third feedback control block will be described with reference to FIG. 55.

First, the operation of the sampling block SELV to determine the actual air-fuel ratio KACT at the confluent portion of the exhaust system will be described with reference to FIG. 55. Actually, this operation is executed at the step S1400 of the FIG. 49 routine in advance, whereby the steps S1700 and S1800 can be executed by using the actual air-fuel ratio KACT and the estimated value A/F#N.

Figure 55:
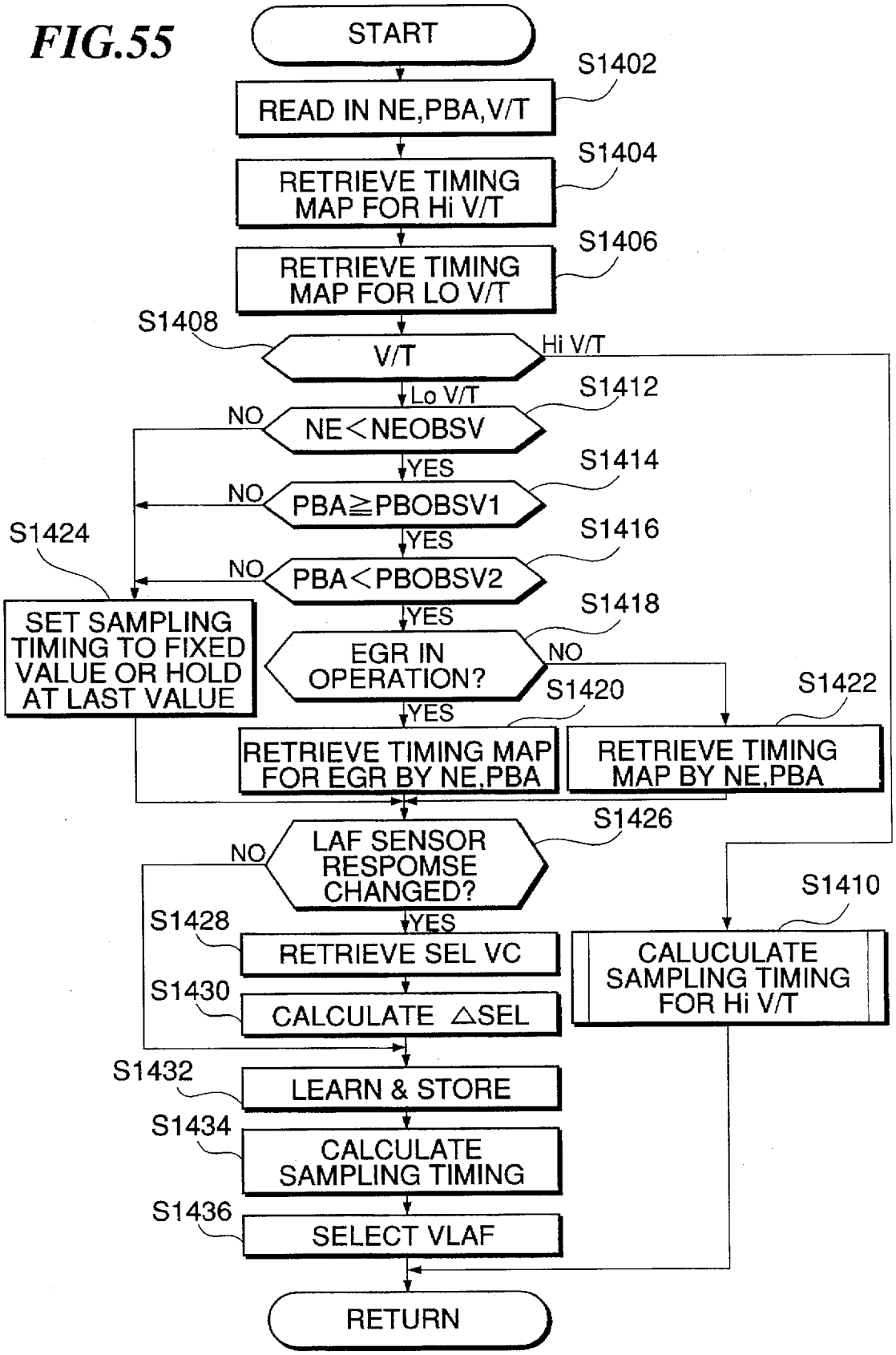
FIG. 55 is a flowchart showing a subroutine for sampling an output from the LAF sensor (actual air-fuel ratio), which is executed by a sampling block (SELV)

Referring to FIG. 55, at a step S1402, the detected values of the engine rotational speed NE, the intake pipe absolute pressure PBA, and the valve timing V/T are read in, and then at steps S1404 and S1406, maps of the high-speed valve timing HiV/T and the low-speed valve timing LoV/T are retrieved, respectively.

Next, at a step S1408, it is determined which of the high-speed valve timing HiV/T and the low-speed valve timing LoV/T is currently selected. If the high-speed valve timing HiV/T is currently selected, the program proceeds to a step S1410, while if the low-speed valve timing LoV/T is currently selected, the program proceeds to a step S1412. The operation in the case of the low-speed valve timing LoV/T being selected and the one in the case of the high-speed valve timing HiV/T being selected are identical in principle with each other, and hence description will be made only of the operation in the case of the low-speed valve timing LoV/T being selected.

At the step S1412, it is determined whether or not the engine rotational speed NE is lower than a predetermined upper limit value NEOBSV (e.g. 3500 rpm). If NE<NEOBSV holds, the program proceeds to steps S1414 and S1416, wherein it is determined whether or not the intake pipe absolute pressure PBA is within a predetermined range defined by a predetermined upper limit value PBOBSV1 (e.g. 660 mmHg) and a predetermined lower limit value PBOBSV2 (e.g. 160 mmHg). If the answers to the questions of the steps S1414 and S1416 are both affirmative (YES), the program proceeds to a step S1418, wherein it is determined whether or not the EGR system 30 is operating. If the EGR system 30 is operating, the program proceeds to a step S1420, wherein a predetermined timing map is retrieved according to the engine rotational speed NE and the intake pipe absolute pressure PBA to determine sampling timing SELVBSC for the HiV/T and EGR-operative condition. On the other hand, if the EGR system is not operating, the program proceeds to a step S1422, wherein a predetermined timing map is retrieved in a similar manner to determine sampling timing SELVBSC for the HiV/T and EGR-inoperative condition. From the step S1420 or 1422, the program proceeds to a step S1426.

If any of the answers to the questions of the steps S1412 to S1416 is negative (NO), the program proceeds to a step S1424, wherein the sampling timing SELVBSC is set to and held at a predetermined value, followed by the program proceeding to the step S1426. Instead of the predetermined value, the sampling timing SELVBSC may be held at the immediately preceding sampling timing.

At the step S1426, it is determined whether or not the LAF sensor 17 is deteriorated. The determination of deterioration of the LAF sensor is carried out e.g. by determining whether or not the response deterioration determination flag FLFRPNG, which is set by the FIG. 40 subroutine of the first embodiment when the response deterioration of the LAF sensor is detected, assumes "1".

Figure 57:
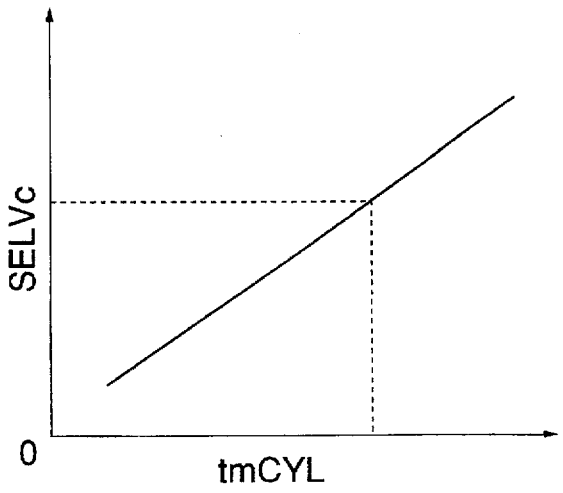
FIG. 57 shows a SELVc map used in determining a degree of the response deterioration of the LAF sensor.

If the LAF sensor 17 suffers from the response deterioration at the step S1426, the program proceeds to a step S1428, wherein an SELVc table is retrieved to determine a characteristic value SELVc which indicates a degree of the response deterioration of the LAF sensor 17. FIG. 57 schematically shows the characteristic value SELVc in relation to the aforementioned repetition period of inversion tmCYCL of the output VLAF from the LAF sensor calculated in the FIG. 40 subroutine. That is, the characteristic value SELVc is determined by the SELVc table according to the repetition period of inversion tmCYCL of the output VLAF from the LAF sensor 17 exhibited when the air-fuel ratio of the mixture supplied to the engine is controlled to the stoichiometric air-fuel ratio.

However, the type of deterioration of the LAF sensor to be checked here is not limited to the response deterioration determined based on the repetition period of inversion tmCYCL of the LAF sensor output VLAF, but the result of the determination of the lean output deterioration of the LAF sensor described above may be utilized. In this case, the repetition period of inversion tmCYCL in FIG. 57 is replaced by the difference (VLAF–IPFC) between a value VLAF of the LAF sensor output actually detected by the lean output deterioration determination and a reference value IPFC obtained in advance from an output from a normally-functioning LAF sensor.

Figure 58:
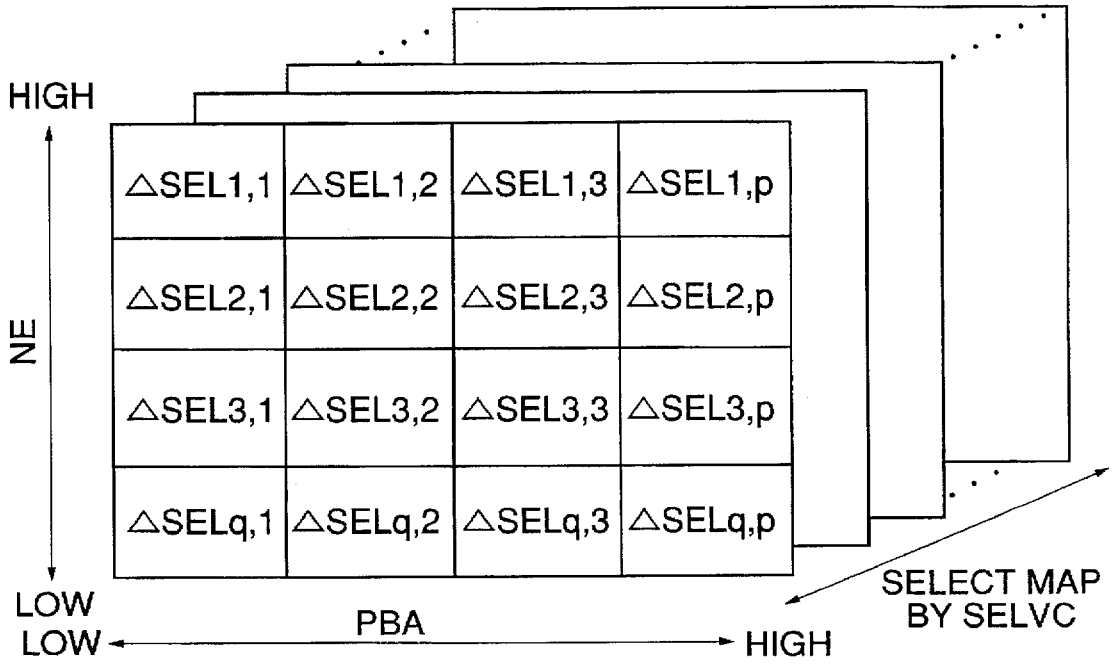
FIG. 58 shows a Δ SEL map used in determining a correction amount Δ SEL for correcting the timing of sampling the output from the LAF sensor.

Then, at the following step S1430, a ΔSEL map is retrieved to determine a correction amount ΔSEL for correcting the sampling timing SELVBSC determined at any of the steps S1420, S1422, and S1424. FIG. 58 schematically shows the ΔSEL map stored in the ROM 76, in which there are provided a set of maps corresponding to respective predetermined values of the characteristic value SELVc, each map containing map values set according to the engine rotational speed NE and the intake pipe absolute pressure PBA.

More specifically, for each predetermined value of the characteristic value SELVc, there are provided a plurality of correction amounts ΔSEL1,1 to ΔSEL1q,p experimentally determined and corresponding to predetermined values of the engine rotational speed NE and predetermined values of the intake pipe absolute pressure PBA.

At the step S1430, one of the maps of the ΔSEL map is selected according to the characteristic value SELVc determined at the step S1428, and a value of correction amount ΔSEL is read from the selected map according to the engine rotational speed NE and the intake pipe absolute pressure PBA. This makes it possible to quickly determine a ΔSEL value corresponding to the degree of deterioration of the LAF sensor 17 according to operating conditions of the engine. Values of the correction amount ΔSEL in the maps are calculated in advance by the use of the following equation (41):

$$\Delta SEL(k)=(CSEL/256)\times\Delta SEL(k-1)+[1-(CSEL/256)]\times\Delta SEL(k) \quad (41)$$

where CSEL represents an averaging coefficient.

At a step S1432, the present value of the correction amount ΔSEL is learned. For example, a weighted average value of an m number of values ΔSEL(k-m–1) to ΔSEL(k–1) of the correction amount obtained in the past and the present value ΔSEL(k) of the correction amount is calculated and stored in a nonvolatile memory, such as an E2PROM.

Then, at a step S1434, the correction amount Δ SEL is added to the sampling timing SELVBSC(k) to calculate corrected sampling timing SELVF by the use of the following equation (42):

$$SELVF=SELVBSC(k)+\Delta SEL(k) \quad (42)$$

At a step S1436, the sampling block SELV samples the output from the LAF sensor 17 at the corrected sampling timing SELVF, whereby the air-fuel ratio at the confluent portion of the exhaust system, i.e. the actual equivalent ratio KACT can be determined with accuracy.

If it is determined at the step S1426 that the LAF sensor does not suffer from the deterioration, the correction amount ΔSEL is set to 0, and then the program jumps to the step S1432 to learn the correction amount ΔSEL and store the resulting average value.

At the step S1410, the operation in the case of the high-speed valve timing HiV/T being selected is carried out. In this operation, data of a SELVc table and a ΔSEL map may be stored in advance for determining a ΔSEL value for executing steps for the high-speed valve timing HiV/T corresponding to the steps S1426 to S1432. Alternatively, the data of the FIG. 57 SELVc table and the FIG. 58 ΔSEL map may be commonly used for the HiV/T and the LoV/T.

Figure 59:
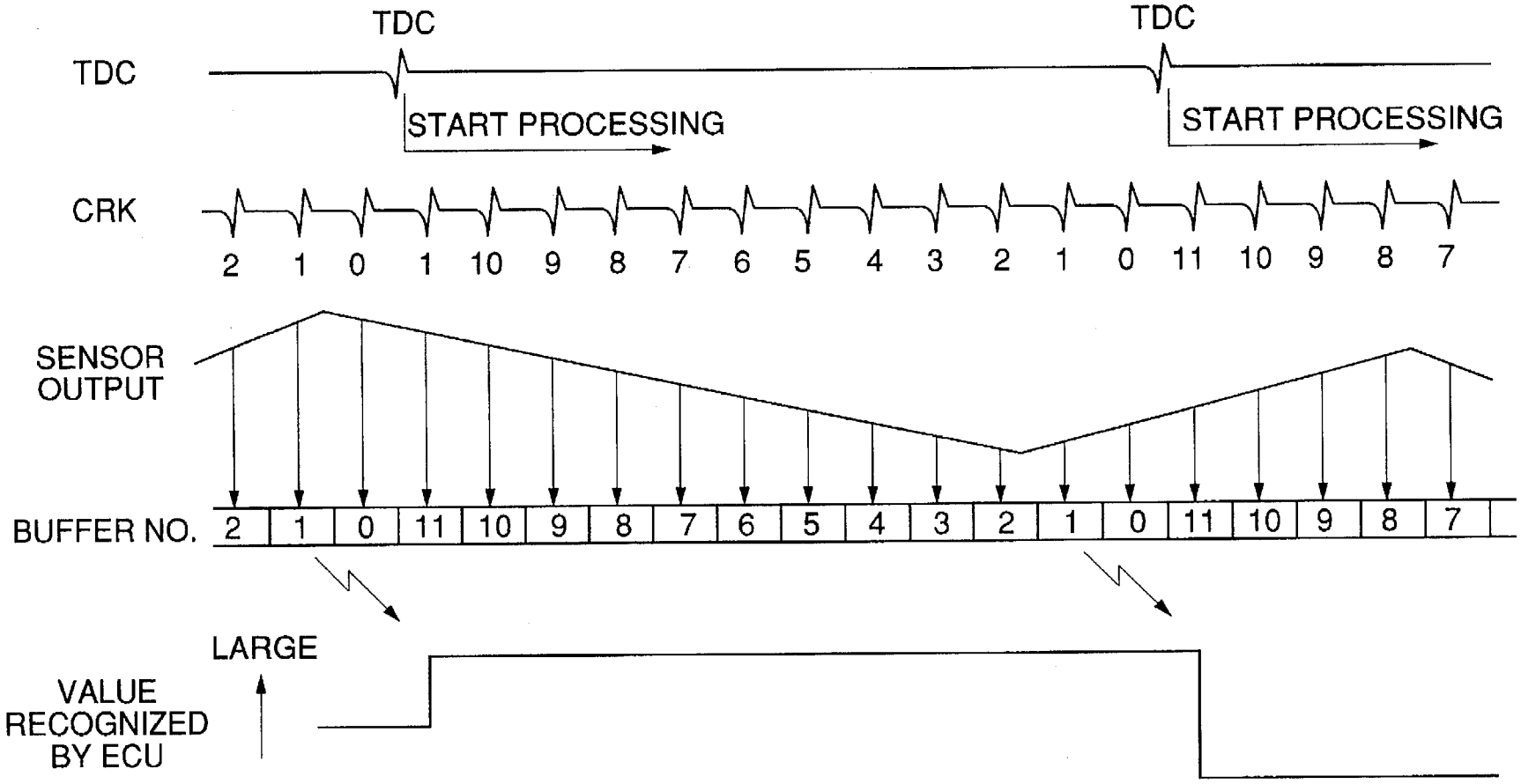
FIG. 59 is a flowchart showing a timing chart useful in explaining sampling operation of the sampling block SELV.

The steps S1402 to S1436 are executed as operations of the sampling block SELV. Therefore, as shown in the bottom of FIG. 59, the CPU 64 can accurately recognize maximal values and minimal values of the output from the LAF sensor 17. Accordingly, the observer OBSV can estimate the cylinder-by-cylinder air-fuel ratio A/F#N based on the LAF sensor output selected by the sampling block SELV with accuracy in a manner following up the behavior of the actual equivalent ratio KACT at the confluent portion of the exhaust system. This improves the reliability of the cylinder-by-cylinder air-fuel ratio feedback control. Further, the second feedback control block can determine the PID correction coefficient KLAF by the PID feedback control and the feedback correction coefficient KSTR by the adaptive control based on the actual equivalent ratio KACT thus detected, which further improves the reliability of the air-fuel ratio control.

Further, the correction amount ΔSEL is learned, and the corrected sampling timing SELVF is determined by the use of the learned value of the correction amount ΔSEL, which makes it possible to set the sampling timing for selecting a LAF sensor output value sampled at the optimum timing in a manner following up variation or deterioration in the characteristic of the LAF sensor 17.

Still further, data of the correction amount Δ SEL currently determined is stored in the non-volatile memory for use in the next cycle, which makes it possible to read the stored data of the correction amount ΔSEL for calculating the sampling timing SELVF when the engine is started again after the ignition key was once turned off to stop the engine. Since the engine is thus not required to wait for calculation of the correction amount ΔSEL, it is possible to quickly start the air-fuel ratio control in a manner coping with variation or deterioration of the characteristic of the LAF sensor, and hence improve the efficiency of purifying exhaust gases.

When a battery installed on the vehicle is replaced, the correction amount ΔSEL is set to 0 so that a new value of the correction amount ΔSEL is calculated starting from 0. This is to overcome the inconvenience of a change in the output characteristic of the LAF sensor 17 caused by a change in the output voltage of the battery.

The determination of deterioration of the LAF sensor 17 is carried out by one of the methods described hereinbefore with respect to the first embodiment. Detailed description thereof is therefore is omitted here.

Figure 56:
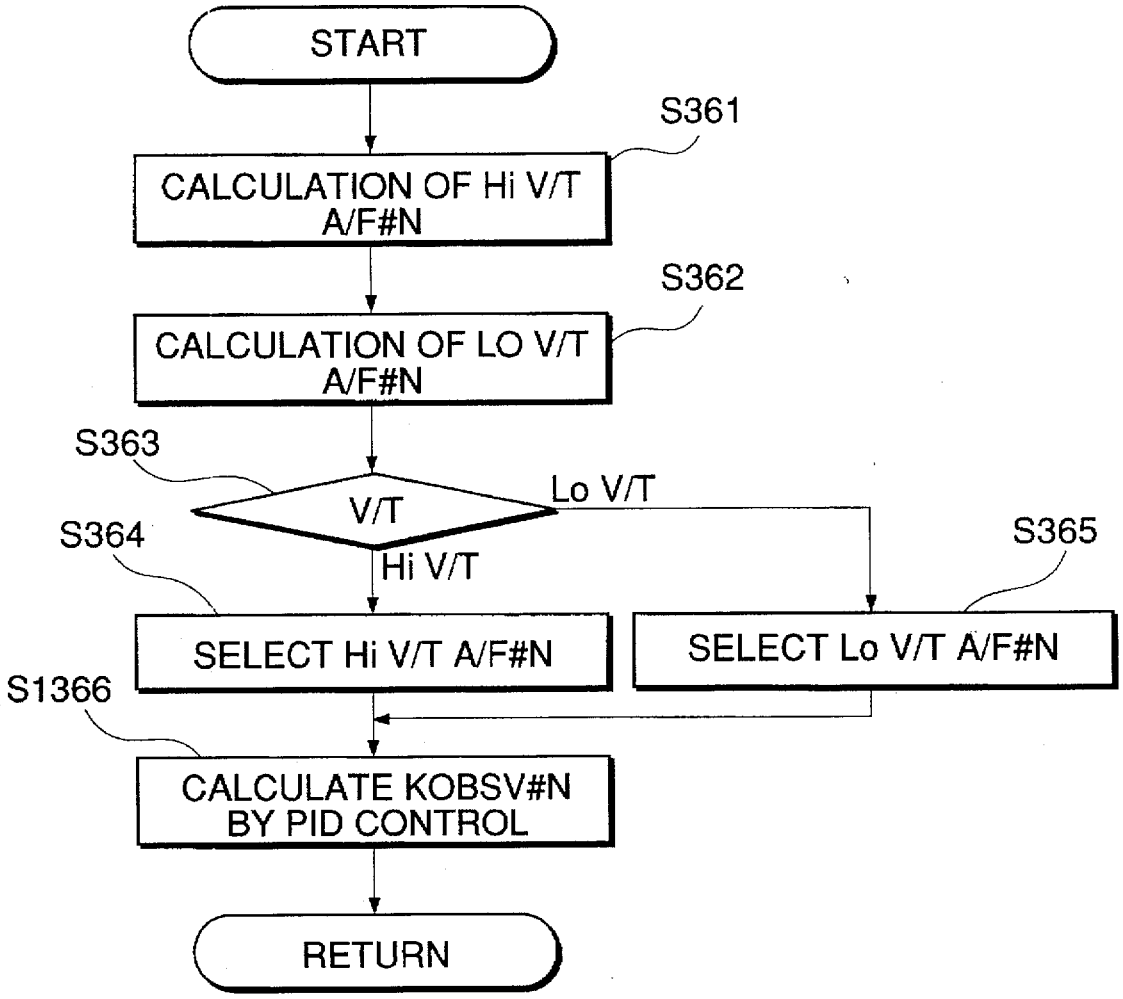
FIG. 56 is a flowchart showing a subroutine for executing a step S1800 of the FIG. 48 routine by the third feedback section.

A subroutine for executing the step S1800 of the FIG. 48 routine to effect the cylinder-by-cylinder air-fuel ratio feedback control will now be described with reference to FIG. 56.

This subroutine is identical with the FIG. 28 subroutine of the first embodiment (steps S361 to S365), except for the addition of a step S1366, wherein the cylinder-by-cylinder correction coefficient KOBSV#N is calculated by the use of the cylinder-by-cylinder air-fuel ratio A/F#N by the PID control.

As described heretofore, according to the present embodiment, the cylinder-by-cylinder air-fuel ratio feedback control can be effected with accuracy, since the air-fuel ratio at the confluent portion of the exhaust system can be determined at sampling timing coping with variation or deterioration in the characteristic of the LAF sensor 17.

What is claimed is:

1. An air-fuel ratio control system for an internal combustion engine having a plurality of cylinders, and an exhaust passage connected to said plurality of cylinders, comprising:

air-fuel ratio-detecting means arranged in said exhaust passage, for detecting an air-fuel ratio of exhaust gases emitted from said cylinders;

sampling means for sampling an output from said air-fuel ratio-detecting means whenever said engine rotates through a predetermined crank angle, and for sequentially storing sampled values of said output from said air-fuel ratio-detecting means;

output characteristic-detecting means for detecting an output characteristic of said air-fuel ratio-detecting means;

selecting means for selecting one of said sampled values of said output from said air-fuel ratio-detecting means at least depending on said output characteristic of said air-fuel ratio-detecting means detected by said output characteristic-detecting means;

cylinder-by-cylinder air-fuel ratio-estimating means for estimating an air-fuel ratio of a mixture supplied to each of said cylinders, separately from other ones of said cylinders, based on selected ones of said sampled values of said output from said air-fuel ratio-detecting means and a model representative of a behavior of said exhaust passage; and cylinder-by-cylinder feedback control means for controlling said air-fuel ratio of said mixture supplied to said each of said cylinders in a feedback manner responsive to the estimated air-fuel ratio of said mixture such that the estimated air-fuel ratio of said mixture supplied to said each of said cylinders is converged to a desired air-fuel ratio.

2. An air-fuel ratio control system according to claim 1, including operating condition-detecting means for detecting operating conditions of said engine, and wherein said selecting means selects said one of said sampled values depending on said operating conditions of said engine detected by said operating condition-detecting means.

3. An air-fuel ratio control system according to claim 2, wherein said output characteristic-detecting means detects a response characteristic of said air-fuel ratio-detecting means as said output characteristic thereof, said selecting means selecting, as said one of said sampled values, a sampled value which was sampled at a later timing as a degree of deterioration of said response characteristic of said air-fuel ratio-detecting means increases.

4. An air-fuel ratio control system according to claim 2, wherein said selecting means includes timing-determining means for determining a timing for selecting said one of said sampled values sampled and stored, and timing correction amount-calculating means for calculating a timing correction amount for changing said timing depending on said output characteristic of said air-fuel ratio-detecting means.

5. An air-fuel ratio control system according to claim 4, wherein said output characteristic-detecting means detects a response characteristic of said air-fuel ratio-detecting means, said timing correction amount-calculating means calculating said timing correction amount such that said timing is changed to a later timing as a degree of deterioration of said response characteristic of said air-fuel ratio-detecting means increases.

6. An air-fuel ratio control system according to claim 4, including learned value-calculating means for calculating a learned value of said timing correction amount, storing means for storing said learned value of said timing correction amount, and timing-correcting means for correcting said timing by the stored learned value of said timing correction amount.

7. An air-fuel ratio control system according to claim 1, wherein said output characteristic-detecting means detects, as said output characteristic of said air-fuel ratio-detecting means, deterioration of a response characteristic of said air-fuel ratio-detecting means, based on a repetition period of inversion of said air-fuel ratio with respect to a stoichiometric air-fuel ratio detected by said air-fuel ratio-detecting means, which is obtained when said air-fuel ratio detected by said air-fuel ratio-detecting means is feedback-controlled to said stoichiometric air-fuel ratio.

8. An air-fuel ratio control system according to claim 1, wherein said output characteristic-detecting means detects, as said output characteristic of said air-fuel ratio-detecting means, deterioration of a response characteristic of said air-fuel ratio-detecting means, based on a time period elapsed from a time point of interruption of fuel supply to said engine to a time point at which said air-fuel ratio detected by said air-fuel ratio-detecting means becomes equal to a predetermined value.

9. An air-fuel ratio control system according to claim 1, wherein said cylinder-by-cylinder air-fuel ratio-estimating means includes observer means for observing an internal operative state of said exhaust passage by means of said model representative of said behavior of said exhaust passage, and for estimating said air-fuel ratio of said mixture supplied to said each of said cylinders, based on said output from said air-fuel ratio-detecting means.

10. In an air-fuel ratio control system for an internal combustion engine having a plurality of cylinders, and an exhaust passage connected to said plurality of cylinders, said air-fuel ratio control system including air-fuel ratio-detecting means arranged in said exhaust passage, for detecting an air-fuel ratio of exhaust gases emitted from said cylinders, cylinder-by-cylinder air-fuel ratio-estimating means for estimating an air-fuel ratio of a mixture supplied to each of said cylinders, separately from other ones of said cylinders, based on an output from said air-fuel ratio-detecting means and a model representative of a behavior of said exhaust passage, and cylinder-by-cylinder feedback control means for controlling said air-fuel ratio of said mixture supplied to said each of said cylinders in a feedback manner responsive to the estimated air-fuel ratio of said mixture such that the estimated value of said air-fuel ratio of said mixture supplied to said each of said cylinders is converged to a desired air-fuel ratio, the improvement comprising:

stoichiometric output deterioration-detecting means for detecting stoichiometric output deterioration of said air-fuel ratio-detecting means such that said output from said air-fuel ratio-detecting means, corresponding to a stoichiometric air-fuel ratio, deviates from a proper value by an amount exceeding a predetermined amount; and inhibiting means for inhibiting operation of said cylinder-by-cylinder feedback control means when said stoichiometric output deterioration of said air-fuel ratio-detecting means is detected by said stoichiometric output deterioration-detecting means.

11. An air-fuel ratio control system according to claim 10, including second air-fuel ratio-detecting means having an output characteristic that an output from said second air-fuel ratio-detecting means sharply changes as said air-fuel ratio of exhaust gases changes across a narrow range including said stoichiometric air-fuel ratio, said stoichiometric output deterioration-detecting means having desired air-fuel ratio-changing means responsive to said output from said second air-fuel ratio-detecting means, for progressively changing said desired air-fuel ratio with respect to said stoichiometric air-fuel ratio, average air-fuel ratio value-calculating means for calculating an average value of values of said air-fuel ratio detected by said first-mentioned air-fuel ratio-detecting means of time points of inversion of said output of said second air-fuel ratio-detecting means caused by said progressive change of said desired air-fuel ratio; and determining means for determining that said first-mentioned air-fuel ratio-detecting means suffers from said stoichiometric output deterioration when a difference between said average value of said values of said air-fuel ratio detected by said first-mentioned air-fuel ratio-detecting means and said stoichiometric air-fuel ratio exceeds a predetermined value.

12. An air-fuel ratio control system according to claim 10, including second air-fuel ratio-detecting means having an output characteristic that an output from said second air-fuel ratio-detecting means sharply changes as said air-fuel ratio of exhaust gases changes across a narrow range including said stoichiometric air-fuel ratio, said stoichiometric output deterioration-detecting means having determining means for determining that said first-mentioned air-fuel ratio-detecting means suffers from said stoichiometric output deterioration when an average value of a correction amount set based on said output from said second air-fuel ratio-detecting means for correcting said desired air-fuel ratio exceeds a predetermined value.

13. An air-fuel ratio control system according to claim 10, wherein said cylinder-by-cylinder air-fuel ratio-estimating means includes observer means for observing an internal operative state of said exhaust passage by means of said model representative of said behavior of said exhaust passage, and for estimating said air-fuel ratio of said mixture supplied to said each of said cylinders, based on said output from said air-fuel ratio-detecting means.

14. In an air-fuel ratio control system for an internal combustion engine having a plurality of cylinders, and an exhaust passage connected to said plurality of cylinders, said air-fuel ratio control system including air-fuel ratio-detecting means arranged in said exhaust passage and being capable of detecting at least leaner values of an air-fuel ratio of exhaust gases emitted from said cylinders than a stoichiometric air-fuel ratio, cylinder-by-cylinder air-fuel ratio-estimating means for estimating an air-fuel ratio of a mixture supplied to each of said cylinders, separately from other ones of said cylinders, based on an output from said air-fuel ratio-detecting means and a model representative of a behavior of said exhaust passage, and cylinder-by-cylinder feedback control means for controlling said air-fuel ratio of said mixture supplied to said each of said cylinders in a feedback manner responsive to the estimated air-fuel ratio of said mixture such that the estimated value of said air-fuel ratio of said mixture supplied to said each of said cylinders is converged to a desired air-fuel ratio, the improvement comprising:

lean output deterioration-detecting means for detecting lean output deterioration of said air-fuel ratio-detecting means that said output from said air-fuel ratio-detecting means corresponding to a predetermined value leaner than said stoichiometric air-fuel ratio deviates from a proper value by an amount exceeding a predetermined amount, said cylinder-by-cylinder feedback control means setting said desired air-fuel ratio to a value equal to or close to said stoichiometric air-fuel ratio when said lean output deterioration of said air-fuel ratio-detecting means is detected by said lean output deterioration-detecting means.

15. An air-fuel ratio control system according to claim 14, wherein said lean output deterioration-detecting means determines that said air-fuel ratio-detecting means suffers form said lean output deterioration when said output from said air-fuel ratio-detecting means continuously falls outside a predetermined range after a predetermined time period has elapsed from a time point of interruption of fuel supply to said engine.

16. An air-fuel ratio control system according to claim 15, including permitting means responsive to interruption of fuel supply to said engine, for permitting said lean output deterioration-detecting means to detect said lean output deterioration of said air-fuel ratio-detecting means when said engine is operating in a lean control region in which said air-fuel ratio of said mixture is controlled to a leaner value than said stoichiometric air-fuel ratio.

17. An air-fuel ratio control system according to claim 14, wherein said cylinder-by-cylinder air-fuel ratio-estimating means includes observer means for observing an internal operative state of said exhaust passage by means of said model representative of said behavior of said exhaust passage, and for estimating said air-fuel ratio of said mixture supplied to said each of said cylinders, based on said output from said air-fuel ratio-detecting means.

18. In an air-fuel ratio control system for an internal combustion engine having a plurality of cylinders, and an exhaust passage connected to said plurality of cylinders, said air-fuel ratio control system including air-fuel ratio-detecting means arranged in said exhaust passage, for detecting an air-fuel ratio of exhaust gases emitted from said cylinders, cylinder-by-cylinder air-fuel ratio-estimating means for estimating an air-fuel ratio of a mixture supplied to said each of said cylinders, separately from other ones of said cylinders, based on an output from said air-fuel ratio-detecting means and a model representative of a behavior of said exhaust passage, and cylinder-by-cylinder feedback control means for controlling said air-fuel ratio of said mixture supplied to said each of said cylinders in a feedback manner by the use of at least one of a proportional control term, an integral control term, and a differential control term, which are calculated based on the estimated air-fuel ratio of said mixture supplied to said each of said cylinders, such that the estimated value of said air-fuel ratio of said mixture supplied to said each of said cylinders is converged to a desired air-fuel ratio, the improvement comprising:

response deterioration-detecting means for detecting deterioration of a response characteristic of said air-fuel ratio-detecting means, said cylinder-by-cylinder feedback control means for controlling the air-fuel ratio of said mixture supplied to said each of said cylinders in said feedback manner by changing said at least one of said proportional term, said integral term, and said differential term to a smaller value when said deterioration of said response characteristic of said air-fuel ratio-detecting means is detected by said response deterioration-detecting means.

19. An air-fuel ratio control system according to claim 18, wherein said response deterioration-detecting means detects said deterioration of said response characteristic of said air-fuel ratio-detecting means based on a repetition period of inversion of said air-fuel ratio with respect to a stoichiometric air-fuel ratio detected by said air-fuel ratio-detecting means, which is obtained when said air-fuel ratio detected by said air-fuel ratio-detecting means is feedback-controlled to said stoichiometric air-fuel ratio.

20. An air-fuel ratio control system according to claim 18, wherein said response deterioration-detecting means detects said deterioration of said response characteristic of said air-fuel ratio-detecting means, based on a time period elapsed from a time point of interruption of fuel supply to said engine to a time point at which said air-fuel ratio detected by said air-fuel ratio-detecting means becomes equal to a predetermined value.

21. An air-fuel ratio control system according to claim 18, wherein said cylinder-by-cylinder air-fuel ratio-estimating means includes observer means for observing an internal operative state of said exhaust passage by means of said model representative of said behavior of said exhaust passage, and for estimating said air-fuel ratio of said mixture supplied to said each of said cylinders, based on said output from said air-fuel ratio-detecting means.

* * * * *